US006979529B2

(12) United States Patent
Katoh et al.

(10) Patent No.: US 6,979,529 B2
(45) Date of Patent: Dec. 27, 2005

(54) METHINE DYE AND SILVER HALIDE PHOTOGRAPHIC LIGHT-SENSITIVE MATERIAL CONTAINING THE METHINE DYE

(75) Inventors: Takashi Katoh, Kanagawa (JP); Hiroo Takizawa, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 706 days.

(21) Appl. No.: 09/842,086

(22) Filed: Apr. 26, 2001

(65) Prior Publication Data

US 2002/0086250 A1 Jul. 4, 2002

(30) Foreign Application Priority Data

| | | |
|---|---|---|
| Apr. 27, 2000 | (JP) | P.2000-128040 |
| Aug. 11, 2000 | (JP) | P.2000-244785 |
| Sep. 5, 2000 | (JP) | P.2000-268925 |
| Sep. 18, 2000 | (JP) | P.2000-282028 |

(51) Int. Cl.[7] ..... G03C 1/005; G03C 1/494

(52) U.S. Cl. ..... 430/574; 430/570; 430/576; 430/581; 430/583

(58) Field of Search ..... 430/570, 574, 430/576, 581, 583

(56) References Cited

U.S. PATENT DOCUMENTS

| | | | | | |
|---|---|---|---|---|---|
| 3,976,493 | A | * | 8/1976 | Borror et al. | 430/579 |
| 5,032,500 | A | * | 7/1991 | Ikeda et al. | 430/570 |
| 5,288,738 | A | * | 2/1994 | Vishwakarma et al. | 430/570 |
| 5,871,897 | A | * | 2/1999 | Katoh | 430/581 |
| 6,048,681 | A | * | 4/2000 | Suzumoto et al. | 430/570 |
| 6,333,146 | B1 | * | 12/2001 | Kobayashi et al. | 430/570 |

* cited by examiner

*Primary Examiner*—Geraldine Letscher
(74) *Attorney, Agent, or Firm*—Sughrue Mion, PLLC

(57) ABSTRACT

A silver halide photographic light-sensitive material is disclosed, comprising a support having thereon at least on light-sensitive halide emulsion layer, wherein the emulsion layer contains a compound represented by formula (1).

8 Claims, No Drawings

METHINE DYE AND SILVER HALIDE PHOTOGRAPHIC LIGHT-SENSITIVE MATERIAL CONTAINING THE METHINE DYE

FIELD OF THE INVENTION

The present invention relates to a novel methine dye compound, more specifically, the present invention relates to a connection-type methine dye compound in which two chromophores are connected, and a silver halide photographic light-sensitive material comprising the compound.

BACKGROUND OF THE INVENTION

Methine compounds have been conventionally used as a spectral sensitizing dye for silver halide photographic light-sensitive materials. Heretofore, with respect to the technology for improving the light absorptivity of silver halide grain, the following techniques are known. In order to improve the light absorptivity per one grain, the adsorption density of the sensitizing dye to a silver halide grain must be increased, however, a normal spectral sensitizing dye adsorbs to a monomolecular layer almost in the highest density filling state and does not adsorb any more.

In order to solve this problem, several proposals have heretofore been made. P. B. Gilman, Jr. et al., *Photographic Science and Engineering*, Vol. 20, No. 3, page 97 (1976), describes a technique of allowing a cationic dye to adsorb to the first layer and allowing an anionic dye to adsorb to the second layer using electrostatic force. U.S. Pat. No. 3,622,316 (G. B. Bird et al.) describes a technique of allowing a plurality of dyes to adsorb to a silver halide grain to form multiple layers and attaining the sensitization by virtue of Forster type excited energy transfer.

JP-A-63-138341 (the term "JP-A" as used herein means an "unexamined published Japanese patent application") and JP-A-64-84244 (both Sugimoto et al.) describes a technique of attaining spectral sensitization using the energy transfer from a light-emitting dye.

These techniques have been created with an attempt to allow a dye to adsorb to a silver halide grain in excess of the saturated adsorption amount, however, the effect of elevating the sensitivity is not so high but on the contrary, the intrinsic desensitization disadvantageously increases.

On the other hand, U.S. Pat. Nos. 2,393,351, 2,425,772, 2,518,732, 2,521,944 and 2,592,196 and European Patent 565,083 described a 2 components-linked dye in which two or more non-conjugated dye chromophores are connected through a covalent bond. This technique is, however, not intended to improve the light absorptivity. For aggressively improving the light absorptivity, U.S. Pat. Nos. 3,622,317 and 3,976,493 (both G. B. Bird et al.) describe a technique of allowing a connection-type sensitizing dye molecule having a plurality of cyanine chromophores to adsorb to a grain and thereby increasing the light absorptivity, with an attempt to attain sensitization by the energy transfer, where, however, remarkable enhancement of the sensitivity is not obtained.

JP-A-64-91134 (Ukai et al.) proposes a technique of connecting a substantially non-adsorptive dye containing at least two sulfo or carboxy groups to at least one spectral sensitizing dye capable of adsorbing onto silver halide.

Also, in the spectral sensitization, JP-A-6-27578 (Vishwakarma) uses a 2 components-connected dye in which a cyanine dye adsorptive to silver halide and an oxonol not adsorptive to silver halide are connected, or European Patent 887700A1 (Parton et al.) uses a 2 components-connected dye in which an adsorptive cyanine dye and a nonadsorptive merocyanine dye or the like are connected using a specific linking group. In these techniques, however, the sensitivity is not sufficiently elevated by the energy transfer.

As such, sufficiently high elevation of the sensitivity is not yet achieved in any of these patents or publications and more technical development is being demanded.

SUMMARY OF THE INVENTION

Accordingly, one object of the present invention is to provide a novel methine-connected dye.

Another object of the present invention is to provide a high-sensitivity silver halide photographic light-sensitive material comprising the dye.

These objects of the present invention can be attained by the following means.

(1) A silver halide photographic light-sensitive material comprising a support having thereon at least one light-sensitive silver halide emulsion layer, wherein the emulsion layer contains a compound represented by the following formula (1):

$$\text{Dye1-}(L_1\text{-}(\text{Dye2})_{m1})_{m2} \qquad (1)$$

wherein $L_1$ represents a linking group, m1 represents an integer of 1 to 5, m2 represents an integer of 1 to 5, Dye1 represents a first chromophore, and Dye2 represents a second chromophore represented by formula (2):

(2)

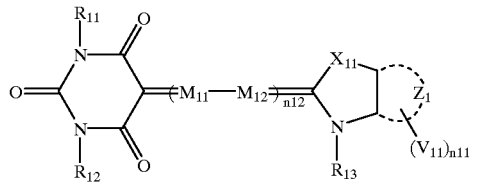

wherein $R_{11}$, $R_{12}$, $R_{13}$ each independently represents a hydrogen atom, an alkyl group, an alkenyl group, an aryl group or a heterocyclic group; $M_{11}$ and $M_{12}$ each independently represents a methine group; n12 represents an integer of 0 to 3; $Z_1$ represents an atomic group for forming a benzene ring condensed with a benzene ring, a naphthalene ring or a heterocyclic ring; $V_{11}$ represents a substituent on the ring formed by $Z_1$; n11 represents an integer of 0 to 8, provided that when n11 is 2 or more, $V_{11}$ may be the same or different or may be combined with each other to form a ring; $X_{11}$ represents —O—, —S— or —$NR_{14}$—; $R_{14}$ represents a hydrogen atom, an alkyl group, an alkenyl group, an aryl group, a heterocyclic group, provided that when $X_{11}$ is —O—, the ring formed by $Z_1$ is not an uncondensed benzene ring, that when $X_{11}$ is —S—, $L_1$ does not contain an ether group, a urethane group (—NRCOO—) or a fluorine atom, and that when $X_{11}$ is —$NR_{14}$—, $L_1$ does not contain a urethane group (—NRCOO—) or a fluorine atom; and the linking group $L_1$ is connected to any one of $R_{12}$, $R_{13}$ and $V_{11}$.

(2) The silver halide photographic light-sensitive material as described in (1), wherein in the compound represented by formula (1), $L_1$ is represented by -$G_1$-($A_1$-$G_2$-)$_{z1}$- (wherein $G_1$ and $G_2$ each independently represents an alkylene group, an alkenylene group or an arylene group, $A_1$ represents, irrespective of the direction, —O—, —$SO_2$—, —S—, —$NR_3$—, —COO—, —$CONR_4$— or —$SO_2NR_5$—, $R_3$ to $R_5$ each independently represents a hydrogen atom, an alkyl group, an alkenyl group, an aryl group or a heterocyclic group, and t1 represents an integer of 1 to 10).

(3) The silver halide photographic light-sensitive material as described in (1) or (2), wherein in the compound represented by formula (1), each Dye1 independently represents a cyanine chromophore, a merocyanine chromophore or an oxonol chromophore (4) The silver halide photographic light-sensitive material as described in (1) to (3), wherein in the compound represented by formula (1), Dye1 is a cyanine chromophore.

(5) The silver halide photographic light-sensitive material as described in any one of (1) to (4), wherein the compound represented by formula (1) is represented by the following formula (3):

(3)

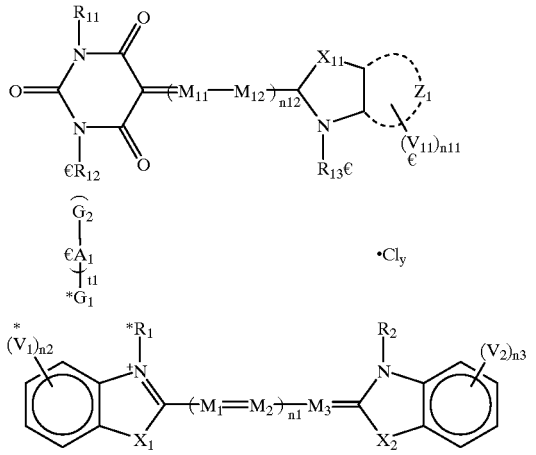

wherein $R_{11}$ to $R_{13}$, $M_{11}$, $M_{12}$, n11, n12, $X_{11}$, $Z_1$ and $V_{11}$ have the same meanings as defined in formula (2); $G_1$, $G_2$, $A_1$ and t1 have the same meanings as defined in (2); $X_1$ and $X_2$ each independently represents —O—, —S—, —$NR_6$ or —$CR_7R_8$—; $R_6$ to $R_8$ each independently represents a hydrogen atom, an alkyl group, an alkenyl group, an aryl group or a heterocyclic group; $R_1$ and $R_2$ each independently represents a hydrogen atom, an alkyl group, an alkenyl group, an aryl group or a heterocyclic group; $M_1$ to $M_3$ each independently represents a methine group; n1 represents an integer of 0 to 3; $V_1$ and $V_2$ each represents a substituent; n2 and n3 each represents an integer of 0 to 4, provided that when n2 and n3 each is 2 or more, the substituents $V_1$ or the substituents $V_2$ may be the same or different or may be combined with each other to form a ring; CI represents an ion for neutralizing the electric charge; y represents a number necessary for neutralizing the electric charge; $G_1$ is connected to Dye1 through $R_1$ or $V_1$; $G_2$ is connected to Dye2 through $R_{12}$, $R_{13}$ or $V_{11}$; when $X_{11}$ is —O—, the ring formed by $Z_1$ is not an uncondensed benzene ring, when $X_{11}$ is —S—, $L_1$ does not contain an ether group, a urethane group (—NRCOO—) or a fluorine atom, and when $X_{11}$ is —$NR_{14}$—, $L_1$ does not contain a urethane group (—NRCOO—) or a fluorine atom.

(6) The silver halide photographic light-sensitive material as described in any one of (2) to (5), wherein in the compound represented by formula (1) or (3), $G_1$ and $G_2$ each is an alkylene group.

(7) The silver halide photographic light-sensitive material as described in any one of (2) to (6), wherein in the compound represented by formula (1) or (3), $A_1$ is —O—, —$SO_2$—, —COO— or —$CONR_3$—.

(8) The silver halide photographic light-sensitive material as described in any one of (5) to (7), wherein in the compound represented by formula (3), $X_1$ and $X_2$ each is —O— or —S—.

(9) The silver halide photographic light-sensitive material as described in any one of (5) to (8), wherein in the compound represented by formula (3), $G_1$ is connected with $R_1$ and $G_2$ is connected with $R_{12}$.

(10) The silver halide photographic light-sensitive material as described in any one of (1) to (9), wherein in the compound represented by formula (1) or (3), $X_{11}$ is —O— and the ring formed by $Z_1$ is a naphthalene ring, a dibenzofuran ring, a dibenzothiophene ring or a carbazole ring.

(11) A silver halide photographic light-sensitive material comprising a support having thereon at least one light-sensitive silver halide emulsion layer, wherein the emulsion layer contains at least one compound represented by the following formula (4):

(4)

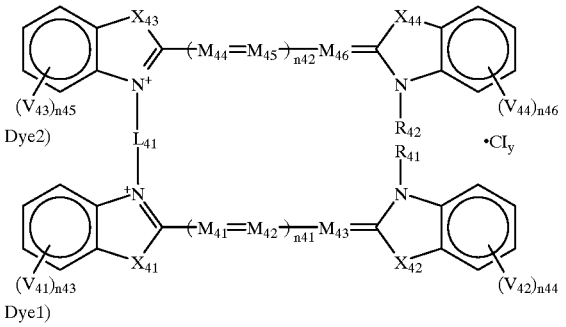

wherein $X_{41}$ to $X_{44}$ each independently represents —O—, —S—, —$NR_{43}$— or —$CR_{44}R_{45}$—; $R_{43}$ to $R_{45}$ each independently represents a hydrogen atom, an alkyl group, an alkenyl group, an aryl group or heterocyclic group; $R_{41}$ and $R_{42}$ each independently represents a hydrogen atom, an alkyl group, an alkenyl group, an aryl group or a heterocyclic group; $M_{41}$ to $M_{46}$ each independently represents a methine group; n41 and n42 each independently represents an integer of 0 to 3; $L_{41}$ represents a linking group having at least one hetero atom except for an amido group and an ester group; $V_{41}$ to $V_{44}$ each represents a substituent; n43 to n46 each represents an integer of 0 to 4, provided that when n43 to n46 each is 2 or more, the substituents $V_{41}$, $V_{42}$, $V_{43}$ or $V_{44}$ may be the same or different or may be combined with each other to form a ring; CI represents an ion for neutralizing the electric charge; and y represents a number necessary for neutralizing the electric charge.

(12) The silver halide photographic light-sensitive material as described in (11), wherein in the compound represented by formula (4), $L_{41}$ is represented by -$L_{42}$-($A_{41}$-$L_{43}$-)$_{t41}$- (wherein $A_{41}$ represents, irrespective of the direction, —COO—, —$CONR_{46}$— or —$SO_2NR_{47}$—, $R_{46}$ and $R_{47}$ each independently represents a hydrogen atom, an alkyl group, an alkenyl group, an aryl group or a heterocyclic group, t41 represents an integer of 0 to 10, $L_{42}$ and $L_{43}$ each independently represents an alkylene group, an alkenylene group, an arylene group or -$G_{41}$-($A_{42}$-$G_{42}$)$_{t42}$-, $G_{41}$ and $G_{42}$ each independently represents an alkylene group, an alkenylene group or an arylene group, $A_{42}$ represents, irrespective of the direction, —O—, —S—, —$NR_{43}$— or —$SO_2$—, t42 represents an integer of 1 to 10, provided that when t41 is 0, $L_{42}$ is $-G_{41}-(A_{42}-G_{42})_{t42}-$ and when t41 is 1 or more, at least one of $L_{42}$ and $L_{43}$ is $-G_{41}-(A_{42}-G_{42})_{t42}-$.

(13) The silver halide photographic light-sensitive material as described in (11) or (12), wherein in the compound represented by formula (4), $X_{41}$ to $X_{44}$ each is —O— or —S—.

(14) The silver halide photographic light-sensitive material as described in (11) to (13), wherein in the compound represented by formula (4), n41 and n42 both are 0 or n41 and n42 both are 1.

(15) The silver halide photographic light-sensitive material as described in (11) to (14), wherein in the compound represented by formula (4), $L_{42}$ and $L_{43}$ each is an alkylene group or $-G_{41}-(A_{42}-G_{42}-)_{t42}-$.

(16) The silver halide photographic light-sensitive material as described in (11) to (15), wherein in the compound represented by formula (4), $A_{41}$ is $—CONR_{46}—$.

(17) The silver halide photographic light-sensitive material as described in (11) to (16), wherein in the compound represented by formula (4), $A_{42}$ is —O—.

(18) A silver halide photographic light-sensitive material comprising a support having thereon at least one light-sensitive silver halide emulsion layer, wherein the emulsion layer contains a compound represented by the following formula (5):

(5)

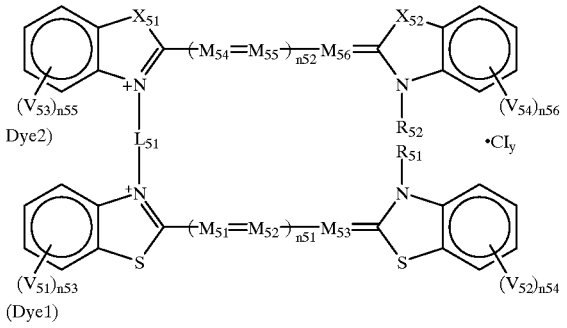

wherein $X_{51}$ and $X_{52}$ each independently represents —O—, —S— or $—NR_{53}—$; $R_{53}$ represents a hydrogen atom, an alkyl group, an alkenyl group, an aryl group or heterocyclic group; $R_{51}$ and $R_{52}$ each independently represents a hydrogen atom, an alkyl group, an alkenyl group, an aryl group or a heterocyclic group; $M_{51}$ to $M_{56}$ each independently represents a methine group; n51 and n52 each independently represents an integer of 0 to 3; $L_{51}$ represents a linking group; $V_{51}$ to $V_{54}$ each independently represents a substituent; n53 to n56 each independently represents an integer of 0 to 4, provided that when n53 to n56 each is 2 or more, the substituents $V_{51}$, $V_{52}$, $V_{53}$ or $V_{54}$ may be the same or different or may be combined with each other to form a ring; CI represents an ion for neutralizing the electric ion for neutralizing the electric charge; and y represents a number necessary for neutralizing the electric charge.

(19) The silver halide photographic light-sensitive material as described in (18), wherein in the compound represented by formula (5), $L_{51}$ is represented by $-L_{52}-(A_{51}-L_{53}-)_{t51}-$ (wherein $A_{51}$ represents, irrespective of the direction, —COO—, $—CONR_{54}—$ or $—SO_2NR_{55}—$, $R_{54}$ and $R_{55}$ each independently represents a hydrogen atom, an alkyl group, an alkenyl group, an aryl group or a heterocyclic group, $L_{52}$ and $L_{53}$ each independently represents an alkylene group which is not substituted by fluorine, an alkenylene group which is not substituted by fluorine or an arylene group which is not substituted by fluorine, and t52 represents an integer of 1 to 10.

(20) The silver halide photographic light-sensitive material as described in (18) or (19), wherein in the compound represented by formula (5), $X_{51}$ and $X_{52}$ both are —S—.

(21) The silver halide photographic light-sensitive material as described in any one of (18) to (20), wherein in the compound represented by formula (5), n51 and n52 both are 0.

(22) The silver halide photographic light-sensitive material as described in any one of (19) to (21), wherein in the compound represented by formula (5), $L_{51}$ and $L_{52}$ both are an alkylene group which is not substituted by fluorine.

(23) The silver halide photographic light-sensitive material as described in any one of (19) to (22), wherein in the compound represented by formula (5), $A_{51}$ is $—CONR_{54}—$.

(24) A silver halide photographic light-sensitive material comprising a compound represented by the following formula (6)

$$A_{61}-(L_{61}-(A_{62})_{n61})_{m61} \quad (6)$$

wherein $A_{61}$ represents a first chromophore, $A_{62}$ represents a second chromophore, provided that at least one of $A_6$ and $A_{62}$ is not isomerized in the state where the geometrical isomer with respect to the methine chain is excited, $L_{61}$ represents a linking group or a single bond, and n61 and m61 each represents an integer of 1 to 5.

(25) The silver halide photographic light-sensitive material as described in (24), wherein in at least one of $A_{61}$ and $A_{62}$ of the compound represented by formula (6), a methine group is fixed by a crosslinked structure.

(26) A silver halide photographic light-sensitive material comprising a compound represented by formula (7):

$$A_{63}-(L_{62}-(A_{64})_{n62})_{m62} \quad (7)$$

wherein $A_{63}$ is a first chromophore, $A_{64}$ is a second chromophore, provided that in at least one of $A_{63}$ and $A_{64}$, from 1 to 10 dissociative groups are directly substituted to the chromophore, $L_{62}$ represents a linking group or a single bond, and $n_{62}$ and $m_{62}$ each represents an integer of 1 to 5.

(27) The silver halide photographic light-sensitive material as described in (26), wherein in at least one of $A_{63}$ and $A_{64}$ of the compound represented by formula (7), from 2 to 5 dissociative groups are directly substituted to the chromophore.

(28) The silver halide photographic light-sensitive material as described in (24), wherein in at least one of $A_{61}$ and $A_{62}$ of the compound represented by formula (6), from 1 to 10 dissociative groups are directly substituted to the chromophore.

(29) The silver halide photographic light-sensitive material as described in any one of (26) to (28), wherein in the compound represented by formula (6) or (7), the dissociative group is a sulfonic acid group.

(30) The silver halide photographic light-sensitive material as described in any one of (24) to (29), wherein in the compound represented by formula (6) or (7), $A_1$, $A_2$, $A_3$ and $A_4$ each is a cyanine chromophore.

(31) The silver halide photographic light-sensitive material as described in any one (1) to (30), wherein in the compound represented by formula (1), (3), (4), (5), (6) or (7), the adsorption strength to silver halide grain is Dye1>Dye2, $A_{61}>A_{63}$ or $A_{62}>A_{64}$.

(32) The silver halide photographic light-sensitive material as described in any one of (1) to (31), wherein the compound represented by formula (1), (3), (4), (5), (6) or (7)

adsorbs to a silver halide grain through Dye1, $A_{61}$ or $A_{63}$ and forms a J-association product and when Dye2, $A_{62}$ or $A_{64}$ not adsorbed to a silver halide grain is excited by light, the excited electron or energy causes electron transfer or energy transfer to Dye1.

(33) The silver halide photographic light-sensitive material as described in any one of (1) to (32), wherein the compound represented by formula (1), (3), (4), (5), (6) or (7) adsorbs to a silver halide grain through Dye1, $A_{61}$ or $A_{63}$ and forms a J-association product, and Dye2, $A_{62}$ or $A_{64}$ not adsorbed to a silver halide grain also forms a J-association product.

(34) The silver halide photographic light-sensitive material as described in any one of (1) to (33), wherein the silver halide photographic emulsion containing a compound represented by formula (1), (3), (4), (5), (6) or (7) is an emulsion in which tabular grains having an aspect ratio of 2 or more are present in a proportion of 50% (by area) or more of all silver halide grains in the emulsion.

(35) The silver halide photographic light-sensitive material as described in any one of (1) to (34), wherein the silver halide photographic emulsion containing a compound represented by formula (1), (3), (4), (5), (6) or (7) is subjected to selenium sensitization.

(36) A dye represented by formula (2).

(37) A dye represented by formula (3).

(38) A dye represented by the following formula (8):

(8)

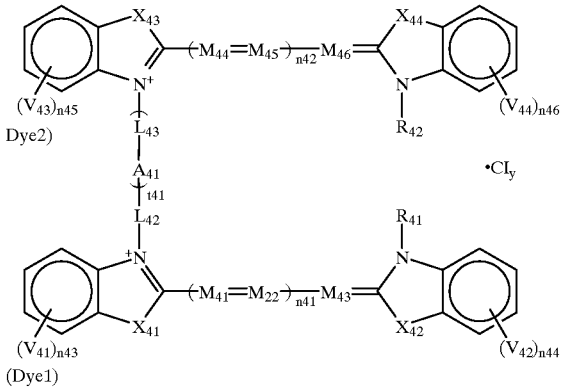

wherein $X_{41}$ to $X_{44}$ each independently represents —O—, —S—, —$NR_{43}$— or —$CR_{44}R_{45}$—; $R_{43}$ to $R_{45}$ each independently represents a hydrogen atom, an alkyl group, an alkenyl group, an aryl group or heterocyclic group; $R_{41}$ and $R_{42}$ each independently represents a hydrogen atom, an alkyl group, an alkenyl group, an aryl group or a heterocyclic group; $M_{41}$ to $M_{46}$ each independently represents a methine group; n41 and n42 each independently represents an integer of 0 to 3; $A_{41}$ represents, irrespective of the direction, —COO—, —$CONR_{46}$— or —$SO_2NR_{47}$—; $R_{46}$ and $R_{47}$ each independently represents a hydrogen atom, an alkyl group, an alkenyl group, an aryl group or a heterocyclic group; t41 represents an integer of 0 to 10; $L_{42}$ and $L_{43}$ each independently represents an alkylene group, an alkenylene group, an arylene group or -$G_{41}$-($A_{42}$-$G_{42}$-)$_{t42}$-; $G_{41}$ and $G_{42}$ each independently represents an alkylene group, an alkenylene group or an arylene group; $A_{42}$ represents, irrespective of the direction, —O—, —S—, —$NR_{43}$— or —$SO_2$—; t42 represents an integer of 1 to 10, provided that when $t_{41}$ s 0, $L_{42}$ represents -$G_{41}$-($A_{42}$-$G_{42}$-)$_{t42}$- and when t41 is 1 or more, at least one of $L_{42}$ and $L_{43}$ is -$G_{41}$-($A_{42}$-$G_{42}$-)$_{t42}$-; $V_{41}$ to $V_{44}$ each represents a substituent; n43 to n46 each represents an integer of 0 to 4, provided that when n43 to n46 each is 2 or more, the substituents $V_{41}$, $V_{42}$, $V_{43}$ or $V_{44}$ may be the same or different or may be combined with each other to form a ring; CI represents an ion for neutralizing the electric charge; and y represents a number necessary for neutralizing the electric charge.

(39) The dye as described in (38), wherein in the compound represented by formula (8) $X_{41}$ to $X_{44}$ each is —O— or —S—.

(40) The dye as described in (38) or (39), wherein in the compound represented by formula (8), n41 and n42 both are 0 or n41 and n42 both are 1.

(41) The dye as described in (38) to (40), wherein in the compound represented by formula (8), $L_{42}$ and $L_{43}$ each is an alkylene group or -$G_{41}$-($A_{42}$-$G_{42}$-)$_{t42}$-.

(42) The dye as described in (38) to (41), wherein in the compound represented by formula (8), $A_{41}$ is —$CONR_{46}$—.

(43) The dye as described in (38) to (42), wherein in the compound represented by formula (8), $A_{42}$ is —O—.

(44) A dye represented by formula (9):

(9)

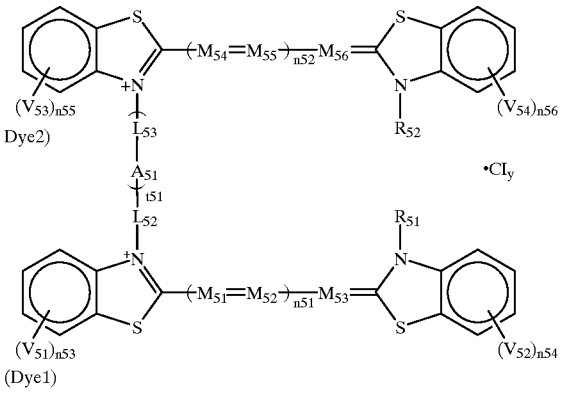

wherein $R_{51}$ and $R_{52}$ each independently represents a hydrogen atom, an alkyl group, an alkenyl group, an aryl group or a heterocyclic group; $M_{51}$ to $M_{56}$ each independently represents a methine group; n51 and n52 each independently represents an integer of 0 to 3; $A_{51}$ represents, irrespective of the direction, —COO—, —$CONR_{54}$— or —$SO_2NR_{55}$—; $R_{54}$ and $R_{55}$ each independently represents a hydrogen atom, an alkyl group, an alkenyl group, an aryl group or a heterocyclic group; $L_{52}$ and $L_{53}$ each independently represents an alkylene group which is not substituted by fluorine, an alkenylene group which is not substituted by fluorine, or an arylene group which is not substituted by fluorine; t51 represents an integer of 1 to 10; $V_{51}$ to $V_{54}$ each independently represents a substituent; n53 to n56 each independently represents an integer of 0 to 4, provided that when n53 to n56 each is 2 or more, the substituents $V_{51}$, $V_{52}$, $V_{53}$ or $V_{54}$ may be the same or different or may be combined with each other to form a ring; CI represents an ion for neutralizing the electric charge; and y represents a number necessary for neutralizing the electric charge.

(45) The dye as described in (44), wherein in formula (9), n51 and n52 both are 0.

(46) The dye as described in (44) or (45), wherein $L_{52}$ and $L_{53}$ both are an alkylene group which is not substituted by fluorine.

DETAILED DESCRIPTION OF THE INVENTION

The compound represented by formula (1) of the present invention is described in detail below.

When the compound of the present invention has an alkyl group, an alkylene group, an alkenyl group or an alkenylene group, unless otherwise indicated, these groups each may be linear or branched or may be substituted or unsubstituted.

When the compound of the present invention has a cycloalkyl group, an aryl group, a heterocyclic group, a cycloalkenylene group, an arylene group or a heterylene group, unless otherwise indicated, these groups each may be a monocyclic ring or a condensed ring or may be substituted or unsubstituted.

In the present invention, when a specific site is called "a group", the site itself may not be substituted or may be substituted by one or more (to a possible maximum number) substituents.

For example, "an alkyl group" means a substituted or unsubstituted alkyl group. Furthermore, the substituents which can be used in the compound for use in the present invention include, irrespective of the presence or absence of substitution, any substituent. For example, the following substituents W may be used.

The substituent represented by W may be any substituent and is not particularly limited, however, examples thereof include a halogen atom, an alkyl group [including cycloalkyl group, bicycloalkyl group and tricycloalkyl group, and also including an alkenyl group (including cycloalkenyl group and tricycloalkenyl group) and an alkynyl group], an aryl group, a heterocyclic group, a cyano group, a hydroxyl group, a nitro group, a carboxyl group, an alkoxy group, an aryloxy group, a silyloxy group, a heterocyclic oxy group, an acyloxy group, a carbamoyloxy group, an alkoxycarbonyloxy group, an aryloxycarbonyloxy group, an amino group (including an anilino group), an ammonio group, an acylamino group, an aminocarbonylamino group, an alkoxycarbonylamino group, an aryloxycarbonylamino group, a sulfamoylamino group, an alkylsulfonylamino group, an arylsulfonylamino group, a mercapto group, an alkylthio group, an arylthio group, a heterocyclic thio group, a sulfamoyl group, a sulfo group, an alkylsulfinyl group, an arylsulfinyl group, an alkylsulfonyl group, an arylsulfonyl group, an acyl group, an aryloxycarbonyl group, an alkoxycarbonyl group, a carbamoyl group, an arylazo group, a heterocyclic azo group, an imido group, a phosphino group, a phophinyl group, a phosphinyloxy group, a phosphinylamino group, a phospho group, a silyl group, a hydrazino group, a ureido group and other known substituents.

More specifically, W represents a halogen atom (e.g., fluorine, chlorine, bromine, iodine), an alkyl group [which means a linear, branched or cyclic, or substituted or unsubstituted alkyl group and which includes an alkyl group (preferably an alkyl group having from 1 to 30 carbon atoms, e.g., methyl, ethyl, n-propyl, isopropyl, tert-butyl, n-octyl, eicosyl, 2-chloroethyl, 2-cyanoethyl, 2-ethylhexyl), a cycloalkyl group (preferably a substituted or unsubstituted cycloalkyl group having from 3 to 30 carbon atoms, e.g., cyclohexyl, cyclopentyl, 4-n-dodecyl-cyclohexyl), a bicycloalkyl group (preferably a substituted or unsubstituted bicycloalkyl group having from 5 to 30 carbon atoms, namely, a monovalent group resulting from removing one hydrogen atom of a bicycloalkane having from 5 to 30 carbon atoms, e.g., bicyclo[1,2,2]heptan-2-yl, bicyclo[2,2,2]octan-3-yl), and a tricyclo structure having many cyclic structures; the alkyl group in the substituent described below (for example, an alkyl group in an alkylthio group) means an alkyl group having such a concept and also includes an alkenyl group and an alkynyl group], an alkenyl group [which means a linear, branched or cyclic, substituted or unsubstituted alkenyl group and which includes an alkenyl group (preferably a substituted or unsubstituted alkenyl group having from 2 to 30 carbon atoms, e.g., vinyl, allyl prenyl, geranyl, oreyl), a cycloalkenyl group (preferably a substituted or unsubstituted cycloalkenyl group having from 3 to 30 carbon atoms, namely, a monovalent group resulting from removing one hydrogen atom of a cycloalkene having from 3 to 30 carbon atoms, e.g., 2-cyclopenten-1-yl, 2-cyclohexen-1-yl), a bicycloalkenyl group (a substituted or unsubstituted bicycloalkenyl group, preferably a substituted or unsubstituted bicycloalkenyl group having from 5 to 30 carbon atoms, namely, a monovalent group resulting from removing one hydrogen atom of bicycloalkene having one double bond, e.g., bicyclo[2,2,]hept-2-en-1-yl, bicyclo [2,2,2]oct-2-en-4-yl)], an alkynyl group (preferably a substituted or unsubstituted alkynyl group having from 2 to 30 carbon atoms, e.g., ethynyl, propargyl, trimethylsilylethynyl), an aryl group (preferably a substituted or unsubstituted aryl group having from 6 to 30 carbon atoms, e.g., phenyl, p-tolyl, naphthyl, m-chlorophenyl, m-chlorophenyl, o-hexadecanoylaminophenyl), a heterocyclic group (preferably a monovalent resulting from removing one hydrogen atom of a 5- or 6-membered substituted or unsubstituted, aromatic or non-aromatic heterocyclic compound, more preferably a 5- or 6-membered aromatic heterocyclic group having from 3 to 30 carbon atoms, e.g., 2-furyl, 2-thienyl, 2-pyrimidinyl, 2-benzothiazolyl; the heterocyclic group may also be a cationic heterocyclic group such as 1-methyl-2-pyridinio and 1-methyl-2-quinolinio), a cyano group, a hydroxyl group, a nitro group, a carboxyl group, an alkoxy group (preferably a substituted or unsubstituted alkoxy group having from 1 to 30 carbon atoms, e.g., methoxy, ethoxy, isopropoxy, tert-butoxy, n-octyloxy, 2-methoxyethoxy), an aryloxy group (preferably a substituted or unsubstituted aryloxy group having from 6 to 30 carbon atoms, e.g., phenoxy, 2-methylphenoxy, 4-tert-butylphenoxy, 3-nitrophenoxy, 2-tetradecanoylaminophenoxy), a silyloxy group (preferably a silyloxy group having from 3 to 20 carbon atoms, e.g., trimethylsilyloxy, tert-butyldimethylsilyloxy), a heterocyclic oxy group (preferably a substituted or unsubstituted heterocyclic oxy group having 2 to 30 carbon atoms, e.g., 1-phenyltetrazole-5-oxy, 2-tetrahydropyranyloxy), an acyloxy group (preferably a formyloxy group, a substituted or unsubstituted alkylcarbonyloxy group having from 2 to 30 carbon atoms and a substituted or unsubstituted arylcarbonyloxy group having from 6 to 30 carbon atoms, e.g., formyloxy, acetyloxy, pivaloyloxy, stearoyloxy, benzoyloxy, p-methoxyphenylcarbonyloxy), a carbamoyloxy group (preferably a substituted or unsubstituted carbamoyloxy group having from 1 to 30 carbon atoms, e.g., N,N-dimethylcarbamoyloxy, N,N-diethylcarbamoyloxy, morpholinocarbonyloxy, N,N-di-n-octylaminocarbonyloxy, N-n-octylcarbamoyloxy), an alkoxycarbonyloxy group (preferably a substituted or unsubstituted alkoxycarbonyloxy group having from 2 to 30 carbon atoms, e.g., methoxycarbonyloxy, ethoxycarbonyloxy, tert-butoxycarbonyloxy, n-octylcarbonyloxy), an aryloxycarbonyloxy group (preferably a substituted or unsubstituted aryloxycarbonyloxy group having from 7 to 30 carbon atoms, e.g., phenoxycarbonyloxy, p-methoxyphenoxycarbonyloxy, p-n-hexadecyloxyphenoxycarbonyloxy), an amino group (preferably an amino group, a substituted or unsubstituted alkylamino group having from 1 to 30 carbon atoms and a substituted or unsubstituted anilino group having from 6 to 30 carbon atoms, e.g., amino, methylamino, dimethylamino, anilino, N-methyl-anilino, diphenylamino), an ammonio group (preferably an ammonio group and an ammonio group substituted by a substituted or unsubstituted alkyl, aryl or heterocyclic group having from 1 to 30 carbon atoms, e.g., trimethylammonio, triethylammonio, diphenylmethylammonio), an acylamino group (preferably a formylamino group, a substituted or unsubstituted alkylcarbonylamino group having from 1 to 30 carbon atoms and a substituted or unsubstituted arylcarbonylamino group having from 6 to 30 carbon atoms, e.g., formylamino, acetylamino, pivaloylamino, lauroylamino, benzoylamino, 3,4,5-tri-n-octyloxyphenylcarbonylamino), an aminocarbonylamino group (preferably a substituted or unsubstituted aminocarbonylamino group having from 1 to 30 carbon atoms, e.g., carbamoylamino, N,N-dimethylaminocarbonylamino, N,N-diethylaminocarbonylamino, morpholinocarbonylamino), an alkoxycarbonylamino group (preferably a substituted or unsubstituted alkoxycarbonylamino group having from 2 to 30 carbon atoms, e.g., methoxycarbonylamino, ethoxycarbonylamino, tert-butoxycarbonylamino, n-octadecyloxycarbonylamino, N-methylmethoxycarbonylamino), an aryloxycarbonylamino group (preferably a substituted or unsubstituted aryloxycarbonylamino group having from 7 to 30 carbon atoms, e.g., phenoxycarbonylamino, p-chlorophenoxycarbonylamino, m-n-octyloxyphenoxycarbonylamino), a sulfamoylamino group (preferably a substituted or unsubstituted sulfamoylamino group having from 0 to 30 carbon atoms, e.g., sulfamoylamino, N,N-dimethylaminosulfonylamino, N-n-octylaminosulfonylamino), an alkyl- or arylsulfonylamino group (preferably a substituted or unsubstituted alkylsulfonylamino group having from 1 to 30 carbon atoms, and a substituted or unsubstituted arylsulfonylamino group having from 6 to 30 carbon atoms, e.g., methylsulfonylamino, butylsulfonylamino, phenylsulfonylamino, 2,3,5-trichlorophenylsulfonylamino, p-methylphenylsulfonylamino), a mercapto group, an alkylthio group (preferably a substituted or unsubstituted alkylthio group having from 1 to 30 carbon atoms, e.g., methylthio, ethylthio, n-hexadecylthio), an arylthio group (preferably a substituted or unsubstituted arylthio having from 6 to 30 carbon atoms, e.g., phenylthio, p-chlorophenylthio, m-methoxyphenylthio), a heterocyclic thio group (preferably a substituted or unsubstituted heterocyclic thio group having from 2 to 30 carbon atoms, e.g., 2-benzothiazolylthio, 1-phenyltetrazole-5-ylthio), a sulfamoyl group (preferably a substituted or unsubstituted sulfamoyl group having from 0 to 30 carbon atoms, e.g., N-ethylsulfamoyl, N-(3-dodecyloxypropyl)sulfamoyl, N,N-dimethylsulfamoyl, N-acetylsulfamoyl, N-benzoylsulfamoyl, N-(N'-phenylcarbamoyl)sulfamoyl), a sulfo group, an alkyl- or arylsulfinyl group (preferably a substituted or unsubstituted alkylsulfinyl group having from 1 to 30 carbon atoms and a substituted or unsubstituted arylsulfinyl group having from 6 to 30 carbon atoms, e.g., methylsulfinyl, ethylsulfinyl, phenylsulfinyl, p-methylphenylsulfinyl), an alkyl- or arylsulfonyl group (preferably a substituted or unsubstituted alkylsulfonyl group having from 1 to 30 carbon atoms and a substituted or unsubstituted arylsulfonyl group having from 6 to 30 carbon atoms, e.g., methylsulfonyl, ethylsulfonyl, phenylsulfonyl, p-methylphenylsulfonyl), an acyl group (preferably a formyl group, a substituted or unsubstituted alkylcarbonyl group having from 2 to 30 carbon atoms, a substituted or unsubstituted arylcarbonyl group having from 7 to 30 carbon atoms, and a substituted or unsubstituted heterocyclic carbonyl group having from 4 to 30 carbon atoms and being bonded to a carbonyl group through a carbon atom, e.g., acetyl, pivaloyl, 2-chloroacetyl, stearoyl, benzoyl, p-n-octyloxyphenylcarbonyl, 2-pyridylcarbonyl, 2-furylcarbonyl), an aryloxycarbonyl group (preferably a substituted or unsubstituted aryloxycarbonyl group having from 7 to 30 carbon atoms, e.g., phenoxycarbonyl, o-chlorophenoxycarbonyl, m-nitrophenoxycarbonyl, p-tert-butylphenoxycarbonyl), an alkoxycarbonyl group (preferably a substituted or unsubstituted alkoxycarbonyl group having from 2 to 30 carbon atoms, e.g., methoxycarbonyl, ethoxycarbonyl, tert-butoxycarbonyl, n-octadecyloxycarbonyl), a carbamoyl group (preferably a substituted or unsubstituted carbamoyl group having from 1 to 30 carbon atoms, e.g., carbamoyl, N-methylcarbamoyl, N,N-dimethylcarbamoyl, N,N-di-n-octylcarbamoyl, N-(methylsulfonyl)carbamoyl), an aryl or heterocyclic azo group (preferably a substituted or unsubstituted arylazo group having from 6 to 30 carbon atoms and a substituted or unsubstituted heterocyclic azo group having from 3 to 30 carbon atoms, e.g., phenylazo, p-chlorophenylazo, 5-ethylthio-1,3,4-thiadiazol-2-ylazo), an imido group (preferably N-succinimido, N-phthalimido), a phosphino group (preferably a substituted or unsubstituted phosphino group having from 2 to 30 carbon atoms, e.g., dimethylphosphino, diphenylphosphino, methylphenoxyphosphino), a phosphinyl group (preferably a substituted or unsubstituted phosphinyl group having from 2 to 30 carbon atoms, e.g., phosphinyl, dioctyloxyphosphinyl, diethoxyphosphinyl), a phosphinyloxy group (preferably a substituted or unsubstituted phosphinyloxy group having from 2 to 30 carbon atoms, e.g., diphenoxyphosphinyloxy, dioctyloxyphosphinyloxy), a phosphinylamino group (preferably a substituted or unsubstituted phosphinylamino group having from 2 to 30 carbon atoms, e.g., dimethoxyphosphinylamino, dimethylaminophosphinylamino), a phospho group, a silyl group (preferably a substituted or unsubstituted silyl group having from 3 to 30 carbon atoms, e.g., trimethylsilyl, tert-butyldimethylsilyl, phenyldimethylsilyl), a hydrazino group (preferably a substituted or unsubstituted hydrazino group having from 0 to 30 carbon atoms, e.g., trimethylhydrazino), or a ureido group (preferably a substituted or unsubstituted ureido group having from 0 to 30 carbon atoms, e.g., N-dimethylureido).

The substituent represented by W may also have a structure condensed with a ring (an aromatic or non-aromatic hydrocarbon ring or heterocyclic ring or a polycyclic structure condensed with ring comprising a combination of these rings, e.g., benzene ring, naphthalene ring, anthracene ring, quinoline ring, phenanthrene ring, fluorene ring, triphenylene ring, naphthacene ring, biphenyl ring, pyrrole ring, furan ring, thiophene ring, imidazole ring, oxazole ring, thiazole ring, pyridine ring, pyrazine ring, pyrimidine ring, pyridazine ring, indolizine ring, indole ring, benzofuran ring, benzothiophene ring, isobenzofuran ring, quinolidine ring, quinoline ring, phthalazine ring, naphthylidine ring, quinoxaline ring, quinoxazoline ring, quinoline ring, carbazole ring, phenanthridine ring, acridine ring, phenanthroline ring, thianthrene ring, chromene ring, xanthene ring, phenoxathiine ring, phenothiazine ring, phenazine ring).

Among these substituents W, those having a hydrogen atom may be deprived of the hydrogen atom and substituted by the above-described substituent. Examples of this functional group include an alkylcarbonylaminosulfonyl group, an arylcarbonylaminosulfonyl group, an alkylsulfonylaminocarbonyl group and arylsulfonylaminocarbonyl group.

Specific examples thereof include methylsulfonylaminocarbonyl, p-methylphenylsulfonylaminocarbonyl, acetylaminosulfonyl and benzoylaminosulfonyl.

In formula (1), m1 represents an integer of 1 to 5, preferably 1 or 2, more preferably 1, and m2 represents an integer of 1 to 5, preferably 1 or 2, more preferably 1.

Dye2 represents a second chromophore represented by formula (2).

In formula (1), $R_{11}$, $R_{12}$ and $R_{13}$ each independently represents a hydrogen atom, an alkyl group [preferably an unsubstituted alkyl group having from 1 to 18, more preferably from 1 to 7, still more preferably from 1 to 4, carbon atoms (hereinafter referred to as "C number") (e.g., methyl, ethyl, propyl, isopropyl, butyl, isobutyl, hexyl, octyl, 2-ethylhexyl, dodecyl, octadecyl) or a substituted alkyl group having a C number of 1 to 18, preferably from 1 to 7, more preferably from 1 to 4 {for example, an alkyl group substituted by W described above as a substituent; preferably an aralkyl group (e.g., benzyl, 2-phenylethyl), a hydroxyalkyl group (e.g., 2-hydroxyethyl, 3-hydroxypropyl, 6-hydroxhexyl), a carboxyalkyl group (e.g., 2-carboxyethyl, 3-crboxypropyl, 4-carboxybutyl, carboxymethyl, 5-carboxypentyl), an alkoxyalkyl group (e.g., 2-methoxyethyl, 2-(2-methoxyethoxy)ethyl), an aryloxyalkyl group (e.g., 2-phenoxyethyl, 2-(1-naphthoxy)ethyl), an alkoxycarbonylalkyl group (e.g., ethoxycarbonylmethyl, 2-benzyloxycarbonylethyl), an aryloxycarbonylalkyl group (e.g., 3-phenoxycarbonylpropyl), an acyloxyalkyl group (e.g., 2-acetyloxyethyl), an acylalkyl group (e.g., 2-acetylethyl), a carbamoylalkyl group (e.g., 2-morpholinocarbonylethyl), sulfamoylalkyl group (e.g., N,N-dimethylsulfamoylmethyl), a sulfoalkyl group (e.g., 2-sulfobenzyl, 3-sulfo-3-phenylpropyl, 2-sulfoethyl, 3-sulfopropyl, 3-sulfobutyl, 4-sulfobutyl, 2-[3-sulfopropoxy]ethyl, 2-hydroxy-3-sulfopropyl, 3-sulfopropoxyethoxyethyl), a sulfatoalkyl group (e.g., 2-sulfatoethyl, 3-sulfatoproyl, 4-sulfatobutyl), a heterocyclic-substituted alkyl group (e.g., 2-(pyrrolidin-2-on-1-yl)ethyl, tetrahydrofurfuryl), an alkylsulfonylcarbamoylalkyl group (e.g., methansulfonylcarbamoylmethyl), an acylcarbamoylalkyl group (e.g., acetylcarbamoylmethyl), an acylsulfamoylalkyl group (e g., acetylsulfamoylmethyl), an alkylsulfonylsulfamoylalkyl group (e.g., methanesulfonylsulfamoylmethyl) or a halogen-substituted alkyl group (e.g., 2-chloroethyl, 2,2,2-trifluoroethyl)}], an alkenyl group (preferably an alkenyl group having a C number of 2 to 20, e.g., vinyl, allyl, 3-butenyl, oleyl, or an alkenyl group substituted by W, such as sulfoalkenyl group (e.g., 3-sulfo-2-propenyl)), an aryl group (an unsubstituted aryl group having a C number of 6 to 20, preferably from 6 to 10, more preferably from 6 to 8 (e.g., phenyl, 1-naphthyl, 2-naphthyl) or a substituted aryl group having a C number of 6 to 20, preferably from 6 to 10, more preferably from 6 to 8 (for example, an aryl group substituted by W described above as examples of the substituent, such as p-methoxyphenyl, p-methylphenyl and p-chlorophenyl)), or a heterocyclic group (an unsubstituted heterocyclic group having a C number of 1 to 20, preferably from 3 to 10, more preferably from 4 to 8 (e.g., 2-furyl, 2-thienyl, 2-pyridyl, 3-pyrazolyl, 3-isooxazolyl, 3-isothiazolyl, 2-imidazolyl, 2-oxazolyl, 2-thiazolyl, 2-pyridazyl, 2-pyrimidyl, 3-pyrazyl, 2-(1,3,5-triazolyl), 3-(1,2,4-triazolyl), 5-tetrazolyl) or a substituted heterocyclic group having a C number of 1 to 20, preferably from 3 to 10, more preferably from 4 to 8 (for example, a heterocyclic group substituted by W described above as examples of the substituent, such as 5-methyl-2-thienyl and 4-methoxy-2-pyridyl)).

$R_{11}$ and $R_{12}$ each is preferably a hydrogen atom, an alkyl group, a sulfoalkyl group or an aryl group, more preferably a hydrogen atom or an alkyl group.

$R_{13}$ is preferably a hydrogen atom, an alkyl group or a sulfoalkyl group.

$M_{11}$, and $M_{12}$ each independently represents a methine group and may have a substituent. The substituent may be any one of the above-described substituents W but is preferably an alkyl group having a C number of 1 to 20 (e.g., methyl, ethyl, i-propyl), a halogen atom (e.g., chlorine, bromine, iodine, fluorine), a nitro group, an alkoxy group having a C number of 1 to 20 (e.g., methoxy, ethoxy), an aryl group having a C number of 6 to 26 (e.g., phenyl, 2-naphthyl), a heterocyclic group having a C number of 0 to 20 (e.g., 2-pyridyl, 3-pyridyl), an aryloxy group having a C number of 6 to 20 (e.g., phenoxy, 1-naphthoxy, 2-naphthoxy), an acylamino group having a C number of 1 to 20 (e.g., acetylamino, benzoylamino), a carbamoyl group having a C number of 1 to 20 (e.g., N,N-dimethylcarbamoyl), a sulfo group, a hydroxy group, a carboxy group, an alkylthio group having a C number of 1 to 20 (e.g., methylthio) or a cyano group. The methine group may form a ring together with another methine group or an auxochrome. $M_{11}$ and $M_{12}$ each is preferably an unsubstituted methine group, an ethyl group-substituted methine group or a methyl group-substituted methine group.

n12 represents an integer of 0 to 3, preferably 0 to 2, more preferably 1 or 2. When n12 is 2 or more, the methine groups $M_{11}$, or $M_{12}$ may be the same or different.

$Z_1$ represents an atomic group for forming a benzene ring condensed with a benzene ring, a naphthalene ring or a heterocyclic ring. The ring formed by $Z_1$ is preferably a benzene ring, a naphthalene ring, an anthracene ring, a phenanthroline ring, a dibenzofuran ring, a dibenzothiophene ring, a carbazole ring, an indole ring or a benzothiophene ring, more preferably a benzene ring, a naphthalene ring, a dibenzofuran ring, a dibenzothiophene ring or a carbazole ring, and most preferably a benzene ring, a naphthalene ring or a dibenzofuran ring.

$V_{11}$ represents a substituent on the ring formed by $Z_1$ and may be any of the above-described substituents W but is preferably, for example, an alkyl group having a C number of 1 to 20 (preferred examples of the alkyl group are the same as those described for $R_{11}$ to $R_{13}$), a halogen atom (e.g., chlorine, bromine, iodine, fluorine), a nitro group, an alkoxy group having a C number of 1 to 20 (e.g., methoxy, ethoxy), an aryl group having a C number of 6 to 20 (e.g., phenyl, 2-naphthyl), a heterocyclic group having a C number of 0 to 20 (e.g., 2-pyridyl, 3-pyridyl, 1-pyrrolyl, 2-thienyl), an aryloxy group having a C number of 6 to 20 (e.g., phenoxy, 1-naphthoxy, 2-naphthoxy), an acylamino group having a C number of 1 to 20 (e.g., acetylamino, benzoylamino), a carbamoyl group having a C number of 1 to 20 (e.g., N,N-dimethylcarbamoyl), a sulfo group, a sulfonamido group having a C number of 0 to 20 (e.g., methanesulfonamido), a sulfamoyl group having a C number of 0 to 20 (e.g., N-methylsulfamoyl), a hydroxyl group, a carboxyl group, an alkylthio group having a C number of 1 to 20 (e.g., methylthio) or a cyano group. $V_{11}$ is preferably an alkyl group, a halogen atom (particularly, chlorine or bromine), an aryl group, an acylamino group, a carbamoyl group, an alkoxy group, a hydroxyl group, a sulfo group or a carboxyl group, and is preferably substituted at the 5- or 6-position.

n11 represents an integer of 0 to 8, preferably from 0 to 2. When n11 is 2 or more, the substituents $V_{11}$ may be the same or different or may be combined with each other to form a ring.

$V_{11}$ may be substituted to any position on the ring formed by $Z_1$.

$X_{11}$ represents —O, —S—, —$NR_{14}$, preferably —S— or —$NR_{14}$—. $R_{14}$ represents a hydrogen atom, an alkyl group, an alkenyl group, an aryl group or a heterocyclic group (preferred examples of these groups are the same as those described for $R_{11}$ to $R_{13}$).

When $X_{11}$ is —O—, the ring formed by $Z_1$ is not an uncondensed benzene ring.

When $X_{11}$ is —$NR_{14}$—, $L_1$ does not contain a urethane group (—NRCOO—) or a fluorine atom.

When $X_{11}$ is —S—, $L_1$ does not contain an ether group, a urethane group (—NRCOO—) or a fluorine atom. Furthermore, when $X_{11}$ is —S—, at least one of the substituents $V_{11}$ is preferably —$SO_3M$, —$OSO_3M_2$, —$PO_3M_2$, —$OPO_3M_2$ or —COOM, or a group containing any one of these, more preferably —$SO_3M$ or a group containing —$SO_3M$. M represents proton or cation.

The linking group $L_1$ is connected to any one of $R_{12}$, $R_{13}$ and $V_{11}$, preferably to $R_{12}$ or $R_{13}$, more preferably to $R_{12}$.

$L_1$ represents a linking group and may be any linking group but is preferably a linking group having a C number of 0 to 100, preferably from 1 to 20, constructed by one or a combination of two or more of an alkylene group (preferably having a C number of 1 to 20, e.g., methylene, ethylene, propylene, butylene, pentylene, hexylene, octylene), an arylene group (preferably having a C number of 6 to 26, e.g., phenylene, naphthylene), an alkenylene group (preferably having a C number of 2 to 20, e.g., ethenylene, propenylene), an alkynylene group (preferably a C number of 2 to 20, e.g., ethynylene, propylene), an amido group, an ester group, a sulfoamido group, a sulfonic acid ester group, a ureido group, a sulfonyl group, a sulfinyl group, a thioether group, an ether group, a carbonyl group, —$NR_{51}$— (wherein $R_{51}$ is a hydrogen atom or a monovalent group and preferred examples of the substituent include W) and a heterylene group (preferably having a C number of 1 to 26, e.g., 6-chloro-1,3,5-triazyl-2,4-diyl, pyrimidine-2,4-diyl, quinoxalin-2,3-diyl).

$L_1$ is preferably represented by $-G_1-(A_1-G_2-)_{t1}-$.

$A_1$ represents, irrespective of the direction, —O—, —S—, —$SO_2$—, —$NR_3$—, —COO—, —$CONR_4$— or —$SO_2NR_5$—, $R_3$ to $R_5$ each independently represents a hydrogen atom, an alkyl group, an alkenyl group, an aryl group or a heterocyclic group (preferred examples of these groups are the same as described for $R_{11}$ to $R_{13}$).

$R_3$ is preferably a hydrogen atom or an alkyl group, more preferably an alkyl group. $R_4$ and $R_5$ each is preferably a hydrogen atom or an alkyl group, more preferably a hydrogen atom.

$A_1$ preferably represents —O—, —$SO_2$—, —COO— or —$CONR_4$—, more preferably —$CONR_4$—.

$G_1$ and $G_2$ each independently represents an alkylene group (preferably having a C number of 1 to 20, e.g., methylene, ethylene, propylene, butylene, hexylene, octylene, 2-methylbutylene, 3-phenylpentylene), an alkenylene group (preferably having a C number of 2 to 20, e.g., ethenyl, propenyl, 2-butenyl) or an arylene group (preferably having a C number of 6 to 26, e.g., 1,4-phenylene, 1,4-naphtylene). These groups each may be substituted by the above-described substituent W. $G_1$ and $G_2$ each preferably represents an alkylene group, more preferably a linear unsubstituted alkylene group having a C number of 1 to 8.

t1 represents an integer of 1 to 10, preferably 1 or 2, more preferably 1. When t1 is 2 or more, multiple $A_1$'s may be the same or different and multiple $G_2$'S may also be the same or different.

When t1 is 1, $A_1$ is preferably —COO—, —$CONR_4$— or —$SO_2NR_5$—, more preferably —COO— or —$CONR_4$—, still more preferably —$CONR_4$—.

When t1 is 2 or more, at least one $A_1$ is preferably —COO—, —$CONR_4$— or —$SO_2NR_5$—, more preferably —COO— or —$CONR_4$—, still more preferably —$CONR_4$—.

The remaining $A_1$ is preferably —COO—, —$CONR_4$—, —$SO_2NR_5$—, —O— or —$SO_2$—, more preferably —O— or —$CONR_4$—.

The chromophore represented by Dye1 may be any chromophore and examples thereof include cyanine dyes, styryl dyes, hemicyanine dyes, merocyanine dyes, trinuclear merocyanine dyes, tetranuclear merocyanine dyes, rhodacyanine dyes, complex cyanine dyes, complex merocyanine dyes, allopolar dyes, oxonol dyes, hemioxonol dyes, squarium dyes, croconium dyes, azomethine dyes, coumarin dyes, arylidene dyes, anthraquinone dyes, triphenylmethane dyes, azo dyes, azomethine dyes, spiro compounds, metallocene dyes, fluorenone dyes, fulgide dyes, perylene dyes, phenazine dyes, phenothiazine dyes, quinone dyes, indigo dyes, diphenylmethane dyes, polyene dyes, acridine dyes, acridinone dyes, diphenylamine dyes, quinacridone dyes, quinophthalone dyes, phenoxazine dyes, phthaloperylene dyes, porphyrin dyes, chlorophyll dyes, phthalocyanine dyes and metal complex dyes.

Among these, preferred are polymethine chromophores such as cyanine dyes, styryl dyes, hemicyanine dyes, merocyanine dyes, trinuclear merocyanine dyes, tetranuclear merocyanine dyes, rhodacyanine dyes, complex cyanine dyes, complex merocyanine dyes, allopolar dyes, oxonol dyes, hemioxonol dyes, squarium dyes, croconium dyes and azamethine dyes.

These dyes are described in detain in F. M. Harmer, *Heterocyclic Compounds—Cyanine Dyes and Related Compounds*, John Wiley & Sons (1964), D. M. Sturmer, *Heterocyclic Compounds—Special topics in heterocyclic chemistry*, Chap. 18, Section 14, pp. 482–515. Examples of the formulae for preferred dyes include the formulae described in U.S. Pat. No. 5,994,051, pp. 32–36, and the formulae described in U.S. Pat. No. 5,747,236, pp. 30–34. Preferred examples of the cyanine dyes, merocyanine dyes and rhodacyanine dyes include those represented by formulae (XI), (XII) and (XIII) of U.S. Pat. No. 5,340,694, columns 21 to 22 (on the condition that the numbers of n12, n15, n17 and n18 are not limited and each is an integer of 0 or more (preferably 4 or less)).

Dye1 is preferably a cyanine chromophore, a merocyanine chromophore or an oxonol chromophore, more preferably a cyanine chromophore or a merocyanine chromophore, most preferably a cyanine chromophore.

The cyanine chromophore is preferably a chromophore represented by the following formula (4'):

(4')

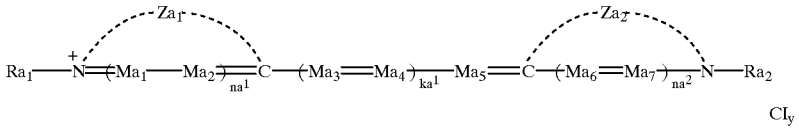

wherein $Za_1$ and $Za_2$ each represents an atomic group for forming a 5- or 6-membered nitrogen-containing heterocyclic ring and this ring may further be condensed with a benzene ring, a benzofuran ring, a pyridine ring, a pyrrole ring, an indole ring or a thiophene ring.

$Ra_1$ and $Ra_2$ each represents a hydrogen atom, an alkyl group, an alkenyl group, an aryl group or a heterocyclic group (preferred examples of these groups are the same as those described for $R_{11}$ to $R_{13}$), preferably a hydrogen atom, an alkyl group or a sulfoalkyl group, more preferably an alkyl group or a sulfoalkyl group.

$Ma_1$ to $Ma_7$ each represents methine and may have a substituent. The substituent may be any of the above-described substituents W but is preferably an alkyl group having a C number of 1 to 20 (e.g., methyl, ethyl, i-propyl), a halogen atom (e.g., chlorine, bromine, iodine, fluorine), a nitro group, an alkoxy group having a C number of 1 to 20 (e.g., methoxy, ethoxy), an aryl group having a C number of 6 to 26 (e.g., phenyl, 2-naphthyl), a heterocyclic group having a C number of 0 to 20 (e.g., 2-pyridyl, 3-pyridyl), an aryloxy group having a C number of 6 to 20 (e.g., phenoxy, 1-naphthoxy, 2-naphthoxy), an acylamino group having a C number of 1 to 20 (e.g., acetylamino, benzoylamino), a carbamoyl group having a C number of 1 to 20 (e.g., N,N-dimethylcarbamoyl), a sulfo group, a hydroxy group, a carboxy group, an alkylthio group having a C number of 1 to 20 (e.g., methylthio) or a cyano group. The methine group may form a ring together with another methine group or an auxochrome. $Ma_1$ to $Ma_7$ each is preferably an unsubstituted methine group, an ethyl group-substituted methine group or a methyl group-substituted methine group.

$na^1$ and $na^2$ each is 0 or 1, preferably 0. $ka^1$ represents an integer of 0 to 3, preferably from 0 to 2, more preferably 0 or 1. When $ka^1$ is 2 or more, the methine groups $Ma_3$ may be the same or different and the methine groups $Ma_4$ may also be the same or different.

CI represents an ion for neutralizing the electric charge. y represents a number necessary for neutralizing the electric charge.

The merocyanine chromophore is preferably a chromophore represented by the following formula (5'):

(5')

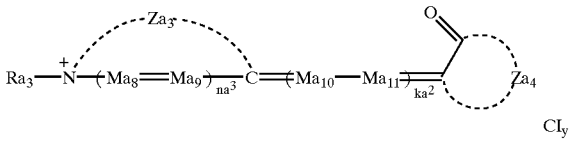

wherein $Za_3$ represents an represents an atomic group for forming a 5- or 6-membered nitrogen-containing heterocyclic ring and this ring may further be condensed with a benzene ring, a benzofuran ring, a pyridine ring, a pyrrole ring, an indole ring or a thiophene ring. $Za_4$ represents an atomic group for forming an acidic nucleus. $Ra_3$ represents a hydrogen atom, an alkyl group, an alkenyl group, an aryl group or a heterocyclic group (preferred examples of these groups are the same as those described for $Ra_1$ and $Ra_2$). $Ma_8$ to $Ma_{11}$ each represents a methine group (preferred examples thereof are the same as those described for $Ma_1$ to $Ma_7$). $na^3$ is 0 or 1. $ka^2$ represents an integer of 0 to 3, preferably from 0 to 2, more preferably 1 or 2.

When $ka^2$ is 2 or more, the methine groups $Ma_{10}$ may be the same or different and the methine groups $Ma_{11}$ may also be the same or different.

CI represents an ion for neutralizing the electric charge. y represents a number necessary for neutralizing the electric charge.

The oxonol chromophore is preferably a chromophore represented by the following formula (6'):

(6')

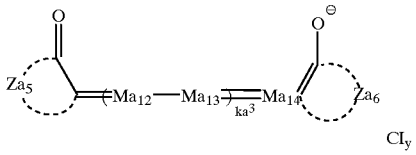

wherein $Za_5$ and $Za_6$ each represents an atomic group for forming an acidic nucleus. $Ma_{12}$ to $Ma_{14}$ each represents a methine group (preferred examples thereof are the same as those described for $Ma_1$ to $Ma_7$). $ka^3$ represents an integer of 0 to 3, preferably from 0 to 2. When $ka^3$ is 2 or more, the methine groups $Ma_{12}$ may be the same or different and the methine groups $Ma_{13}$ may also be the same or different.

CI represents an ion for neutralizing the electric charge. y represents a number necessary for neutralizing the electric charge.

Examples of $Za_1$, $Za_2$ and $Za_3$ include oxazole nuclei having from 3 to 25 carbon atoms (e.g., 2-3-methyloxazolyl, 2-3-ethyloxazolyl, 2-3,4-diethyloxazolyl, 2-3-methylbenzoxazolyl, 2-3-ethylbenzoxazolyl, 2-3-sulfoethylbenzoxazolyl, 2-3-sulfopropylbenzoxazolyl, 2-3-methylthioethylbenzoxazolyl, 2-3-methoxyethylbenzoxazolyl, 2-3-sulfobutylbenzoxazolyl, 2-3-methyl-β-naphthoxazolyl, 2-3-methyl-α-naphthoxazolyl, 2-3-sulfopropyl-β-naphthoxazolyl, 2-3-sulfopropyl-γ-naphthoxazolyl, 2-3-(3-naphthoxyethyl) benzoxazolyl, 2-3,5-dimethylbenzoxazolyl, 2-6-chloro-3-methylbenzoxazolyl, 2-5-bromo-3-methylbenzoxazolyl, 2-3-ethyl-5-methoxybenzoxazolyl, 2-5-phenyl-3-sulfopropylbenzoxazolyl, 2-5-(4-bromophenyl)-3-sulfobutylbenzoxazolyl, 2-3-dimethyl-5,6-dimethylbenzoxazolyl), thiazole nuclei having from 3 to 25 carbon atoms (e.g., 2-3-methylthiazolyl, 2-3-ethylthiazolyl, 2-3-sulfopropylthiazolyl, 2-3-sulfobutylthiazolyl, 2-3,4-dimethylthiazolyl, 2-3,4,4-trimethylthiazolyl, 2-3-carboxyethylthiazolyl, 2-3-methylbenzothiazolyl, 2-3-ethylbenzothiazolyl, 2-3-butylbenzothiazolyl, 2-3-sulfopropylbenzothiazolyl, 2-3-sulfobutylbenzothiazolyl, 2-3-methyl-β-naphthothiazolyl, 2-3-sulfopropyl-γ-naphthothiazolyl, 2-3-(1-naphthoxyethyl)benzothiazolyl, 2-3,5-dimethylbenzothiazolyl, 2-6-chloro-3-methylbenzothiazolyl, 2-6-iodo-3-ethylbenzothiazolyl, 2-5-bromo-3-methylbenzothiazolyl, 2-3-ethyl-5-methoxybenzothiazolyl, 2-5-phenyl-3-sulfopropylbenzothiazolyl, 2-5-(4-bromophenyl)-3-sulfobutylbenzothiazolyl, 2-3-dimethyl-5,6-dimethylbenzothiazolyl), imidazole nuclei having from 3 to 25 carbon atoms (e.g., 2-1,3-diethylimidazolyl, 2-1,3-dimethylimidazolyl, 2-1-methylbenzimidazolyl, 2-1,3,4-triethylimidazolyl, 2-1,3-diethylbenzimidazolyl, 2-1,3,5-trimethylbenzimidazolyl, 2-6-chloro-1,3-dimethylbenzimidazolyl, 2-5,6-dichloro-1,3-diethylbenzimidazolyl, 2-1,3-disulfopropyl-5-cyano-6-chlorobenzimidazolyl), indolenine nuclei having from 10 to 30 carbon atoms (e.g., 3,3-dimethylindolenine), quinoline nuclei having from 9 to 25 carbon atoms (e.g., 2-1-methylquinolyl, 2-1-ethylquinolyl, 2-1-methyl-6-chloroquinolyl, 2-1,3-diethylquinolyl, 2-1-methyl-6-methylthioquinolyl, 2-1-sulfopropylquinolyl, 4-1-methylquinolyl, 4-1-sulfoethylquinolyl, 4-1-methyl-7-chloroquinolyl, 4-1,8-diethylquinolyl, 4-1-methyl-6-methylthioquinolyl, 4-1-sulfopropylquinolyl), selenazole nuclei having from 3 to 25 carbon atoms (e.g., 2-3-methylbenzoselenazolyl), pyridine nuclei having from 5 to 25 carbon atoms (e.g., 2-pyridyl), thiazoline nuclei, oxazoline nuclei, selenazoline nuclei, tetrazoline nuclei, tetrazole nuclei, benzotellurazole nuclei, imidazoline nuclei, imidazo[4,5-quinoxaline] nuclei, oxadiazole nuclei, thiadiazole nuclei, tetrazole nuclei and pyrimidine nuclei.

These nuclei each may be substituted and examples of the substituent include the above-described substituents W. The substituent is preferably, for example, an alkyl group (e.g., methyl, ethyl, propyl), a halogen atom (e.g., chlorine, bromine, iodine, fluorine), a nitro group, an alkoxy group (e.g., methoxy, ethoxy), an aryl group (e.g., phenyl), a heterocyclic group (e.g., 2-pyridyl, 3-pyridyl, 1-pyrrolyl, 2-thienyl), an aryloxy group (e.g., phenoxy), an acylamino group (e.g., acetylamino, benzoylamino), a carbamoyl group (e.g., N,N-dimethylcarbamoyl), a sulfo group, a sulfonamido group (e.g., methanesulfonamido), a sulfamoyl group (e.g., N-methylsulfamoyl), a hydroxy group, a carboxy group, an alkylthio group (e.g., methyl thio) or a cyano group.

$Za_1$, $Za_2$ and $Za_3$ each is preferably an oxazole nucleus, an imidazole nucleus or a thiazole nucleus. These heterocyclic rings each may further be condensed with a ring such as benzene ring, benzofuran ring, pyridine ring, pyrrole ring, indole ring or thiophene ring.

$Za_4$, $Za_5$ and $Za_6$ each represents an atomic group necessary for forming an acidic nucleus and the acidic nucleus is defined in James (compiler), *The Theory of the Photographic Process,* 4th ed., Macmillan, page 198 (1977). Specific examples thereof include nuclei such as 2-pyrazolon-5-one, pyrazolidine-3,5-dione, imidazolin-5-one, hydantoin, 2- or 4-thiohydantoin, 2-iminooxazolidin-4-one, 2-oxazolin-5-one, 2-thiooxazoline-2,4-dione, isorhodanine, rhodanine, indane-1,3-dione, thiophen-3-one, thiophen-3-one-1,1,-dioxide, indolin-2-one, indolin-3-one, 2-oxoindazolium, 5,7-dioxo-6,7-dihydrothiazolo[3,2-a]pyrimidine, 3,4-dihydroisoquinolin-4-one, 1,3-dioxane-4,6-dione, barbituric acid, 2-thiobarbituric acid, coumarin-2,4-dione, indazolin-2-one, pyrido[1,2-a]pyrimidine-1,3-dione, pyrazolo[1,5-b]quinazolone and pyrazolopyridone.

Among these preferred are hydantoin, rhodanine, barbituric acid and 2-oxazolin-5-one. $Za_4$ is preferably a barbituric acid.

Specific examples of the cyanine chromophore, merocyanine chromophore and oxonol chromophore include those described in F. M. Harmer, *Heterocyclic Compounds—Cyanine Dyes and Related Compounds*, John & Wiley & Sons, New York, London (1964).

The formulae of cyanine dyes and merocyanine dyes are preferably formulae (XI) and (XII) of U.S. Pat. No. 5,340,694, pages 21 and 22.

The compound represented by formula (1) of the present invention is preferably represented by formula (3). In formula (3), $R_{11}$ to $R_{13}$, $M_{11}$, $M_{12}$, n11, n12, $X_{11}$, $Z_1$ and $V_{11}$ have the same meanings as defined in formula (2). $G_1$, $G_2$, $A_1$ and t1 have the same meanings as defined in claim 2.

$X_1$ and $X_2$ each independently represents —O—, —S—, —$NR_6$— or —$CR_7R_8$—, $R_6$ to $R_8$ each independently represents a hydrogen atom, an alkyl group, an alkenyl group, an aryl group or a heterocyclic group (preferred examples of these groups are the same as those described for $R_{11}$ to $R_{13}$), $R_6$ preferably represents a hydrogen atom, an alkyl group or a sulfoalkyl group, more preferably an alkyl group or a sulfoalkyl group, and $R_7$ and $R_8$ each preferably represents an alkyl group. $X_1$ and $X_2$ each is preferably —O— or —S—.

$R_1$ and $R_2$ each independently represents a hydrogen atom, an alkyl group, an alkenyl group, an aryl group or a heterocyclic group (preferred examples of these groups are the same as those described for $R_{11}$ to $R_{13}$), preferably a hydrogen atom, an alkyl group, an acid-substituted alkyl group (the acid salt group is, for example, a carboxy group, a sulfo group, a phosphate group, a sulfonamide group, a sulfamoyl group or an acylsulfonamide group). The acid-substituted alkyl group is preferably a sulfoalkyl group.

$M_1$ to $M_3$ each independently represents a methine group (preferred examples of these groups are the same as those described for $M_{11}$ and $M_{12}$), preferably an unsubstituted methine group, an ethyl group-substituted methine group or a methyl group-substituted methine group.

n1 represents an integer of 0 to 3, preferably from 0 to 2, more preferably 0 or 1. When n1 is 2 ore more, the methine groups $M_1$ may be the same or different and the methine groups $M_2$ may also be the same or different.

When n1 is 0, n12 is preferably 1 and when n1 is 1, n12 is preferably 2.

When n1 is 0, $X_1$ and $X_2$ both are preferably —S— and when n1 is 1, $X_1$ and $X_2$ both are preferably —O—.

$V_1$ and $V_2$ each represents a substituent (preferred examples thereof are the same as those described for $V_{11}$), n2 and n3 each represents an integer of 0 to 4, preferably from 0 to 2. When n2 and n3 each is 2 or more, the substituents $V_2$ or $V_3$ may be the same or different or may be combined with each other to form a ring. The ring formed is preferably a benzene ring, a pyridine ring, a dibenzofuran ring, a thiophene ring, a pyrrole ring or an indole ring, more preferably a benzene ring or a benzofuran ring.

$G_1$ is connected to Dye1 through $R_1$ or $V_1$ and $G_2$ is connected to Dye2 through $R_{12}$, $R_{13}$ or $V_{11}$. At this time, $G_1$, $G_2$, $R_1$, $R_{12}$, $R_{13}$, $V_1$ or $V_{11}$ connects groups in which one hydrogen atom is eliminated from respective terminals, but this does not necessarily mean that the compound is produced by such a synthesis method.

In connecting with $G_1$ or $G_2$, $V_1$ and $V_{11}$ each is preferably a carboxy group, an alkoxy group, an acylamino group, a carbamoyl group, a sulfonamide group, a sulfamoyl group, a hydroxy group or an alkylthio group, more preferably an acylamino group or a carbamoyl group.

$G_1$ is preferably connected with $R_1$ and $G_2$ is preferably connected with $R_{12}$ or $R_{13}$, more preferably with $R_{12}$ At this time, $R_{11}$, $R_{12}$ and $R_{13}$ all are preferably a hydrogen atom.

When $X_{11}$ is —O—, the ring formed by $Z_1$ is not an uncondensed benzene ring. When $X_{11}$ is —S—, $L_1$ does not contain an ether group, a urethane group (—NRCOO—) or a fluorine atom. When $X_{11}$ is —$NR_{14}$—, $L_1$ does not contain a urethane group (—NRCOO—) or a fluorine atom.

CI represents ion for neutralizing the electric charge. Whether a certain compound is cation or anion or has net ion charge depends on the substituent thereof. The cation is typically ammonium ion or alkali metal ion. On the other than, the anion may be either inorganic ion or organic ion.

Examples of the cation include sodium ion, potassium ion, triethylammonium ion, diethyl(i-propyl)ammonium ion, pyridinium ion and 1-ethylpyridinium ion. Examples of the anion include halide anion (e.g., chloride ion, bromide ion, fluoride ion, iodide ion), substituted arylsulfonate ion (e.g., paratoluenesulfonate ion), alkylsulfate ion (e.g., methylsulfate ion), sulfate ion, perchlorate ion, tetrafluoroborate ion and acetate ion.

y represents a number necessary for neutralizing the electric charge.

Formula (4) or (8) is described below.

In formula (4) or (8), $X_{41}$ and $X_{42}$ each independently represents —O—, —S—, —$NR_{43}$— or —$CR_{44}R_{45}$—, and $R_{43}$ to $R_{45}$ each independently represents a hydrogen atom, an alkyl group, an alkenyl group, an aryl group or a heterocyclic group (preferred examples of these groups are the same as those described for $R_{11}$ to $R_{13}$).

$R_{43}$ preferably represents a hydrogen atom, an alkyl group or a sulfoalkyl group, more preferably an alkyl group or a sulfoalkyl group, $R_{44}$ and $R_{45}$ each preferably represents an alkyl group, and $X_{41}$ and $X_{42}$ each preferably represents —O—, —S— or —$NR_{43}$—, more preferably —O— or —S—.

$R_{41}$ and $R_{42}$ each independently represents a hydrogen atom, an alkyl group, an alkenyl group, an aryl group or a heterocyclic group (preferred examples of these groups are the same as those described for $R_3$), preferably an alkyl group or a sulfoalkyl group.

$M_{41}$ and $M_{46}$ each independently represents a methine group and may have a substituent and preferred examples thereof are the same as those described for $M_{11}$ and $M_{12}$.

n41 and n42 each independently represents an integer of 0 to 3 and when n41 and 42 each is 2 or more, methine groups $M_{41}$, $M_{42}$, $M_{44}$ or $M_{45}$ may be the same or different. n41 and n42 each preferably represents 0 or 1. When n41 is 0, $X_{41}$ and $X_{42}$ each is preferably S and when n41 is 1, $X_{41}$ and $X_{42}$ each is preferably O. n41 and n42 are preferably the same.

$L_{41}$ represents a linking group having at least one heteroatom except for an amido group and an eater group. Preferred examples of the heteroatom include oxygen, nitrogen, sulfur, chlorine, bromine, phosphor and silicon. Among these, preferred are oxygen, nitrogen, sulfur and chlorine. $L_{41}$ is preferably a linking group such that an alkylene group, an alkenylene group or an arylene group is substituted by the above-described substituent W. $L_{41}$ is also preferably a linking group containing one or more of —O—, —S—, —$NR_{43}$— and —$SO_2$—, on the main chain.

$L_{41}$ is represented by -$L_{42}$-($A_{41}$-$L_{43}$-)$_{t41}$-. $A_{41}$ represents, irrespective of the direction, —COO—, —$CONR_{46}$— or —$SO_2NR_{47}$—, $R_{46}$ and $R_{47}$ each independently represents a hydrogen atom, an alkyl group, an alkenyl group, an aryl group or a heterocyclic group (preferred examples of these groups are the same as those described for $R_{43}$ to $R_{45}$), preferably a hydrogen atom or an alkyl group, more preferably a hydrogen atom). $A_4$ is preferably —$CONR_{46}$—. t41 represents an integer of 1 to 10, preferably 1 or 2, more preferably 1. When t41 is 2 or more, multiple $A_{41}$'s may be the same or different and multiple $L_{42}$ may also be the same or different.

$L_{42}$ and $L_{43}$ each independently represents an alkylene group (preferably having a C number of 1 to 20, e.g., methylene, ethylene, propylene, butylene, hexylene, octylene, 2-methylbutylene, 3-phenylpentylene), an alkenylene group (preferably having a C number of 2 to 20, e.g., ethenylene, propenylene, 2-butenylene), an arylene group (preferably having a C number of 6 to 26, e.g., 1,4-phenylene, 1,4-naphtylene) or -$G_{41}$-($A_{42}$-$G_{42}$)$_{t42}$-, $G_{41}$ and $G_{42}$ each independently represents an alkylene group, an alkenylene group or an arylene group (preferred examples of these groups are the same as those described for $L_{42}$ and $L_{43}$), preferably an alkylene group. $A_{42}$ represents, irrespective of the direction, —O—, —S—, —$NR_{43}$— or —$SO_2$—, preferably —O—, —$NR_{43}$— or —$SO_2$, more preferably —O—. t42 represents an integer of 1 to 10, preferably from 1 to 4, more preferably from 2 to 4. When t42 is 2 or more, multiple $A_{42}$'s may be the same or different and multiple $G_{42}$' may be the same or different.

$L_{42}$ and $L_{43}$ each preferably represents an alkylene group or -$G_{41}$-($A_{42}$-$G_{42}$)$_{t42}$-. At this time, $L_{41}$, $L_{42}$, $G_{41}$ and $G_{42}$ each is preferably an unsubstituted linear alkylene group having a C number of 1 to 8, provided that when t41 is 0, $L_{42}$ is -$G_{41}$-($A_{42}$-$G_{42}$)$_{t42}$- and when t41 is 1 or more, at least one of $L_{42}$ and $L_{43}$ is -$G_{41}$-($A_{42}$-$G_{42}$)$_{t42}$-.

$V_{41}$ to $V_{44}$ each represents a substituent and may be any of the above-described substituents W but is preferably an alkyl group having a C number of 1 to 20 (preferred examples of the alkyl group are the same as those described for $R_{43}$ to $R_{45}$), a halogen atom (e.g., chlorine, bromine, iodine, fluorine), a nitro group, an alkoxy group having a C number of 1 to 20 (e.g., methoxy, ethoxy), an aryl group having a C number of 6 to 20 (e.g., phenyl, 2-naphthyl), a heterocyclic group having a C number of 0 to 20 (e.g., 2-pyridyl, 3-pyridyl, 1-pyrrolyl, 2-thienyl), an aryloxy group having a C number of 6 to 20 (e.g., phenoxy, 1-naphthoxy, 2-naphthoxy), an acylamino group having a C number of 1 to 20 (e.g., acetylamino, benzoylamino), a carbamoyl group having a C number of 1 to 20 (e.g., N,N-dimethylcarbamoyl), a sulfo group, a sulfonamido group having a C number of 0 to 20 (e.g., methanesulfonamido), a sulfamoyl group having a C number of 0 to 20 (e.g., N-methylsulfamoyl), a hydroxyl gro a carboxyl group, an alkylthio group having a C number of 1 to 20 (e.g., methylthio) or a cyano group. $V_{41}$ and $V_{42}$ each is preferably an alkyl group, a halogen atom (particularly, chlorine or bromine), an aryl group or an alkoxy group, and is preferably substituted at the 5-, 6-, 5'- or 6'-position. $V_{43}$ and $V_{44}$ each is preferably an alkyl group (particularly, a bulky group such as tert-butyl), a halogen atom (particularly, fluorine), an aryl group, an alkoxy group, a hydroxyl group, a sulfo group or a carboxyl group, and is preferably substituted at the 5-, 6-, 7-, 5'-, 6'- or 7'-position.

n43 to n46 each represents an integer of 0 to 4, preferably from 0 to 2. When n43 to n46 each is 2 or more, the substituents $V_{41}$, $V_{42}$, $V_{43}$ or $V_{44}$ may be the same or different or may be combined with each other to form a ring. In the case of forming a ring, the ring formed is preferably a benzene ring, a pyridine ring, a benzofuran ring, a thiophene ring, a pyrrole ring or an indole ring, more preferably a benzene ring or a benzofuran ring.

The compound represented by formula (5) or (9) of the present invention is described below.

In formula (5) or (9), $X_{51}$ and $X_{52}$ each independently represents —O—, —S— or —$NR_{53}$—, and $R_{53}$ represents a hydrogen atom, an alkyl group, an alkenyl group, an aryl group or a heterocyclic group (preferred examples of these groups are the same as those described for $R_{11}$ to $R_{13}$).

$R_{51}$, $R_{52}$ and $R_{53}$ each independently represents a hydrogen atom, an alkyl group, an alkenyl group, an aryl group or a heterocyclic group, preferably an alkyl group or a sulfoalkyl group.

$M_{51}$ to $M_{56}$ each independently represents a methine group and may have a substituent and preferred examples thereof are the same as those described for $M_{11}$ and $M_{12}$.

n51 and n52 each independently represents an integer of 0 to 3, provided that when n51 and n52 each is 2 or more, the methane groups $M_{51}$, $M_{52}$, $M_{54}$ or $M_{55}$ may be the same or different. n51 and n52 each preferably represents 0 or 1, more preferably 0.

n51 and n52 are preferably the same.

$L_{51}$ represents a linking group and may be, for example, an alkylene group which may be substituted, an alkenylene group which may be substituted, or the like, but is preferably represented by $-L_{52}-(A_{51}-L_{53}-)_{t51}-$.

$A_{51}$ represents, irrespective of the direction, —COO—, —$CONR_{54}$— or —$SO_2NR_{55}$—, wherein $R_{54}$ and $R_{55}$ each independently represents a hydrogen atom, an alkyl group, an alkenyl group, an aryl group or a heterocyclic group, preferably a hydrogen atom or an alkyl group, more preferably a hydrogen atom. $A_{51}$ preferably represents —COO— or —$CONR_{54}$—, more preferably —$CONR_{54}$—, most preferably —CONH—.

$L_{52}$ and $L_{53}$ each independently represents an alkylene group (preferably having a C number of 1 to 20, e.g., methylene, ethylene, propylene, butylene, hexylene, octylene, 2-methylbutylene, 3-phenylpentylene) which is not substituted by fluorine, an alkenylene group (preferably having a C number of 2 to 20, e.g., ethenylene, propenylene, 2-butenylene) which is not substituted by fluorine, or an arylene group (preferably having a C number of 6 to 26, e.g., 1,4-phenylene, 1,4-nphthylene.

$L_{52}$ and $L_{53}$ both are preferably an alkylene group, more preferably an unsubstituted linear alkylene having a C number of 1 to 8.

t51 represents an integer of 1 to 10, preferably 1 or 2, more preferably 1. When t51 is 2 or more, multiple $A_{51}$'s may be the same or different and multiple $L_{53}$ may also be the same or different.

$V_{51}$ to $V_{54}$ each represents a substituent and may be any of the above-described substituents W but is preferably an alkyl group having a C number of 1 to 20 (preferred examples of the alkyl group are the same as those described for $R_3$), a halogen atom (e.g., chlorine, bromine, iodine, fluorine), a nitro group, an alkoxy group having a C number of 1 to 20 (e.g., methoxy, ethoxy), an aryl group having a C number of 6 to 20 (e.g., phenyl, 2-naphthyl), a heterocyclic group having a C number of 0 to 20 (e.g., 2-pyridyl, 3-pyridyl, 1-pyrrolyl, 2-thienyl), an aryloxy group having a C number of 6 to 20 (e.g., phenoxy, 1-naphthoxy, 2-naphthoxy), an acylamino group having a C number of 1 to 20 (e.g., acetylamino, benzoylamino), a carbamoyl group having a C number of 1 to 20 (e.g., N,N-dimethylcarbamoyl), a sulfo group, a sulfonamido group having a C number of 0 to 20 (e.g., methanesulfonamido), a sulfamoyl group having a C number of 0 to 20 (e.g., N-methylsulfamoyl), a hydroxyl group, a carboxyl group, an alkylthio group having a C number of 1 to 20 (e.g., methylthio) or a cyano group. $V_{51}$ and $V_{52}$ each is preferably an alkyl group, a halogen atom (particularly, chlorine or bromine), an aryl group or an alkoxy group, and is preferably substituted at the 5-, 6-, 5'- or 6'-position. $V_{53}$ and $V_{54}$ each is preferably an alkyl group (particularly, a bulky group such as tert-butyl), a halogen atom (particularly, fluorine), an aryl group, an alkoxy group, a hydroxyl group, a sulfo group or a carboxyl group, and is preferably substituted at the 5-, 6-, 7-, 5'-, 6'- or 7'-position.

n53 to n56 each represents an integer of 0 to 4, preferably from 0 to 2. When n53 to n56 each is 2 or more, the substituents $V_{51}$, $V_{52}$, $V_{53}$ or $V_{54}$ may be the same or different or may be combined with each other to form a ring. In the case of forming a ring, the ring formed is preferably a benzene ring, a pyridine ring, a benzofuran ring, a thiophene ring, a pyrrole ring or an indole ring, more preferably a benzene ring or a benzofuran ring.

$V_{51}$ and $V_{52}$ each is preferably a halogen atom (preferably chlorine), an aryl group (preferably a phenyl group) or an alkoxy group (preferably a methoxy group) substituted at the 5-position (or 5'-position), or preferably forms a benzene ring condensed at the 4,5-position (4',5'-position) (namely, forms a so-called naphthothiazole ring).

The compound represented by formula (6) or (7) is described below.

At least one of $A_{61}$ and $A_{62}$ is not isomerized in the state where the geometrical isomer with respect to the methine chain is excited. $A_{62}$ is preferably not isomerized in the state where the geometrical isomer with respect to the methine chain is excited. The chromophore which can be used for $A_{61}$ and $A_{62}$ is preferably a florescent compound and although the structure thereof is not particularly limited, examples of the compound include the compounds described in Richard P. Haugland, *Handbook of Fluorescent Probes and Research Chemicals,* 6th ed., Chap. 1, pp. 1–46, Molecular Probes (1996). The chromophore is preferably a polymethine chromophore, more preferably a cyanine chromophore. Specific examines of the cyanine chromophore include those described, for example, in U.S. Pat. No. 5,268,486. The fluorescent quantum yield depends on the structure of the geometric isomer with respect to the methine chain and in general, those having an all-trans structure are higher in the fluorescent quantum yield than those where a part of the methine chain is a cis structure. The fluorescent quantum yield of the methine compound is known to decrease when the geometric isomer with respect to the methine chain is isomerized (particularly when the all-trans structure is broken and a part of the methine chain changes into a cis structure) in the excited state. Accordingly, the methine compound having a high fluorescent quantum is preferably a compound in which the geometric isomer with respect to the methine chain is not isomerized in the excited state. This compound is described in detail, for example, in *Photographic Science and Engineering*, Vol. 19, No. 5, page 273 (1975), *Journal of Physics Chemistry*, Vol. 99, page 8516 (1955).

The compound represented by formula (6) or (7) of the present invention is preferably not isomerized in the state where the geometric isomer with respect to the methine chain is excited, and for preventing the isomerization in the excited state, a method of using a crosslinked structure may be used. In particular, a methine compound where the methine chain is fixed to form an all-trans structure, is preferred. Examples of the methine compound having this crosslinked structure include the structures described in British Patents 610,064 and 618,889 and U.S. Pat. Nos. 4,490,463, 2,541,400 and 3,148,187.

At least one of $A_{63}$ and$A_{64}$ is directly substituted by from 1 to 10 dissociative groups. When $A_{64}$ is a cyanine chromophore, the number of dissociative groups is preferably from 2 to 5, more preferably 2. When $A_{64}$ is a merocyanine chromophore, the number of dissociative groups directly substituted is preferably from 1 to 4. The $A_{64}$ as a whole preferably has from 2 to 5 dissociative groups, more preferably 2 dissociative groups.

The dissociative group means a functional group which dissociates a proton and generates an anion seed, and examples thereof include an active methylene group, a hydroxy group, a thiol group, a carboxylic acid group, a sulfonic acid group, a phosphoric acid group, a sulfato group, a sulfonylcarbamoyl group, a sulfonylsulfamoyl group, a carbonylcarbamoyl group and a carbonylsulfamoyl group. Among these, preferred are a hydroxy group, a carboxylic acid group, a sulfonic acid group and a phosphoric acid group, more preferred is a sulfonic acid group.

In the present invention, when the compound represented by formula (6) or (7) is adsorbed to a silver halide grain, $A_{62}$ and $A_{64}$ each is preferably a chromophore not directly adsorbed to a silver halide grain.

In other words, $A_{62}$ and $A_{64}$ are preferably lower in the adsorption strength than $A_{61}$ and $A_{63}$, respectively. The order of the adsorption strength to a silver halide grain is most preferably $A_{62}<L_{61}<A_{61}$ or $A_{64}<L_{62}<A_{63}$.

As described above, $A_{61}$ and $A_{63}$ each is preferably a sensitizing dye moiety having adsorptivity to a silver halide grain but the adsorption may be attained by either physical adsorption or chemical adsorption.

$A_{62}$ and $A_{64}$ each is preferably low in the adsorptivity to a silver halide grain and is preferably a light-emitting dye.

Furthermore, $A_{61}$ and $A_{63}$ preferably show an absorption maximum wavelength longer than the absorption maximum wavelength of $A_{62}$ and $A_{64}$, respectively, in a silver halide photographic light-sensitive material. Also, the light-emission of $A_{62}$ and $A_{64}$ preferably overlaps with the absorption of $A_{61}$ and $A_{63}$, respectively. In addition, $A_{61}$ and $A_{63}$ each preferably forms a J-association product and in order to allow the compound of the present invention to have absorption and spectral sensitivity in the desired wavelength region, $A_{62}$ and $A_{64}$ each also preferably forms a J-association product.

Preferred examples of $A_{61}$ and $A_{63}$ are the same as those described with respect to Dye1.

$L_{61}$ and $L_{62}$ each represents a linking group (preferably a divalent linking group) or a single bond. $L_{63}$, $L_{64}$, $L_{65}$ and $L_{66}$ each represents a linking group. This linking group preferably comprises an atom or an atomic group containing at least one of carbon atom, nitrogen atom, sulfur atom and oxygen atom. The linking group is preferably a linking group having from 0 to 100 carbon atoms, more preferably from 1 to 20 carbon atoms, which is constructed by one or a combination of two or more of an alkylene group (e.g., methylene, ethylene, propylene, butylene, pentylene), an arylene group (e.g., phenylene, naphthylene), an alkenylene group (e.g., ethenylene, propenylene), an alkynylene group (e.g., ethynylene, propynylene), an amido group, an ester group, a sulfonamido group, a sulfonic acid ester group, a ureido group, a sulfonyl group, a sulfinyl group, a thioether group, an ether group, a carbonyl group, —N(Va)-(wherein Va represents a hydrogen atom or a monovalent substituent; examples of the monovalent substituent include W described above) and a heterocyclic divalent group (e.g., 6-chloro-1,3,5-triazine-2,4-diyl, pyrimidine-2,4-dily, quinoxaline-2,3-diyl).

The linking group may have a substituent represented by W and also, may have a ring (for example, an aromatic or nonaromatic hydrocarbon ring, or a heterocyclic ring).

The linking group is more preferably a divalent linking group having from 1 to 10 carbon atoms, which is constructed by one or a combination of two or more of an alkylene group having from 1 to 10 carbon atoms (e.g., methylene, ethylene, propylene, butylene), an arylene group having from 6 to 10 carbon atoms (e.g., phenylene, naphthylene), an alkenylene group having from 2 to 10 carbon atoms (e.g., ethenylene, propenylene), an alkynylene group having from 2 to 10 carbon atoms (e.g., ethynylene, propynylene), an ether group, an amido group, an ester group, a sulfonamido group and a sulfonic acid ester group. These groups each may be substituted by a substituent W. $L_{61}$ and $L_{62}$ each is preferably an alkylene group or an arylene group through an amido bond, an ester bond or an ether bond, more preferably an alkylene group through an amide group or an ester bond.

$L_{63}$, $L_{64}$, $L_{65}$ and $L_{66}$ each is preferably an alkylene group (e.g., ethylene, propylene, butylene), more preferably ethylene or propylene.

$n_{61}$, $n_{62}$, m61 and $m_{62}$ each is an integer of 1 to 5, preferably $n_{61}=n_{62}=m_{61}=m_{62}=1$.

Preferred examples of Dye1, $A_{61}$ and $A_{63}$ in the compound represented by (1), (3), (4), (5), (6), (7), (8) or (9) are set forth below, however, the present invention is not described thereto. The following structural formulae of the compounds of the present invention are only one limiting structure and the compounds each may have another structure which can be formed by resonance.

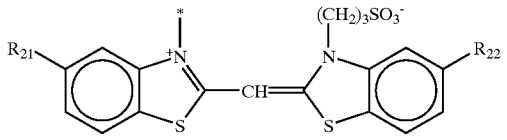

| | $R_{21}$ | $R_{22}$ |
|---|---|---|
| DA-1 | —Ph | —Cl |
| DA-2 | —Cl | —Cl |
| DA-3 | —Ph | —Ph |
| DA-4 | —Cl | —H |
| DA-5 | 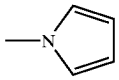 | —Cl |

-continued
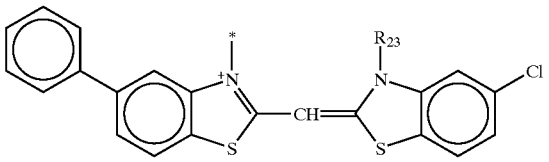
$R_{23}$
| | |
|---|---|
| DA-6 | $—(CH_2)_4SO_3^-$ |
| DA-7 | $—(CH_2)_2—CH(CH_3)SO_3^-$ |
| DA-8 | —C2H5 |
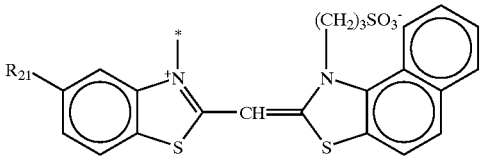
$R_{21}$
| | |
|---|---|
| DA-9 | —Cl |
| DA-10 | $—OCH_3$ |
DA-11
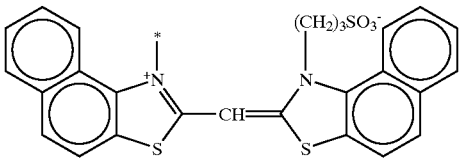
DA-12
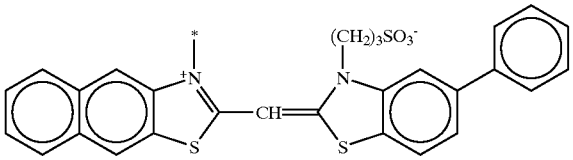
DA-13
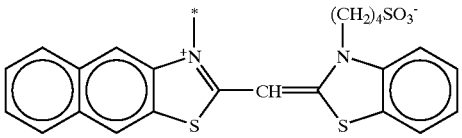
DA-14
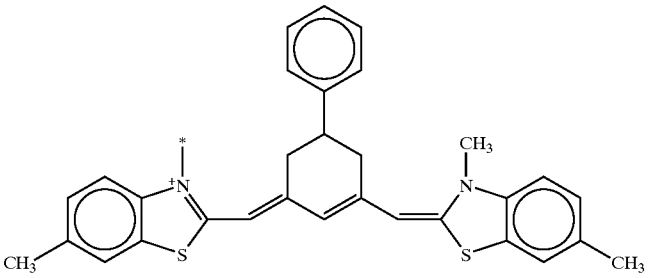
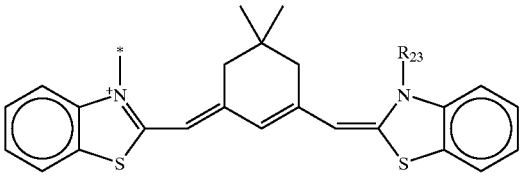
$R_{23}$ -continued
| | |
|---|---|
| DA-15 | $—C_2H_5$ |
| DA-16 | $—(CH_2)_3—SO_3^-$ |
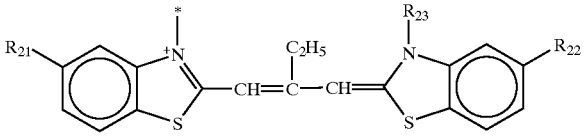
| | $R_{21}$ | $R_{22}$ | $R_{23}$ |
|---|---|---|---|
| DA-17 | —Cl | —Cl | $—(CH_2)_2—SO_3^-$ |
| DA-18 | $—CH_3$ | $—CH_3$ | $—(CH_2)_3SO_3^-$ |
| DA-19 | —Cl | —Cl | $—CH_2CONH—(CH_2)_2—SO_3^-$ |
| DA-20 | —Cl | —Cl | $—CH_2(OH)CH_2SO_3^-$ |
DA-21
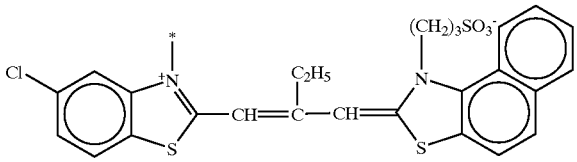
DA-22
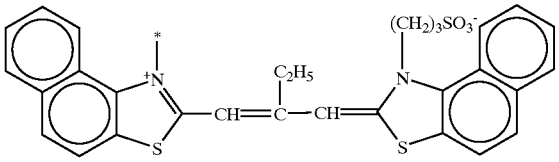
DA-23
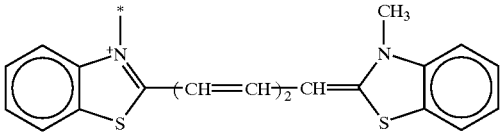
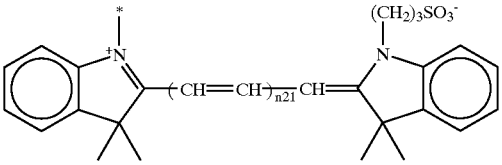
| | $n_{21}$ |
|---|---|
| DA-24 | 1 |
| DA-25 | 2 |
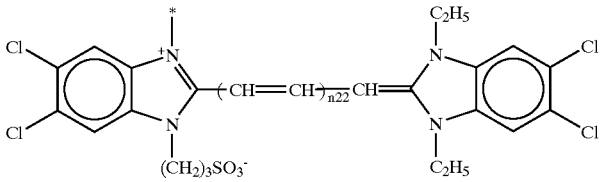
| | $n_{22}$ |
|---|---|
| DA-26 | 0 |
| DA-27 | 1 |
| DA-28 | 2 |
DA-29
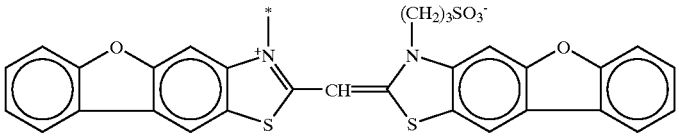

-continued
DA-30
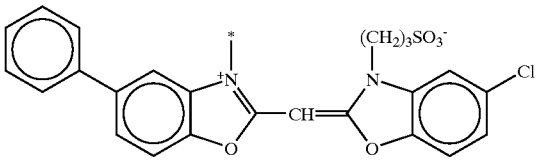
DA-31
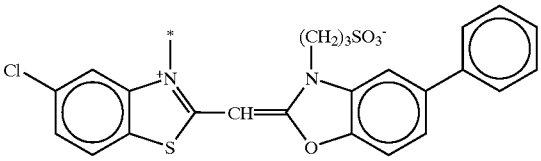
DA-32
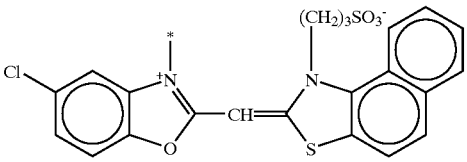
DA-33
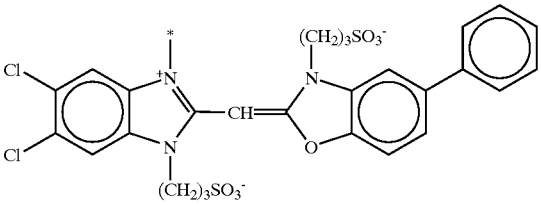
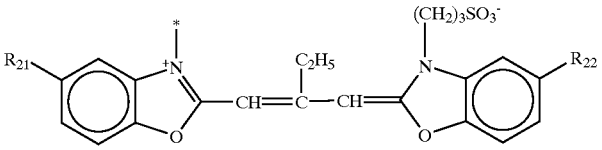
| | $R_{21}$ | $R_{22}$ |
|---|---|---|
| DA-34 | —Br | —Br |
| DA-35 | —Ph | —Cl |
| DA-36 | —Cl | —Cl |
| DA-37 | —Ph | —Ph |
DA-38
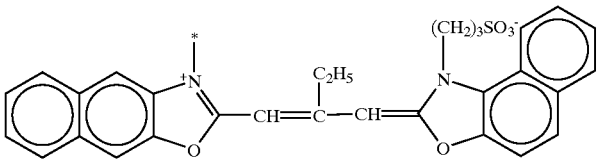
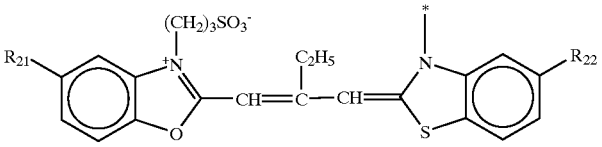
| | $R_{21}$ | $R_{22}$ |
|---|---|---|
| DA-39 | —Cl | —Cl |
| DA-40 | —Ph | —$CH_3$ |
| DA-41 | —$OCH_3$ | —$CH_3$ |

-continued
DA-42
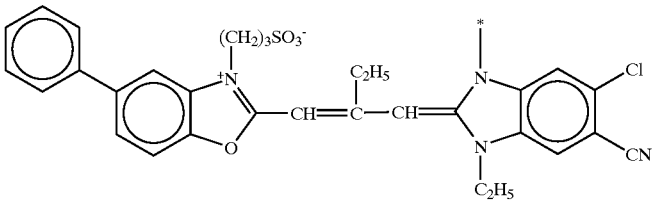
DA-43
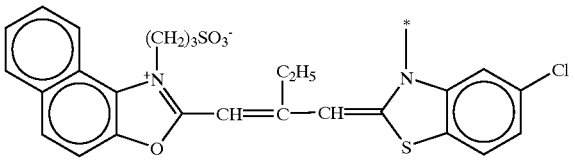
DA-44
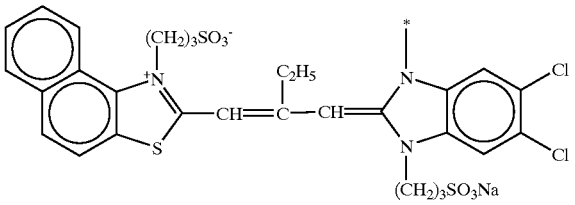
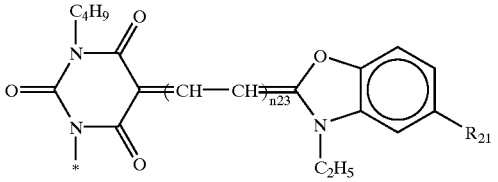
| | $n_{23}$ | $R_{21}$ |
|---|---|---|
| DA-45 | 1 | H |
| DA-46 | 1 | $—SO_3Na$ |
| DA-47 | 2 | H |
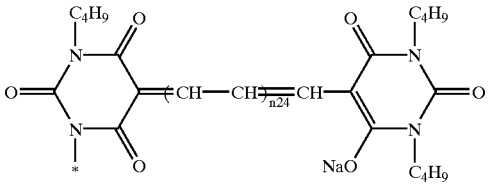
| | $n_{24}$ |
|---|---|
| DA-48 | 0 |
| DA-49 | 1 |
| DA-50 | 2 |
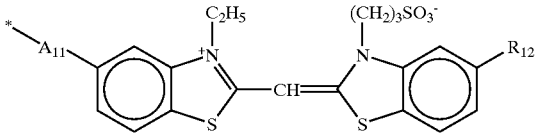
| | $A_{11}$ | $R_{12}$ |
|---|---|---|
| DA-51 | —O— | —Ph |
| DA-52 | —OC(=O)— | —Ph |
| DA-53 | —NHCO— | —Ph |

-continued
| | | |
|---|---|---|
| DA-54 | —$NHSO_2$— | —Ph |
| DA-55 | —CONH— | —Ph |
| DA-56 | —$SO_2NH$— | —Ph |
| DA-57 | —NHCO— | —Cl |
DA-58
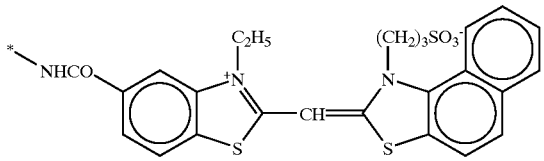
DA-59
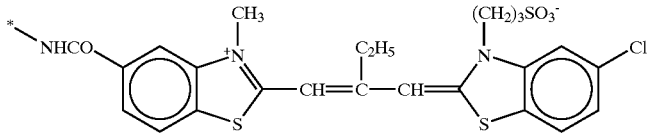
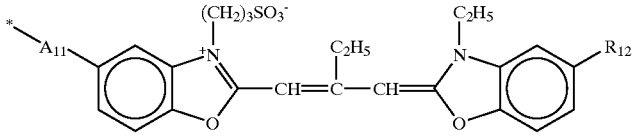
| | $A_{11}$ | $R_{12}$ |
|---|---|---|
| DA-60 | —NHCO— | —Br |
| DA-61 | —CONH— | —Cl |
In the compound represented by formula (1), (3), (4), (5), (8) or (9), preferred examples of Dye2 are shown below, however, the present invention is not limited thereto.
Examples of Dye2 Residue:
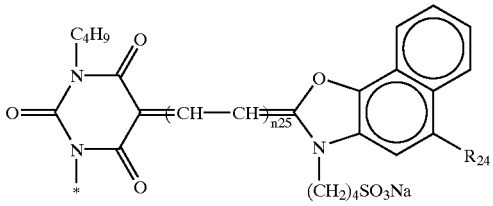
| | $n_{25}$ | $R_{24}$ |
|---|---|---|
| DB-1 | 1 | H |
| DB-2 | 1 | —$SO_3Na$ |
| DB-3 | 2 | H |
| DB-4 | 2 | —O—$(CH_2)_4$—$SO_3K$ |
DB-5
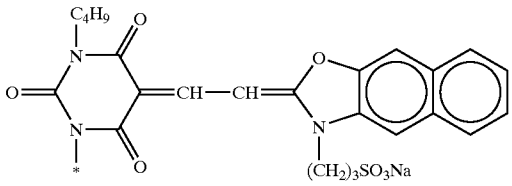

-continued
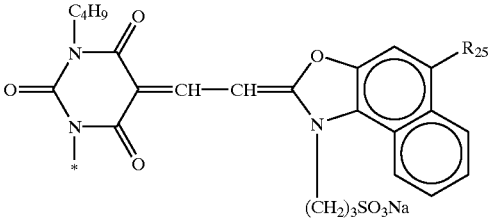
| | $R_{25}$ |
|---|---|
| DB-6 | H |
| DB-7 | —$SO_3Na$ |
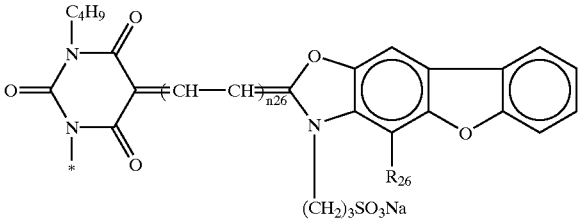
| | $n_{25}$ | $R_{24}$ |
|---|---|---|
| DB-8 | 1 | H |
| DB-9 | 1 | —$SO_3Na$ |
| DB-10 | 2 | H |
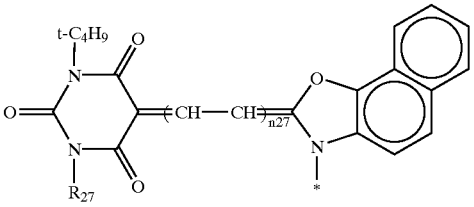
| | $n_{27}$ | $R_{27}$ |
|---|---|---|
| DB-11 | 1 | —Ph |
| DB-12 | 1 | —O—$(CH_2)_3$—$SO_3Na$ |
| DB-13 | 2 | —$CH_3$ |
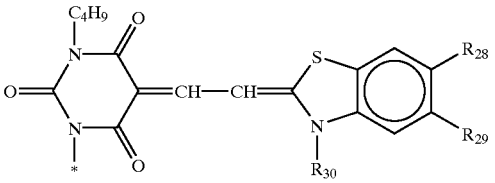
| | $R_{28}$ | $R_{29}$ | $R_{30}$ |
|---|---|---|---|
| DB-14 | H | H | —$C_2H_5$ |
| DB-15 | H | H | —$(CH_2)_3$—$SO_3K$ |
| DB-16 | H | —$SO_3Na$ | —$C_2H_5$ |
| DB-17 | H | —$SO_3Na$ | —$(CH_2)_3$—$SO_3Na$ |
| DB-18 | H | —$PO_3Na_2$ | —$C_2H_5$ |
| DB-19 | —O—$(CH_2)_3$—$SO_3Na$ | H | —$(CH_2)_3$—$SO_3Na$ |
| DB-20 | —$OPO_3Na_2$ | H | —$C_2H_5$ |

-continued
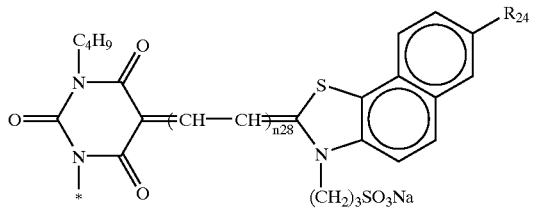
| | $n_{28}$ | $R_{24}$ |
|---|---|---|
| DB-21 | 1 | H |
| DB-22 | 1 | —O—$(CH_2)_3$—$SO_3Na$ |
| DB-23 | 2 | H |
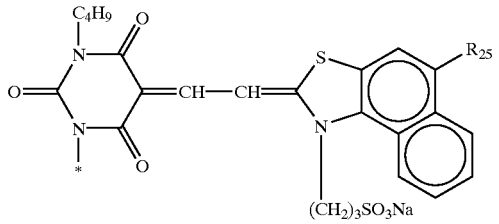
| | $R_{25}$ |
|---|---|
| DB-24 | H |
| DB-25 | —$SO_3Na$ |
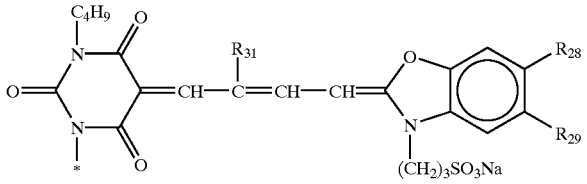
| | $R_{31}$ | $R_{28}$ | $R_{29}$ |
|---|---|---|---|
| DB-26 | H | H | —$SO_3H$ |
| DB-27 | —$C_2H_5$ | H | —$SO_3Na$ |
| DB-28 | —$C_2H_5$ | —O—$(CH_2)_3$—$SO_3Na$ | H |
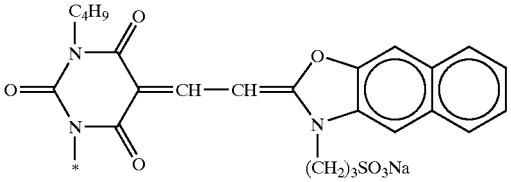
| | $R_{27}$ | $R_{28}$ | $R_{29}$ |
|---|---|---|---|
| DB-29 | —$CH_3$ | H | —$SO_3^-$—$H^+NEt_3$ |
| DB-30 | —Ph | —$(CH_2)_3$—$SO_3Na$ | H |
DB-31
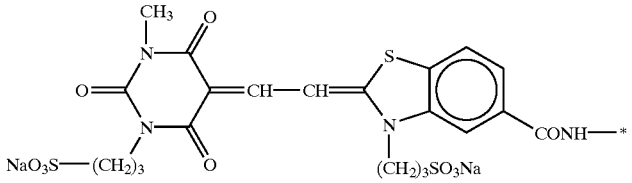

-continued

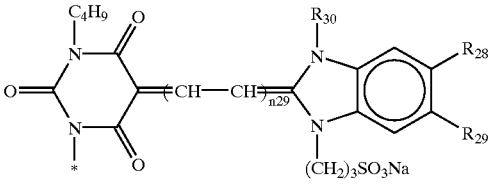

| | $n_{29}$ | $R_{28}$ | $R_{29}$ | $R_{30}$ |
|---|---|---|---|---|
| DB-32 | 1 | —Cl | —Cl | $—C_2H_5$ |
| DB-33 | 1 | —Cl | —Cl | $—(CH_2)_3—SO_3Na$ |
| DB-34 | 2 | —Cl | —Cl | $—(CH_2)_3—SO_3Na$ |
| DB-35 | 1 | $—SO_3Na$ | H | $—(CH_2)_3—SO_3Na$ |
| DB-36 | 1 | —Cl | —CN | $—(CH_2)_3—SO_3H$ |
| DB-37 | 1 | —Cl | $—CF_3$ | $—(CH_2)_3—SO_3—.H^+NEt_3$ |
| DB-38 | 1 | $—C_2H_5$ | $—C_2H_5$ | $—(CH_2)_3—SO_3Na$ |

DB-39

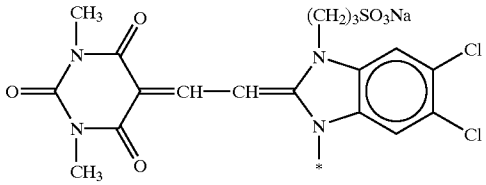

DB-40

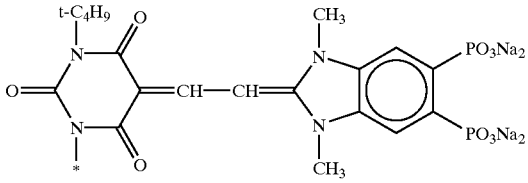

35

Examples of Dye2 Residue:

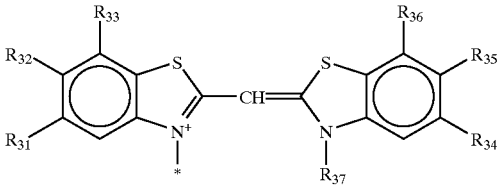

| | $R_{31}$ | $R_{32}$ | $R_{33}$ | $R_{34}$ | $R_{35}$ | $R_{36}$ | $R_{37}$ |
|---|---|---|---|---|---|---|---|
| DB-101 | H | H | H | H | $—SO_3Na$ | H | $—(CH_2)_3—SO_3^-$ |
| DB-102 | —Ph | H | H | H | $—SO_3K$ | H | $—(CH_2)_3—SO_3^-$ |
| DB-103 | —Cl | H | H | H | $—SO_3Na$ | H | $—(CH_2)_4—SO_3^-$ |
| DB-104 | $—CH_3$ | $—CH_3$ | H | $—SO_3^-\cdot\overset{+}{H}NEt_3$ | H | H | $—(CH_2)_2—CH(OH)CH_2SO_3^-$ |
| DB-105 | $—SO_3Na$ | H | H | H | $—SO_3Na$ | H | $—(CH_2)_3—SO_3^-$ |
| DB-106 | $—SO_3^-$ | H | H | H | $—SO_3Na$ | H | $—C_2H_5$ |
| DB-107 | —OH | —OH | H | H | $—SO_3^-$ | H | $—C_2H_5$ |
| DB-108 | H | —OH | H | H | —OH | H | $—(CH_2)_3—SO_3^-$ |

-continued
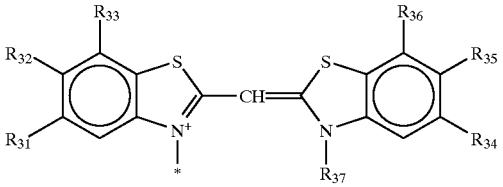
| | $R_{31}$ | $R_{32}$ | $R_{33}$ | $R_{34}$ | $R_{35}$ | $R_{36}$ | $R_{37}$ |
|---|---|---|---|---|---|---|---|
| DB-109 | —OH | —OH | H | H | H | H | $—(CH_2)_3—SO_3^-$ |
| DB-110 | H | $—COO^-$ | H | H | —COOH | H | $—CH_3$ |
| DB-111 | H | —COONa | H | H | H | H | $—CH_3$ |
| DB-112 | H | —F | H | H | —F | H | $—(CH_2)_2—CH(CH_3)SO_3^-$ |
| DB-113 | H | $—C_4H_9$-t | H | H | $—SO_3Na$ | H | $—(CH_2)_3—SO_3^-$ |
| DB-114 | H | H | $—C_4H_9$-t | H | H | $—CH_3$ | $—(CH_2)_3—SO_3^-$ |
Examples of Dye2 Residue:
DB-115
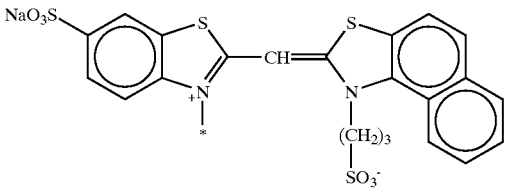
DB-116
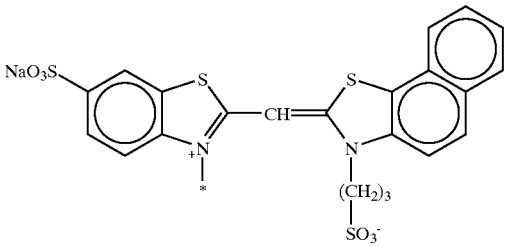
DB-117
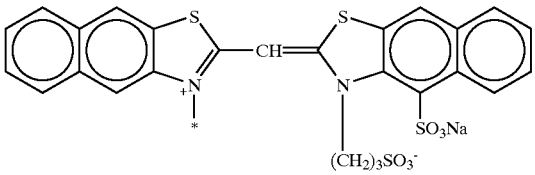
-continued
DB-118
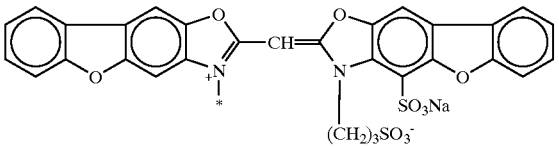
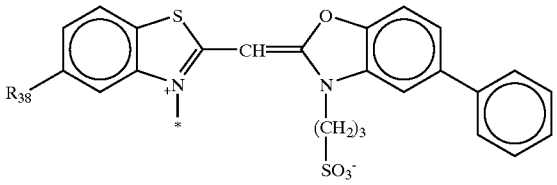
| | $R_{38}$ |
|---|---|
| DB-119 | —Cl |
| DB-120 | $—SO_3Na$ |
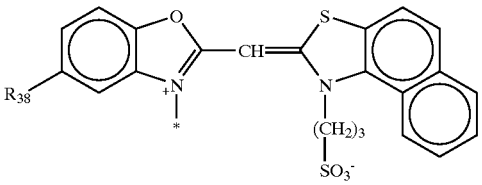
| | $R_{38}$ |
|---|---|
| DB-121 | —Br |
| DB-122 | $—SO_3Na$ |

Examples of Dye2 Residue:
DB-123
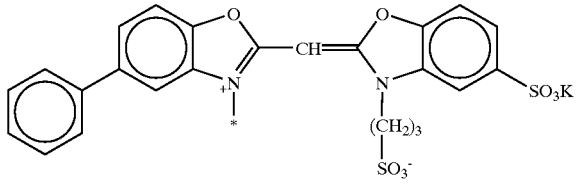
DB-124
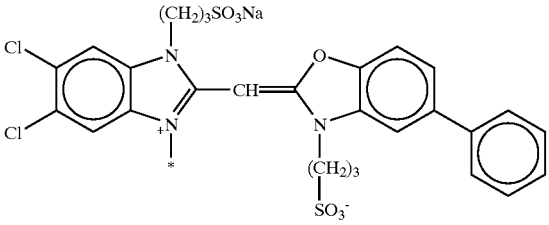
DB-125
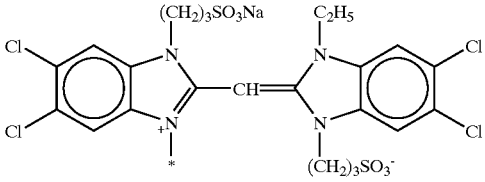
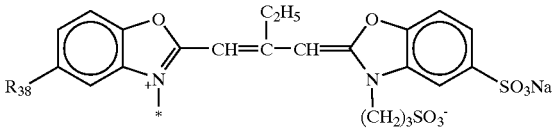
$R_{38}$
| | |
|---|---|
| DB-126 | —Cl |
| DB-127 | —$SO_3Na$ |
| DB-128 | —Ph |
DB-129
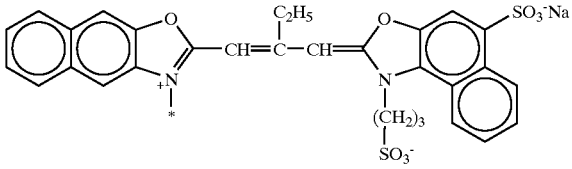
-continued
DB-130
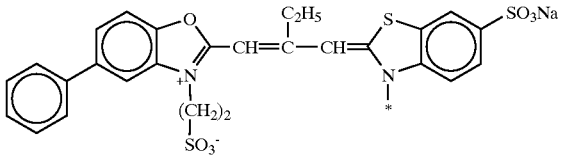
Examples of Dye2 Residue:
DB-131
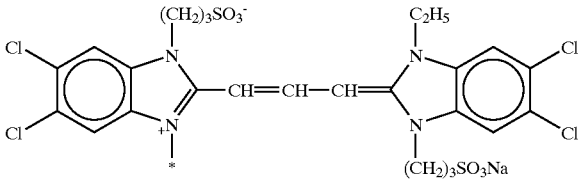
DB-132
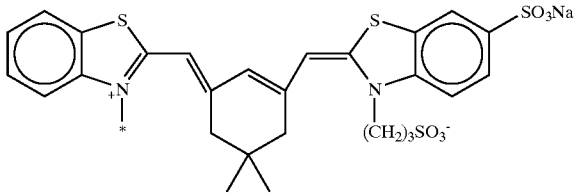
DB-133
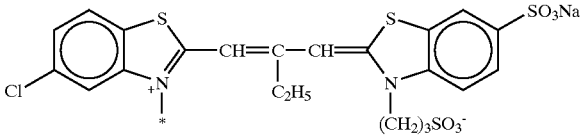
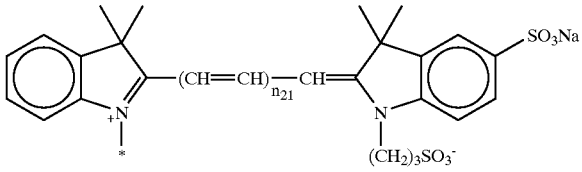
$n_{21}$
| | |
|---|---|
| DB-134 | 1 |
| DB-135 | 2 |
In the compound represented by formula (1) or (3) of the present invention, preferred examples of the linking group -$L_1$- are shown below, however, the present invention is not limited thereto.
Examples of Linking Chain -$L_2$- (Dye1 in the Left)
| | |
|---|---|
| L-1 | —$(CH_2)_4$— |
| L-2 | —$(CH_2)_8$— |

-continued
L-3 $—(CH_2)_7CH{=}CH—(CH_2)_7—$
L-4
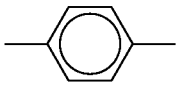
L-5
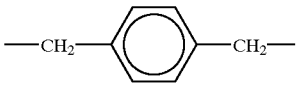
L-6
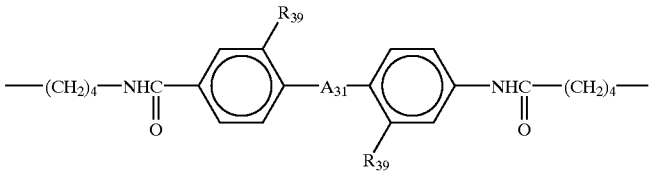
| | $A_{31}$ | $R_{39}$ |
|---|---|---|
| L-6 | — | H |
| L-7 | — | $—SO_3^-.H^+NEt(i\text{-}Pr)_2$ |
| L-8 | —O— | H |
| L-9 | —O— | $—SO_3Na$ |
| L-10 | $—SO_2—$ | H |
L-11
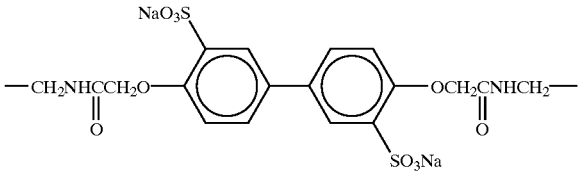
L-12
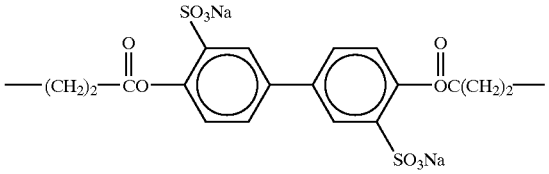
L-13
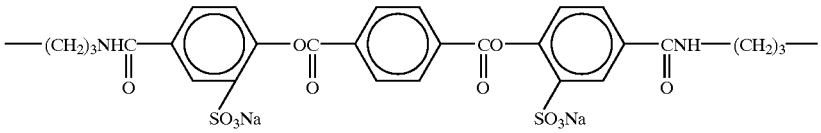
L-14 $—(CH_2)_4—NHC(=O)CH(SO_3Na)CH_2C(=O)NH—(CH_2)_4—$
L-15
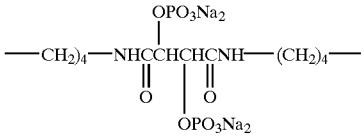
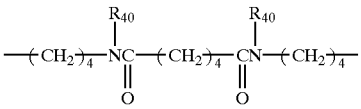
| | $R_{40}$ |
|---|---|
| L-16 | $—(CH_2)_2SO_3Na$ |
| L-17 | $—(CH_2)_2—COONa$ |
| L-18 | $—(CH_2)_2PO_3Na_2$ |

-continued
L-19
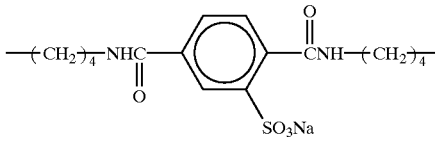
$-(CH_2)_{n31}-NHC(=O)-(CH_2)_{n32}-$
| | $n_{31}$ | $n_{32}$ |
|---|---|---|
| L-20 | 4 | 5 |
| L-21 | 8 | 5 |
| L-22 | 8 | 1 |
| L-23 | 4 | 3 |
| L-24 | 4 | 1 |
L-25
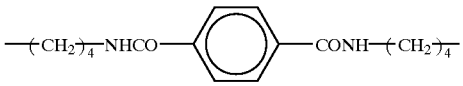
L-26 $-(CH_2)_4-NHCO-(CH_2)_2-CONH-(CH_2)_4-$
$-(CH_2)_{n33}-CH(=O)-NH-(CH_2)_{n34}-$
| | $n_{33}$ | $n_{34}$ |
|---|---|---|
| L-27 | 5 | 4 |
| L-28 | 5 | 8 |
| L-29 | 1 | 6 |
L-30 $-(CH_2)_6-OC(=O)-(CH_2)_5-$
L-31 $-(CH_2)_5-CO(=O)-(CH_2)_6-$
L-32 $-(CH_2)_8-NHSO_2-(CH_2)_3-$
$-(CH_2)_2(OCH_2CH_2)_{n35}-NHC(=O)-(CH_2)_{n36}-$
| | $n_{35}$ | $n_{36}$ |
|---|---|---|
| L-33 | 2 | 5 |
| L-34 | 2 | 1 |
| L-35 | 3 | 1 |
$-(CH_2)_2(OCH_2CH_2)_{n37}-CH(=O)-NH-(CH_2)_{n38}-$
| | $n_{37}$ | $n_{38}$ |
|---|---|---|
| L-36 | 2 | 3 |
| L-37 | 2 | 4 |
| L-38 | 2 | 8 |
L-39 $-(CH_2)_3-CH(=O)-NH-(CH_2)_2(OCH_2CH_2)_2-CONH-(CH_2)_3-$
L-40 $-(CH_2)_4-NHC(=O)-(CH_2CH_2O)_2(CH_2)_2-$
L-41 $-(CH_2)_5-C(=O)-NH-(CH_2CH_2O)_2(CH_2)_2-$ -continued

| | |
|---|---|
| L-42 | $-(CH_2)_2(OCH_2CH_2)_2-\overset{\overset{O}{\|}}{C}O-(CH_2)_5-$ |
| L-43 | $-(CH_2)_2-(OCH_2CH_2)_2-NHSO_2-(CH_2)_3-$ |
| | $-(CH_2)_2-(A_{32}CH_2CH_2)_2-NHCO-(CH_2)_5-$ $A_{32}$ |
| L-44 | $-S-$ |
| L-45 | $-\underset{\underset{CH_3}{\|}}{N}-$ |
| L-46 | $-\underset{\underset{OH}{\|}}{CH}-$ |
| L-47 | $-(CH_2)_2-SO_2-(CH_2)_2-NHCO-(CH_2)_5-$ |

Specific examples of the compound represented by formula (1) or (3) of the present invention are set forth below, however, the present invention is not limited thereto.

Specific Examples of the Compound Dye1-$L_1$-Dy2 of the Present Invention:

| | Dye1 | $-L_1-$ | Dye2 |
|---|---|---|---|
| D-1 | DA-1 | L-2 | DB-1 |
| D-2 | " | L-22 | DB-2 |
| D-3 | " | L-34 | DB-1 |
| D-4 | " | L-22 | DB-5 |
| D-5 | " | " | DB-7 |
| D-6 | " | " | DB-9 |
| D-7 | " | L-34 | " |
| D-8 | " | L-32 | DB-12 |
| D-9 | " | L-2 | DB-16 |
| D-10 | " | L-22 | " |
| D-11 | " | L-7 | " |
| D-12 | " | L-22 | DB-17 |
| D-13 | " | " | DB-18 |
| D-14 | " | " | DB-19 |
| D-15 | " | L-20 | " |
| D-16 | " | L-22 | DB-22 |
| D-17 | " | L-14 | DB-25 |
| D-18 | " | L-27 | DB-29 |
| D-19 | " | L-19 | DB-31 |
| D-20 | " | L-22 | DB-32 |
| D-21 | " | L-34 | " |
| D-22 | " | L-22 | DB-33 |
| D-23 | " | " | DB-35 |
| D-24 | " | L-41 | DB-39 |
| D-25 | " | L-43 | DB-40 |
| D-26 | DA-45 | L-7 | DB-2 |
| D-27 | DA-2 | L-22 | DB-1 |
| D-28 | " | " | DB-9 |
| D-29 | " | " | DB-17 |
| D-30 | " | " | DB-19 |
| D-31 | DA-2 | L-22 | DB-32 |
| D-32 | " | " | DB-33 |
| D-33 | " | L-34 | DB-9 |
| D-34 | " | L-24 | DB-17 |
| D-35 | " | L-34 | DB-32 |
| D-36 | DA-9 | L-22 | DB-2 |
| D-37 | " | L-34 | DB-5 |
| D-38 | " | L-37 | DB-7 |
| D-39 | " | L-22 | DB-9 |
| D-40 | " | " | DB-17 |
| D-41 | " | L-30 | DB-22 |
| D-42 | " | L-22 | DB-25 |

-continued

| | Dye1 | $-L_1-$ | Dye2 |
|---|---|---|---|
| D-43 | " | L-34 | DB-32 |
| D-44 | DA-17 | L-24 | DB-21 |
| D-45 | DA-27 | L-22 | DB-3 |
| D-46 | " | " | DB-10 |
| D-47 | " | " | DB-28 |
| D-48 | " | L-34 | DB-34 |
| D-49 | DA-29 | L-47 | DB-5 |
| D-50 | DA-35 | L-22 | DB-4 |
| D-51 | " | " | DB-27 |
| D-52 | DA-36 | L-34 | DB-34 |
| D-53 | DA-37 | L-22 | DB-10 |
| D-54 | DA-38 | " | DB-3 |
| D-55 | DA-39 | " | DB-22 |
| D-56 | DA-53 | L-22 | DB-32 |
| D-57 | DA-55 | L-27 | DB-9 |
| D-58 | DA-58 | L-22 | DB-17 |
| D-59 | DA-60 | " | DB-1 |

The compound of the present invention is preferably such that $X_1$ and $X_2$ each is —O— or —S—, $X_{11}$ is —S— or $-NR_{14}-$, and L is one selected from L-36 to L-38, more preferably such that $X_1$ and $X_2$ each is —S—, $X_{11}$ is $-NR_{14}-$, and L is one selected from L-36 to L-38.

In the compound represented by formula (4) or (8) of the present invention, preferred examples of the linking group $-L_{41}-$ are set forth below, however, the present invention is not limited thereto.

| $(CH_2)_2-(OCH_2CH_2)_{n39}-NHCO-(CH_2)_{n40}-$ | n39 | n40 |
|---|---|---|
| L-33 | 2 | 5 |
| L-102 | 2 | 3 |
| L-34 | 2 | 1 |
| L-104 | 3 | 5 |
| L-35 | 3 | 1 |
| L-106 | 4 | 1 |

| $(CH_2)_2-(OCH2CH_2)_{n39}-CONH-(CH_2)_{n40}-$ | n39 | n40 |
|---|---|---|
| L-107 | 2 | 1 |
| L-108 | 2 | 2 |

-continued

| | | |
|---|---|---|
| L-36 | 2 | 3 |
| L-37 | 3 | 4 |
| L-38 | 2 | 8 |

L-39
$—(CH_2)_3—CONH—(CH_2)_2—(OCH_2CH_2)_2—CONH—(CH_2)_3—$
L-40
$—(CH_2)_4—NHCO—(CH_2CH_2O)_2—(CH_2)_2—$
L-41
$—(CH_2)_5—CONH—(CH_2CH_2O)_2—(CH_2)_2—$
L-115
$—(CH_2)_2—O—(CH_2)_2—NHCO—(CH_2)_2—O—(CH_2)_2—$
L-42

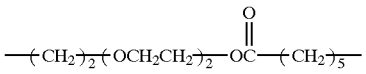

L-117

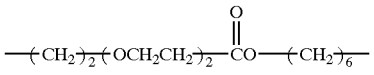

L-118

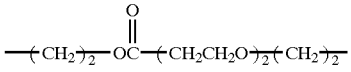

L-43
$—(CH_2)_2(OCH_2CH_2)_2—NHSO_2—(CH_2)_3—$
L-120
$—(CH_2)_3—SO_2NH—(CH_2CH_2O)_2—(CH_2)_2—$ $—(CH_2)_2—(A_{32}CH_2CH_2)_2—NHCO—(CH_2)_5—$
$A_{32}$

| | |
|---|---|
| L-44 | —S— |
| L-45 | —N(CH$_3$)— |
| L-46 | —CH(OH)— |

L-124
$—(CH_2—CH=CH—CH_2O)_2—(CH_2)_2—NHCO—(CH_2)—$
L-47
$—(CH_2)_2—SO_2—(CH_2)_2—NHCO—(CH_2)_5—$

Specific examples of the compound represented by formula (4) or (8) of the present invention are set froth below, however, the present invention is not limited thereto.

| | Dye1 | —$L_{41}$— | Dye2 |
|---|---|---|---|
| D-101 | DA-1 | L-33 | DB-101 |
| D-102 | " | " | DB-103 |
| D-103 | " | " | DB-105 |
| D-104 | " | " | DB-106 |
| D-105 | " | " | DB-108 |
| D-106 | " | " | DB-109 |
| D-107 | " | " | DB-111 |
| D-108 | " | " | DB-114 |
| D-109 | " | " | DB-115 |
| D-110 | " | " | DB-118 |
| D-111 | " | " | DB-120 |
| D-112 | " | L-34 | DB-101 |
| D-113 | " | " | DB-105 |

-continued

| | Dye1 | —$L_{41}$— | Dye2 |
|---|---|---|---|
| D-114 | " | L-35 | DB-106 |
| D-115 | " | L-37 | DB-102 |
| D-116 | " | L-39 | DB-116 |
| D-117 | " | L-40 | DB-106 |
| D-118 | " | L-41 | " |
| D-119 | " | L-42 | DB-101 |
| D-120 | " | L-43 | DB-105 |
| D-121 | " | L-45 | DB-106 |
| D-122 | " | L-46 | " |
| D-123 | " | L-47 | " |
| D-124 | DA-2 | L-33 | DB-101 |
| D-125 | " | " | DB-105 |
| D-126 | DA-9 | L-33 | DB-101 |
| D-127 | " | " | DB-102 |
| D-128 | " | " | DB-105 |
| D-129 | " | " | DB-106 |
| D-130 | " | " | DB-115 |
| D-131 | " | " | DB-117 |
| D-132 | " | " | DB-118 |
| D-133 | " | " | DB-122 |
| D-134 | " | L-42 | DB-105 |
| D-135 | " | L-43 | DB-105 |
| D-136 | A-17 | L-33 | DB-101 |
| D-137 | " | " | DB-126 |
| D-138 | " | " | DB-133 |
| D-139 | DA-27 | " | DB-105 |
| D-140 | " | " | DB-131 |
| D-141 | " | " | DB-127 |
| D-142 | DA-29 | " | DB-118 |
| D-143 | DA-35 | " | DB-106 |
| D-144 | " | " | DB-127 |
| D-145 | DA-36 | " | DB-127 |
| D-146 | DA-37 | " | DB-128 |
| D-147 | DA-38 | " | DB-129 |
| D-148 | DA-39 | " | DB-127 |
| D-149 | " | " | DB-130 |

In the compound represented by formula (5) or (9) of the present invention, preferred examples of the linking chain -$L_{51}$- are set forth below, however, the present invention is not limited thereto.

Examples of Linking Chain -$L_{51}$- (Dye1 in the Left):

L-20 $—(CH_2)_4—NHCO—(CH_2)_5—$
L-21 $—(CH_2)_8—NHCO—(CH_2)_5—$
L-22 $—(CH_2)_8NHCOCH_2—$
L-23 $—(CH_2)_4—NHCO—(CH_2)_3—$
L-205 $—(CH_2)_8NHCO—(CH_2)_2—$
L-206 $—CH_2—NHCO—(CH_2)_5—$

L-25

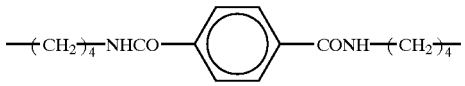

L-208

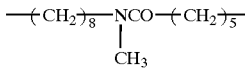

L-209

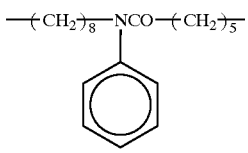

-continued

L-210 —$CH_2$—CH=CH—NHCO—$(CH_2)_5$—
L-211 —$(CH_2)_2$—NHCO—$(CH_2)_3$—
L-212 —$(CH_2)_3$—NHCO—$(CH_2)_5$—
L-213 —$(CH_2)_4$—NHCO—$(CH_2)_2$—CONH—$(CH_2)_4$—
L-27 —$(CH_2)_5$—CONH—$(CH_2)_4$—
L-28 —$(CH_2)_5$—CONH—$(CH_2)_8$—
L-29 —$CH_2$CONH—$(CH_2)_6$—

L-217

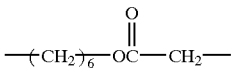

L-30

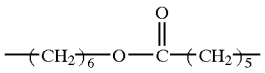

L-119

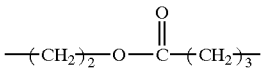

L-31

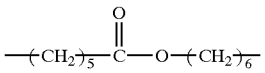

L-221

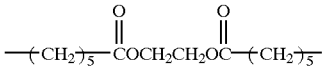

L-222 —$(CH_2)_3$—$SO_2$NH—$(CH_2)_4$—
L-223 —$(CH_2)_4$—$NHSO_2$—$(CH_2)_3$—
L-224 —$(CH_2)_8$—$NHSO_2$—$(CH_2)_4$—
L-225 —$(CH_2)_3$—$SO_2$NH—$(CH_2)_4$—$NHSO_2$—$(CH_2)_3$—

L-226

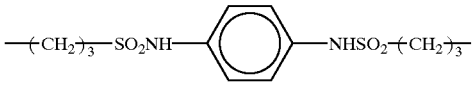

L-1 —$(CH_2)_4$—
L-2 —$(CH_2)_8$—
L-3 —$(CH_2)_7$—CH=CH—$(CH_2)_7$—

L-4

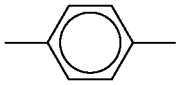

L-231

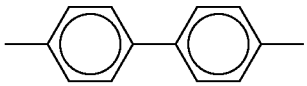

Specific examples of the compound represented by formula (5) or (9) of the present invention are set forth below, however, the present invention is not limited thereto.

Examples of the Compound Dye1-$L_{51}$-Dye2 of the Present Invention:

| | Dye1 | —$L_{51}$— | Dye2 |
|---|---|---|---|
| D-201 | DA-1 | L-2 | DB-101 |
| D-202 | " | " | DB-103 |
| D-203 | " | " | DB-105 |
| D-204 | " | " | DB-106 |
| D-205 | " | " | DB-115 |
| D-206 | " | " | DB-118 |
| D-207 | " | " | DB-120 |
| D-208 | " | L-20 | DB-101 |

-continued

| | Dye1 | —$L_{51}$— | Dye2 |
|---|---|---|---|
| D-209 | " | " | DB-109 |
| D-210 | " | " | DB-110 |
| D-211 | " | " | DB-117 |
| D-212 | " | L-22 | DB-101 |
| D-213 | " | L-25 | DB-101 |
| D-214 | " | " | DB-102 |
| D-215 | " | " | DB-108 |
| D-216 | " | " | DB-109 |
| D-217 | " | " | DB-111 |
| D-218 | " | " | DB-114 |
| D-219 | " | " | DB-116 |
| D-220 | " | L-213 | DB-101 |
| D-221 | " | L-211 | DB-103 |
| D-222 | " | L-28 | DB-105 |
| D-223 | " | L-108 | DB-122 |
| D-224 | " | L-30 | DB-102 |
| D-225 | " | L-221 | DB-101 |
| D-226 | " | L-224 | DB-103 |
| D-227 | " | L-225 | DB-102 |
| D-228 | DA-2 | L-21 | DB-101 |
| D-229 | " | " | DB-105 |
| D-230 | " | " | DB-115 |
| D-231 | " | " | DB-118 |
| D-232 | " | L-20 | DB-102 |
| D-233 | " | L-30 | DB-106 |
| D-234 | DA-9 | L-21 | DB-103 |
| D-235 | " | " | DB-105 |
| D-236 | " | " | DB-106 |
| D-237 | " | " | DB-115 |
| D-238 | " | " | DB-116 |
| D-239 | " | " | DB-117 |
| D-240 | " | | DB-122 |
| D-241 | " | L-20 | DB-101 |
| D-242 | " | L-30 | DB-102 |
| D-243 | " | " | DB-106 |
| D-244 | " | " | DB-115 |
| D-245 | " | " | DB-118 |
| D-246 | " | " | DB-103 |
| D-247 | " | L-224 | DB-103 |
| D-248 | DA-17 | L-20 | DB-101 |
| D-219 | " | L-30 | DB-115 |
| D-250 | " | L-20 | DB-126 |
| D-251 | " | L-30 | DB-127 |
| D-252 | " | L-20 | DB-131 |
| D-253 | " | L-30 | DB-131 |
| D-254 | DA-1 | L-30 | DB-101 |

Specific examples of the compound represented by formula (6) or (7) are set forth below, however, the present invention is not limited thereto.

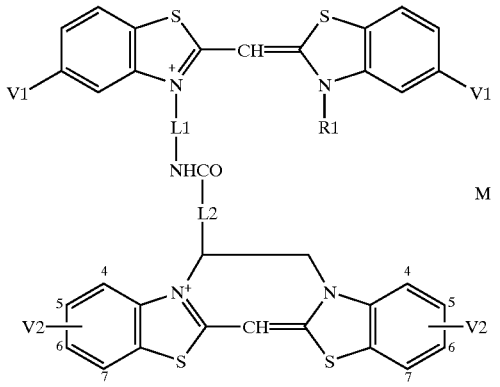
| Dye No. | V1 | V2 | R1 | L1* | L2 | M |
|---|---|---|---|---|---|---|
| I-1 | Ph | H | $(CH_2)_3SO_3^-$ | $—(CH_2)_4—$ | — | $2Cl^-$ |
| I-2 | Ph | 5-OH | $(CH_2)_3SO_3^-$ | $—(CH_2)_2O(CH_2)_2—$ | $CH_2$ | $Cl^-$ |
| I-3 | Cl | 5,6-Benzo | $(CH_2)_3SO_3^-$ | $—(CH_2)—(O(CH_2)_2)_2—$ | — | $Br^-$ |
| I-4 | Ph | $5\text{-}SO_3^-$ | $(CH_2)_3SO_3^-$ | $—(CH_2)_4—$ | — | $HN^+(C_2H_5)_3$ |
| I-5 | Br | $6\text{-}COO^-$ | $C_2H_5$ | $—(CH_2)_2NHC(=O)(CH_2)_2—$ | $(CH_2)_3$ | — |
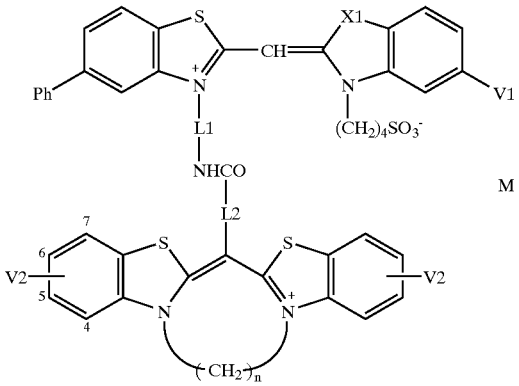
| Dye No. | X1 | V1 | V2 | n | L1* | L2 | M |
|---|---|---|---|---|---|---|---|
| I-6 | S | Ph | H | 2 | $—(CH_2)_4—$ | $—(CH_2)_5—$ | $Cl^-$ |
| I-7 | O | Ph | 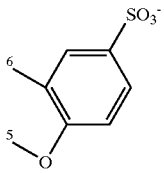 | 3 | $—(CH_2)_3—$ | $—(CH_2)_3—$ | $HN^+(C_2H_6)_3$ |
| I-8 | —CH═CH— | $CH_3$ | $6\text{-}SO_3^-$ | 2 | $—(CH_2)_2O(CH_2)_2—$ | $—(CH_2)_5—$ | $Na^+$ |
| I-9 | S | Cl | $5\text{-}SO_3^-$ | 2 | $—(CH_3)_2NHC(=O)(CH_2)_2—$ | $CH_2$ | $Na^+$ |

-continued
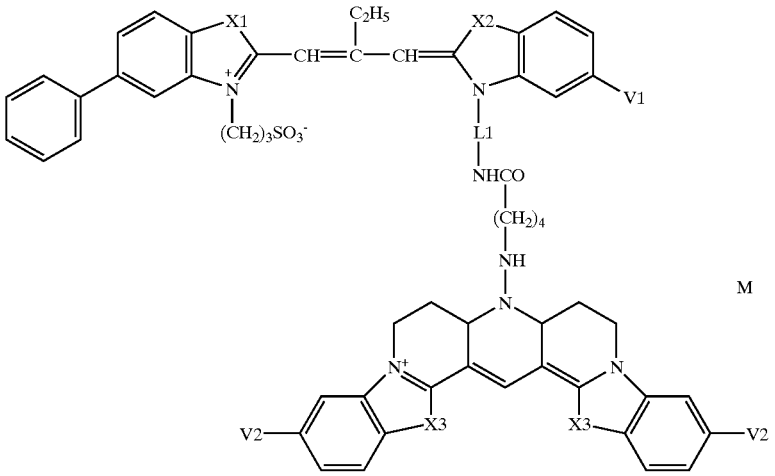
| Dye No. | X1 | X2 | X3 | V1 | V2 | L1* | M |
|---|---|---|---|---|---|---|---|
| I-10 | O | S | O | Cl | 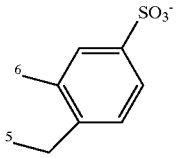 | —$(CH_2)_4$— | $Na^+$ |
| I-11 | S | S | S | Br | $SO_3^-$ | —$(CH_2)_6$— | $HN^+(C_2H_5)_3$ |
I-12
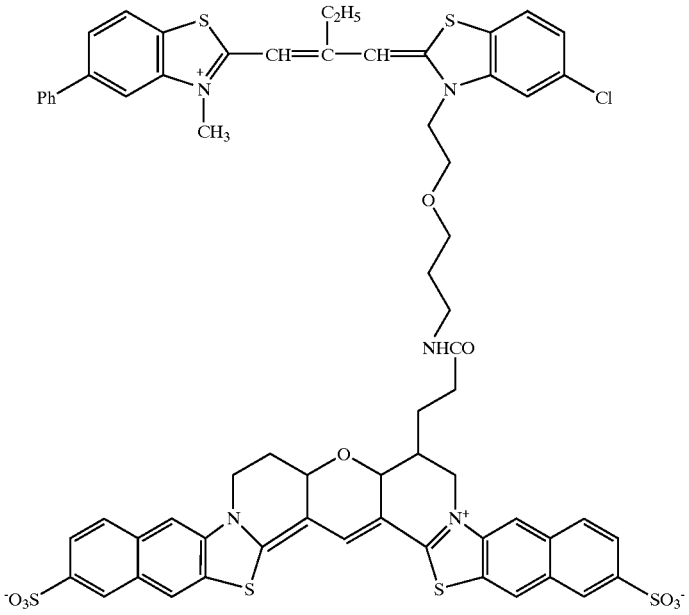

-continued
I-13
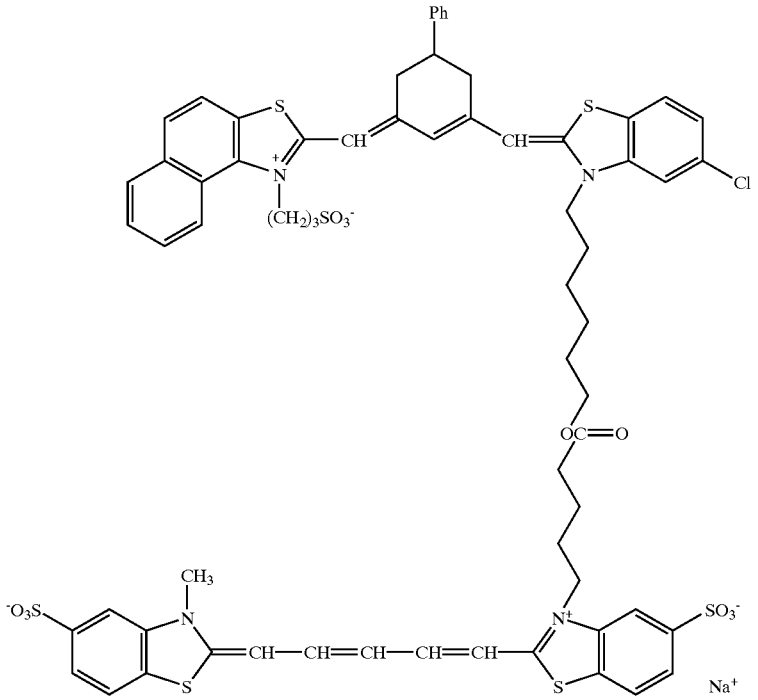
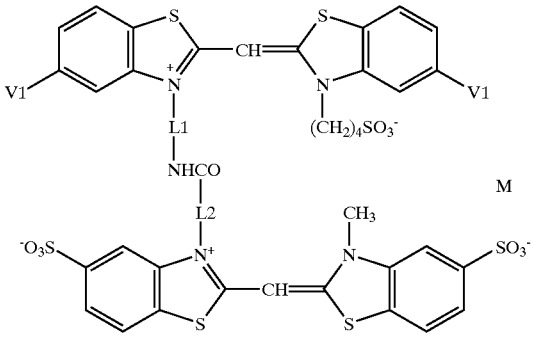
| Dye No. | V1 | L1* | L2 | M |
|---|---|---|---|---|
| I-14 | Cl | —$(CH_2)_6$— | —$(CH_2)_4$— | $Na^+$ |
| I-15 | Ph | —$(CH_2)_2O(CH_2)_2$— | —$(CH_2)_2$— | $HN^+(C_2H_5)_3$ |
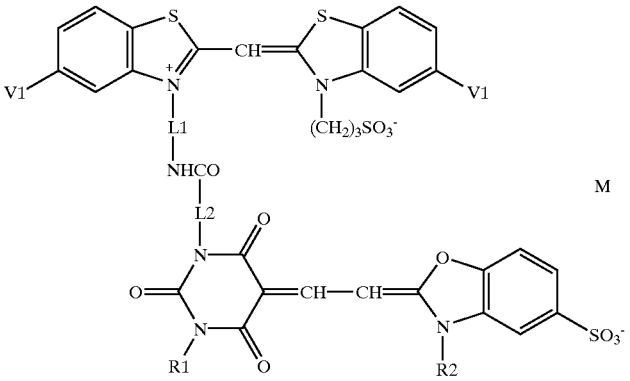
| Dye No. | V1 | R1 | R2 | L1* | L2 | M |
|---|---|---|---|---|---|---|
| I-16 | Cl | $CH_3$ | $(CH_2)_3SO_3^-$ | —$(CH_2)_4$— | $CH_2$ | $2Na^+$ |
| I-17 | Ph | $(CH_2)_3SO_3^-$ | $C_2H_5$ | —$(CH_2)_4$— | $CH_2$ | $2HN^+(C_2H_5)_3$ |
*The left links with $N^+$ atom and the right links with NHCO (hereinafter the same).

The compounds of the present invention can be synthesized according to the methods described, for example, in F. M. Harmer, *Heterocyclic Compounds—Cyanine Dyes and Related Compounds*, John Wiley & Sons (1964), D. M. Sturmer, *Heterocyclic Compounds—Special topics in heterocyclic chemistry*, Chap. 18, Section 14, pp. 482–515, John & Wiley & Sons, New York, London (1977), and European Patent 8,87700A1.

In the compound represented by formula (1), (4) or (5), the adsorption strength to a silver halide grain is preferably Dye1>Dye2. In this point, Dye2 preferably contains one or more of —$SO_3M$, —$OSO_3M$, —$OPO_3M_2$, —$PO_3M_2$ and —COOM, more preferably at least one or more —$SO_3M$. M represents proton or cation.

The adsorptivity of each dye constituting the chromophores represented by Dye1 and Dye2 to a silver halide grain can be measured by a method of determining an adsorption isotherm using respective model compounds or by a method of determining a saturation adsorption amount. These methods are in principle the same and the test results of adsorptivity are also the same. This is described in detail later by referring to the report by A. Herz and also in Examples.

It is preferred that when Dye2 of the compound represented by formula (1), (4) or (5) is photo-excited, Dye2 can cause electron transfer or energy transfer to Dye1.

Furthermore, in a silver halide photographic emulsion or a silver halide photographic material, when the compound represented by formula (1), (4) or (5) is adsorbed to a silver halide grain through Dye1 and the Dye2 not adsorbed to the silver halide grain is photo-exited, the Dye2 preferably causes electron transfer or energy transfer to Dye1.

Also, in a silver halide photographic emulsion or a silver halide photographic material, the compound represented by formula (1), (4) or (5) preferably adsorbs to a silver halide grain through Dye1 to form a J-association product. The Dye2 not adsorbed to the silver halide grain also preferably forms a J-association product. The formation of J-association can be confirmed by the appearance of an association band on a spectral absorption curve.

The silver halide photographic light-sensitive material of the present invention is described in detail below.

The compound of the present invention is used as a sensitizing dye mainly in a silver halide photographic emulsion or a silver halide photographic light-sensitive material.

In the silver halide photographic emulsion or silver halide light-sensitive material, the compounds of the present invention may be used individually or in combination of two or more thereof or may be used in combination with another sensitizing dye. Preferred examples of the dye used here include cyanine dyes, merocyanine dyes, rhodacyanine dyes, trinuclear merocyanine dyes, tetranuclear merocyanine dyes, allopolar dyes, hemicyanine dyes and styryl dyes. Among these, preferred are cyanine dyes, merocyanine dyes and rhodacyanine dyes, and more preferred are cyanine dyes. These dyes are described in detail in F. M. Harmer, *Heterocyclic Compounds— Cyanine Dyes and Related Compounds*, John Wiley & Sons, New York, London (1964), D. M. Sturmer, *Heterocyclic Compounds—Special topics in heterocyclic chemistry*, Chap. 18, Section 14, pp. 482–515.

Preferred examples of the dye include the sensitizing dyes represented by the formulae or described as specific examples in U.S. Pat. No. 5,994,051, pp. 32–44, and U.S. Pat. No. 5,747,236, pp. 30–39.

Also, preferred examples of the cyanine dye, merocyanine dye and rhodacyanine dye include those represented by formulae (XI), (XII) and (XIII) of U.S. Pat. No. 5,340,694, columns 21 to 22 (on the condition that the numbers of n12, n15, n17 and n18 are not limited and each is an integer of 0 or more (preferably 4 or less).

These sensitizing dyes may be used individually or in combination of two or more thereof. The combination of sensitizing dyes is often used for the purpose of supersensitization. Representative examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,303,377, 3,769,301, 3,814,609, 3,837,862 and 4,026,707, British Patents 1,344,281 and 1,507,803, JP-B-43-4936 (the term "JP-B" as used herein means an "examined Japanese patent publication"), JP-B-53-12375, JP-A-52-110618 and JP-A-52-109925.

Together with the sensitizing dye, a dye which itself has no spectral sensitizing effect or a substance which absorbs substantially no visible light, but which provides supersensitization, can also be contained in the emulsion.

The supersensitizer (e.g., pyrimidylamino compound, triazinylamino compound, azolium compound, aminostyryl compound, aromatic organic acid formaldehyde condensate, azaindene compound, cadmium salt) and the combination of a supersensitizer and a sensitizing dye, which are useful in the spectral sensitization of the present invention, are described, for example, in U.S. Pat. Nos. 3,511,664, 3,615,613, 3,615,632, 3,615,641, 4,596,767, 4,945,038, 4,965,182, 4,965,182, 2,933,390, 3,635,721, 3,743,510, 3,617,295 and 3,635,721. With respect to the use method thereof, the methods described in these patents are preferred.

The timing of adding the sensitizing dyes for use in the present invention (the same applies to other sensitizing dyes and supersensitizers) to the silver halide emulsion of the present invention may be at any stage heretofore recognized as useful in the preparation of the emulsion. The dye may be added at any time or in any step if it is before the coating of emulsion, for example, may be added before grain formation of silver halide grains or/and before desalting, or during desilvering and/or between after desalting and before initiation of chemical ripening, as disclosed in U.S. Pat. Nos. 2,735,766, 3,628,960, 4,183,756 and 4,225,666, JP-A-58-184142 and JP-A-60-196749, or may be added immediately before or during chemical ripening, or between after chemical ripening and before coating as disclosed in JP-A-58-113920. Also, as disclosed in U.S. Pat. No. 4,225,666 and JP-A-58-7629, a compound by itself or in combination with another compound having a foreign structure may be added in parts, for example, during the grain formation and during the chemical ripening or after the completion of chemical ripening, or before or during the chemical ripening and after the completion of chemical ripening. The kind of the compound added in parts and the combination of compounds may also be varied.

The amount added of the sensitizing dye of the present invention (the same applies to other sensitizing dyes and supersensitizers) varies depending on the shape and size of silver halide grains and may be any amount, however, the sensitizing dye is preferably used in an amount of $1\times10^{-8}$ to $8\times10^{-1}$ mol per mol of silver halide. For example, when the silver halide grain size is 0.2 to 1.3 $\mu$m, the amount added is preferably from $2\times10^{-6}$ to $3.5\times10^{-3}$ mol, more preferably from $7.5\times10^{-6}$ to $1.5\times10^{-3}$ mol, per mol of silver halide.

The sensitizing dye of the present invention (the same applies to other sensitizing dyes and supersensitizers) can be dispersed directly in an emulsion. The dye may also be dissolved in an appropriate solvent such as methyl alcohol, ethyl alcohol, methyl cellosolve, acetone, water, pyridine or a mixed solvent thereof and then added in the form of a solution to an emulsion. At this time, additives such as base, acid and surfactant may also be allowed to be present together. Furthermore, an ultrasonic wave may also be used for the dissolution. With respect to the method for adding the compound, the following methods may be used: a method described in U.S. Pat. No. 3,469,987 where the compound is dissolved in a volatile organic solvent, the solution is dispersed in hydrophilic colloid and this dispersion is added to the emulsion; a method described in JP-B-46-24185 where the compound is dispersed in a water-soluble solvent and this dispersion is added to the emulsion; a method described in U.S. Pat. No. 3,822,135 where the compound is dissolved in a surfactant and the solution is added to the emulsion; a method described in JP-A-51-74624 where the compound is dissolved using a compound capable of red-shifting and the solution is added to the emulsion; and a method described in JP-A-50-80826 where the compound is dissolved in an acid substantially free of water and the solution is added to the emulsion. In addition, for the addition to the emulsion, the methods described in U.S. Pat. Nos. 2,912,343, 3,342,605, 2,996,287 and 3,429,835 can be used.

In the present invention, for the photographic emulsion undertaking the photosensitive mechanism, any of silver bromide, silver iodobromide, silver chlorobromide, silver iodide, silver iodochloride, silver iodobromo-chloride and silver chloride may be used. However, the halogen composition on the outermost surface of emulsion preferably has an iodide content of 0.1 mol % or more, more preferably 1 mol % or more, still more preferably 5 mol % or more, whereby the multi-layer adsorption structure can be more firmly constructed.

The grain size distribution may be either broad or narrow but narrow distribution is preferred.

The silver halide grain of the photographic emulsion may be a grain having a regular crystal form such as cubic, octahedral, tetradecahedral or rhombic dodecahedral form, a grain having an irregular crystal form such as spherical or tabular form, a grain having an hkl plane, or a mixture of grains having these crystal forms, however, a tabular grain is preferred. The tabular grain is described in detail later. The grain having a high-order face is described in *Journal of Imaging Science*, Vol. 30, pp. 247–254 (1986).

The silver halide photographic emulsion for use in the present invention may contain the above-described silver halide grains individually or may contain a plurality of grains by mixture. The silver halide grain may have different phases between the interior and the surface layer, may have a multi-phase structure, for example, with a junction structure, may have a localized phase on the grain phase or may have a uniform phase throughout the grain. These grains may also be present together.

These various emulsions each may be either a surface latent image-type emulsion in which a latent image is mainly formed on the surface, or an internal latent image-type emulsion in which a latent image is formed inside the grain.

In the present invention, a silver halide tabular grain having a halogen composition of silver chloride, silver bromide, silver chlorobromide, silver iodobromide, silver chloroiodobromide or silver iodochloride is preferably used. The tabular grain preferably has a main surface of (100) or (111). The tabular grain having a (111) main surface is hereinafter referred to as a (111) tabular grain and this grain usually has a triangular or hexagonal face. In general, as the distribution is more uniform, the ratio of tabular grains having a hexagonal face is higher. JP-B-5-61205 describes the monodispersed hexagonal tabular grains.

The tabular grain having a (100) face as the main surface is hereinafter called a (100) tabular grain and this grain has a rectangular or square form. In the case of this emulsion, a grain having a ratio of adjacent sides of less than 5:1 is called a tabular grain rather than an acicular grain. In the case where the tabular grain is silver chloride or a grain having a high silver chloride content, the (100) tabular grain is higher in the stability of the main surface than that of the (111) tabular grain. Therefore, the (111) tabular grain must be subjected to stabilization of the (111) main surface, and the method therefor is described in JP-A-9-80660, JP-A-9-80656 and U.S. Pat. No. 5,298,388.

The (111) tabular grain comprising silver chloride or having a high silver chloride content for use in the present invention is disclosed in the following patents:

U.S. Pat. Nos. 4,414,306, 4,400,463, 4,713,323, 4,783,398, 4,962,491, 4,983,508, 4,804,621, 5,389,509, 5,217,858 and 5,460,934.

The high silver bromide (111) tabular grain for use in the present invention is described in the following patents:

U.S. Pat. Nos. 4,425,425, 4,425,426, 4,434,226, 4,439,520, 4,414,310, 4,433,048, 4,647,528, 5,665,012, 4,672,027, 4,678,745, 4,684,607, 4,593,964, 4,722,886, 4,755,617, 4,755,456, 4,806,461, 4,801,522, 4,835,322, 4,839,288, 4,914,014, 4,962,015, 4,977,074, 4,985,350, 5,061,609, 5,061,616, 5,068,173, 5,132,203, 5,272,048, 5,334,469, 5,334,495, 5,358,840 and 5,372,927.

The (100) tabular grain for use in the present invention is described in the following patents:

U.S. Pat. Nos. 4,386,156, 5,275,930, 5,292,632, 5,314,798, 5,320,938, 5,319,635 and 5,356,764, European Patents 569,971 and 737,887, JP-A-6-308648 and JP-A-9-5911.

The silver halide emulsion for use in the present invention is preferably a silver halide tabular grain having a higher ratio of surface area/volume and having adsorbed thereto a sensitizing dye disclosed in the present invention. The aspect ratio is 2 or more, preferably 5 or more, more preferably 8 or more. The upper limit is not particularly limited but is preferably less than 0.2 $\mu$m, more preferably less than 0.1 $\mu$m, still more preferably less than 0.07 $\mu$m.

The term "the aspect ratio is 2 or more" as used herein means that silver halide grains having an aspect ratio (equivalent-circle diameter/grain thickness of a silver halide grain) of 2 or more occupies 50% or more, preferably 70% or more, more preferably 85% or more, of the projected area of all silver halide grains in the emulsion.

In order to prepare thin tabular grains having such a high aspect ratio, the following technique is applied.

The tabular grains for use in the present invention are preferably uniform in the dislocation line amount distribution among grains. In the emulsion for use in the present invention, silver halide grains having 10 or more dislocation lines per one grain preferably occupy from 50 to 100% (by number), more preferably from 70 to 100%, still more preferably from 90 to 100%, of all grains. If the occupation is less than 50%, disadvantageous effect may result in the homogeneity among grains.

In the present invention, in determining the ratio of grains containing a dislocation line and the number of dislocation lines, it is preferred to directly observe the dislocation lines of at least 100 grains, more preferably 200 grains or more, more preferably 300 grains or more.

Gelatin is advantageous as a protective colloid used in the preparation of the emulsion of the present invention or as a binder for other hydrophilic colloid layers. However, other hydrophilic colloids may also be used.

Examples of other hydrophilic colloids which can be used include proteins such as gelatin derivatives, graft polymers of gelatin with other high molecular material, albumin and casein; cellulose derivatives such as hydroxyethyl cellulose, carboxymethyl cellulose and cellulose sulfates; sugar derivatives such as sodium alginate and starch derivatives; and various synthetic polymer materials such as homopolymers and copolymers, for example, polyvinyl alcohol, polyvinyl alcohol partial acetal, poly-N-vinylpyrrolidone, polyacrylic acid, polymethacrylic acid, polyacrylamide, polyvinylimidazole and polyvinylpyrazole.

Examples of the gelatin which can be used include lime-treated gelatin, acid-treated gelatin and enzyme-treated gelatin described in *Bull. Soc. Sci. Photo. Japan.*, No. 16, page 30 (1966). Furthermore, hydrolysates and enzymolysates of gelatin can also be used.

The emulsion for use in the present invention is preferably washed with water for desalting and dispersed in a newly prepared protective colloid dispersion. The temperature at the water washing can be selected according to the purpose but is preferably selected from the range of 5 to 50° C. The pH at the water washing may also be selected according to the purpose but is preferably selected from the range of 2 to 10, more preferably from 3 to 8. The pAg at the water washing may also be selected according to the purpose but is preferably selected from the range of 5 to 10. The method for performing water washing may be selected from a noodle washing method, a dialysis method using a semipermeable membrane, a centrifugal separation method, a coagulating precipitation method and an ion exchange method. In the case of coagulating precipitation, a method using a sulfate, a method using an organic solvent, a method using a water-soluble polymer or a method using a gelatin derivative may be used.

According to the purpose, a salt of metal ion is preferably allowed to be present at the time of preparing the emulsion for use in the present invention, for example, during grain formation, desalting or chemical sensitization before the coating. The metal ion salt is preferably added during the grain formation in the case of doping it into a grain and is preferably added after the grain formation but before the completion of chemical sensitization in the case of using the metal ion salt for the modification of the grain surface or as a chemical sensitizing agents. The metal ion salt may be doped throughout the grain or may be doped only into the core part or only into the shell part. Examples of the metal which can be used include Mg, Ca, Sr, Ba, Al, Sc, Y, La, Cr, Mn, Fe, Co, Ni, Cu, Zn, Ga, Ru, Rh, Pd, Re, Os, Ir, Pt, Au, Cd, Hg, Tl, In, Sn, Pb and Bi. This metal can be added when it is in the form of a salt capable of dissolving at the time of grain formation, such as ammonium salt, acetate, nitrate, sulfate, phosphate, hydroxide, six-coordinated complex salt or four-coordinated complex salt. Examples of the metal ion salt include $CdBr_2$, $CdCl_2$, $Cd(NO_3)_2$, $Pb(NO_3)_2$, $Pb(CH_3COO)_2$, $K_3[Fe(CN)_6]$, $(NH_4)_4[Fe(CN)_6]$, $K_3IrCl_6$, $(NH_4)_3RhCl_6$, $K_4Ru(CN)_6$. The ligand of the coordinated compound can be selected from halo, aquo, cyano, cyanate, thiocyanate, nitrosyl, thionitrosyl, oxo and carbonyl Only one of these metal compounds may be used but two or more thereof may also be used in combination.

The metal compound is preferably added after dissolving it in an appropriate organic solvent such as water, methanol or acetone. In order to stabilize the solution, a method of adding an aqueous solution of a hydrogen halide (e.g., HCl, HBr) or an alkali halide (e.g., KCl, NaCl, KBr, NaBr) may be used. If desired, an acid or an alkali may be added. The metal compound may be added to the reactor either before or during the grain formation. It is also possible to add the metal compound to an aqueous solution of a water-soluble silver salt (e.g., $AgNO_3$) or an alkali halide (e.g., NaCl, KBr, KI) and continuously add the solution during the formation of silver halide grains. Furthermore, the solution may be prepared independently of the water-soluble silver salt and the alkali halide and then continuously added in an appropriate timing during the grain formation. A combination use of various addition methods is also preferred.

The method of adding a chalcogen compound during the preparation of the emulsion as described in U.S. Pat. No. 3,772,031 is also useful in some cases. A cyanate, a thiocyanate, a selenocyanate, a carbonate, a phosphate or an acetate may also be allowed to be present in addition to S, Se and Te.

The silver halide grain of the present invention may be subjected to at least one of sulfur sensitization, selenium sensitization, gold sensitization, palladium sensitization, noble metal sensitization and reduction sensitization, at any step in the process of preparing the silver halide emulsion. A combination of two or more sensitization methods is preferably used. By varying the step of performing the chemical sensitization, various types of emulsions may be prepared. Examples thereof include a type where chemical sensitization specks are embedded inside the grain, a type where chemical sensitization specks are embedded in the shallow part from the grain surface, and a type where chemical sensitization specks are formed on the grain surface. In the emulsion for use in the present invention, the site of chemical sensitization speck can be selected according to the purpose, however, in general, at least one kind of chemical sensitization speck is preferably formed in the vicinity of the surface.

The chemical sensitization which can be preferably performed in the present invention is chalcogen sensitization, noble metal sensitization or a combination thereof. As described in T. H. James, *The Theory of the Photographic Process,* 4th ed. Macmillan, pp. 67–76 (1977), the chemical sensitization may be performed using active gelatin. Furthermore, as described in *Research Disclosure*, Vol. 120, 12008 (April, 1974), *Research Disclosure*, Vol. 34, 13452 (June, 1975), U.S. Pat. Nos. 2,642,361, 3,297,446, 3,772,031, 3,857,711, 3,901,714, 4,266,018 and 3,904,415 and British Patent 1,315,755, the chemical sensitization may be performed using sulfur, selenium, tellurium, gold, platinum, palladium, iridium or a combination of two or more of these sensitizing dyes at a pAg of 5 to 10, a pH of 5 to 8 and a temperature of 30 to 80° C. In the noble metal sensitization, a noble metal salt such as gold, platinum, palladium or iridium may be used and in particular, gold sensitization, palladium sensitization and a combination thereof are preferred. In the case of gold sensitization, a known compound such as chloroauric acid, potassium chloroaurate, potassium aurithiocyanate, gold sulfide or gold selenide may be used. The palladium compound means a palladium divalent or tetravalent salt. The preferred palladium compound is represented by $R_2PdX_6$ or $R_2PdX_4$, wherein R represents hydrogen atom, an alkali metal atom or an ammonium group and X represents a halogen atom such as chlorine, bromine or iodine.

More specifically, $K_2PdCl_4$, $(NH_4)_2PdCl_6$, $Na_2PdCl_4$, $(NH_4)_2PdCl_4$, $Li_2PdCl_4$, $Na_2PdCl_6$ and $K_2PdBr_4$ are preferred. The gold compound and the palladium compound each is preferably used in combination with a thiocyanate or a selenocyanate.

Examples of the sulfur sensitizer which can be used include hypo, thiourea-based compounds, rhodanine-based compounds and sulfur-containing compounds described in U.S. Pat. Nos. 3,857,711, 4,266,018 and 4,054,457. The chemical sensitization may also be performed in the presence of a so-called chemical sensitization aid. Useful chemical sensitization aids include compounds known to suppress fogging and at the same time elevate the sensitivity in the process of chemical sensitization, such as azaindene, azapyridazine and azapyrimidine. Examples of the chemical sensitization aid modifier are described in U.S. Pat. Nos. 2,131,038, 3,411,914 and 3,554,757, JP-A-58-126526 and Duffin, *Photographic Emulsion Chemistry*, supra, pp. 138–143.

In the case of the emulsion for use in the present invention, gold sensitization is preferably performed in combination. The amount of the gold sensitizer is preferably from $1\times10^{-7}$ to $1\times10^{-4}$ mol, more preferably from $5\times10^{-7}$ to $1\times10^{-5}$ mol, per mol of silver halide. The amount of the palladium compound is preferably from $5\times10^{-7}$ to $1\times10^{-3}$ mol per mol of silver halide. The amount of the thiocyanate compound or the selenocyanate compound is preferably from $1\times10^{-6}$ to $5\times10^{-2}$ mol per mol of silver halide.

The amount of the sulfur sensitizer used for the silver halide grain of the present invention is preferably from $1\times10^{-7}$ to $1\times10^{-4}$, more preferably from $5\times10^{-7}$ to $1\times10^{-5}$ mol, per mol of silver halide.

The preferred sensitization method for the emulsion of the present invention includes selenium sensitization. In the selenium sensitization, a known labile selenium compound is used and specific examples of the selenium compound which can be used include colloidal metal selenium, selenoureas (e.g., N,N-dimethylselenourea, N,N-diethylselenourea), selenoketones and selenoamides. In some cases, the selenium sensitization is preferably performed in combination with one or both of sulfur sensitization and noble metal sensitization.

The silver halide emulsion of the present invention is preferably subjected to reduction sensitization during the grain formation, before or during the chemical sensitization after the grain formation, or after the chemical sensitization.

For the reduction sensitization, a method of adding a reduction sensitizer to the silver halide emulsion, a method called silver ripening where the emulsion is grown or ripened in a low pAg atmosphere of 1 to 7, and a method called high pH ripening where the emulsion is grown or ripened in a high pH atmosphere of 8 to 11 may be used. Also, two or more of these methods may be used in combination.

The method of adding a reduction sensitizer is preferred because the reduction sensitization level can be subtly controlled.

Known examples of the reduction sensitizer include stannous chloride, ascorbic acid and its derivatives, amines and polyamines, hydrazine derivatives, formamidine-sulfinic acid, silane compounds and borane compounds. In the present invention, the reduction sensitization may be performed using a reduction sensitizer selected from these known reduction sensitizers, and two or more compounds may also be used in combination. Preferred examples of the compound as the reduction sensitizer include stannous chloride, thiourea dioxide, dimethylamineborane, and ascorbic acid and its derivatives. The amount of the reduction sensitizer added depends on the conditions in the production of emulsion and therefore, must be selected but is suitably from $10^{-7}$ to $10^{-3}$ mol per mol of silver halide.

The reduction sensitizer is added during the grain growth after dissolving it in water or an organic solvent such as alcohols, glycols, ketones, esters, and amides. The reduction sensitizer may be previously added to the reactor but is preferably added in an appropriate timing during the grain growth. It is also possible to previously add the reduction sensitizers to an aqueous solution of a water-soluble silver salt or a water-soluble alkali halide and precipitate silver halide grains using this aqueous solution. In another preferred method, with the growing of grains, a solution of the reduction sensitizer is added in several parts or continuously over a long time period.

In the process of producing the emulsion for use in the present invention, an oxidizing agent for silver is preferably used. The oxidizing agent for silver means a compound having a function of acting on metal silver and converting it into silver ion. In particular, a compound which converts very fine silver grains generated as a by-product in the process of formation and chemical sensitization of silver halide grains, into silver ion is effective. The silver ion generated here may form a sparingly water-soluble silver salt such as silver halide, silver sulfide or silver selenide or may form an easily water-soluble silver salt such as silver nitrate. The oxidizing agent for silver may be either an inorganic material or an organic material. Examples of the inorganic oxidizing agent include ozone, hydrogen peroxide and its adducts (e.g., $NaBO_2.H_2O_2.3H_2O$, $2NaCO_3.3H_2O_2$, $Na_4P_2O_7.2H_2O_2$, $2Na_2SO_4.H_2O_2.2H_2O$), peroxy acid salts (e.g., $K_2S_2O_8$, $K_2C_2O_6$, $K_2P_2O_8$), peroxy complex compounds (e.g., $K_2[Ti(O_2)C_2O_4].3H_2O$, $4K_2SO_4.Ti(O_2)OH.SO_4.2H_2O$, $Na_3[VO(O_2)(C_2H_4)_2].6H_2O$), permanganates (e.g., $KMnO_4$), oxyacid salts such as chromate (e.g., $K_2Cr_2O_7$), halogen elements such as iodine and bromine, perhalogenates (e.g., potassium periodate), high-valence metal salts (e.g., potassium hexacyanoferrate) and thiosulfonates.

Examples of the organic oxidizing agent include quinones such as p-quinone, organic peroxides such as peracetic acid and per benzoic acid, and compounds capable of releasing an active halogen (for example, N-bromosuccinimide, chloramine T and chloramine B).

The oxidizing agent for use in the present invention is preferably an inorganic oxidizing agent such as ozone, a hydrogen peroxide or an adduct thereof, a halogen element or a thiosulfonate, or an organic oxidizing agent such as quinones. In a preferred embodiment, the above-described reduction sensitization and the oxidizing agent for silver are used in combination. In this case, a method of using the oxidizing agent and then applying the reduction sensitization, a method reversed thereto, or a method of allowing the reduction sensitization and the oxidizing agent to be present together at the same time may be used. These methods each can be used either during the grain formation or during the chemical sensitization.

The photographic emulsion for use in the present invention may contain various compounds for the purpose of preventing fogging during the production, storage or photographic processing of a light-sensitive material, or for stabilizing the photographic performance. Examples of compound which can be added include a large number of compounds known as an antifoggant or a stabilizer, that is, thiazoles such as benzothiazolium salt, nitroimidazoles, nitrobenzimidazoles, chlorobenzimidazoles, bromobenzimidazoles, mercaptothiazoles, mercaptobenzothiazoles, mecaptobenzimidazoles, mercaptothiadiazoles, aminotriazoles, benzotriazoles, nitrobenzotriazoles and mercaptotetrazoles (particularly 1-phenyl-5-mercaptotetrazole); mercaptopyrimidines; mercaptotriazines; thioketo compounds such as oxazolinethione; azaindenes such as triazaindenes, tetrazaindenes (particularly 4-hydroxy-substituted (1,3,3a,7) tetrazaindenes) and pentazaindenes. For example, compounds described in U.S. Pat. Nos. 3,954,474 and 3,982,947 and JP-B-52-28660 can be used. One preferred compound is the compound described in JP-A-63-212932. The antifoggant and the stabilizer can be added according to the purpose in various timings such as before grain formation, during grain formation, after grain formation, during water washing, during dispersion after the washing, before chemical sensitization, during chemical sensitization, after chemical sensitization, and before coating. These compounds can be used not only to exert the original effect of preventing fogging and stabilizing the photographic performance but also for other various purposes, for example, control of crystal habit of grain, reduction in the grain size, decrease in the solubility of grain, control of chemical sensitization and control of arrangement of dyes.

The silver halide material prepared according to the present invention can be used for either a color photographic light-sensitive material or a black-and-white photographic light-sensitive material. Examples of the color photographic light-sensitive material include color printing paper, film for color photographing, color reversal film and color diffusion transfer film, and examples of the black-and-white photographic light-sensitive material include film for general photographing, X-ray film, film for medical diagnosis, film for printing light-sensitive material and diffusion transfer film.

In the field of film for medical diagnosis and film for printing light-sensitive material, the exposure can be efficiently performed using a laser image setter or a laser imager.

The technique in this field is described in JP-A-7-287337, JP-A-4-335342, JP-A-5-313289, JP-A-8-122954 and JP-A-8-292512.

Also, the present invention may be used for a photothermographic material. For example, a material having a light-sensitive layer comprising a binder matrix having dispersed therein a catalytic amount of photocatalyst (e.g., silver halide), a reducing agent, a reducible silver salt (e.g., organic silver salt) and if desired, a color toning agent for controlling the color tone of silver, is known. Examples thereof include those described in U.S. Pat. Nos. 3,152,904, 3,457,075, 2,910,377 and 4,500,626, JP-B-43-4924, JP-A-11-24200, JP-A-11-24201, JP-A-11-30832, JP-A-11-84574, JP-A-11-65021, JP-A-11-109547, JP-A-11-125880, JP-A-11-129629, JP-A-11-133536 to JP-A-11-133539, JP-A-11-133542, JP-A-11-133543, JP-A-11-223898, JP-A-11-352627, JP-A-6-130607, JP-A-6-332134, JP-A-6-332136, JP-A-6-347970, JP-A-7-261354 and Japanese Patent Application No. 2000-89436.

The compound of the present invention may also be preferably used for a diffusion transfer light-sensitive material. In this regard, the heat-developable diffusion transfer method is described in JP-A-98562/2000 (using a preformed dye) and Japanese Patent Application Nos. 2000-89436 (using a coupling-formation dye), and the instant photographic material system is described in JP-A-284442/2000.

With respect to the preparation method of the photographic emulsion for use in the present invention, JP-A-10-239789, column 63, line 36 to column 65, line 2, may be applied.

Furthermore, with respect to the additives such as color coupler, additives to the photographic light-sensitive material, the kind of light-sensitive material to which the present invention can be applied, and the processing of the light-sensitive material, JP-A-10-239789, column 65, line 3 to column 73, line 13 may be applied.

These various additives are used in the silver halide photographic light-sensitive material of the present invention and other than those, various additives may also be used according to the purpose.

These additives are described in more detail in *Research Disclosure*, Item 17643 (December, 1978), ibid., Item 18716 (November, 1979), and ibid., Item 308119 (December, 1989). The pertinent portions are summarized in the table below.

| | Kinds of Additives | RD17643 | RD18716 | RD308119 |
|---|---|---|---|---|
| 1. | Chemical sensitizer | page 23 | page 648, right column | page 996 |
| 2. | Sensitivity increasing agent | | page 648, right column | |
| 3. | Spectral sensitizer, supersensitizer | pages 23 to 24 | page 648, right column to page 649, right column | page 996, right column to page 998, right column |
| 4. | Brightening agent | page 24 | | page 998, right column |
| 5. | Antifoggant, stabilizer | pages 24 to 25 | page 649, right column | page 998, right column to page 1000, right column |
| 6. | Light absorbent, filter dye, UV absorbent | pages 25 to 26 | page 649, right column to page 650, left column | page 1003, left column to page 1003, right column |
| 7. | Stain inhibitor | page 25, right column | page 650, left to right columns | page 1002, right column |
| 8. | Dye Image Stabilizer | page 25 | | page 1002, right column |
| 9. | Hardening agent | page 26 | page 651, left column | page 1004, right column to page 1005, left column |
| 10. | Binder | page 26 | page 651, left column | page 1003, right column to page 1004, right column |
| 11. | Plasticizer, lubricant | page 27 | page 650, right column | page 1006, left column to page 1006, right column |
| 12. | Coating aid, surfactant | Pages 26 to 27 | page 650, right column | page 1005, left column to page 1006, left column |
| 13. | Antistatic agent | page 27 | page 650, right column | page 1006, right column to page 1007, left column |
| 14. | Matting agent | | | page 1008, left column to page 1009, left column |

The technique such as layer arrangement, the silver halide emulsion, the dye forming coupler, the functional coupler such as DIR coupler, various additives and the development processing, which can be used in the emulsion for use in the present invention and in the photographic light-sensitive material using the emulsion, are described in EP 0565096A1 (published on Oct. 13, 1993) and patents cited therein. Respective items and corresponding portions therefor are listed below.

| | | |
|---|---|---|
| 1. | Layer construction: | page 61, lines 23 to 35, page 61, line 41 to page 62 line 14 |
| 2. | Interlayer: | page 61, lines 36 to 40 |

-continued

| | | |
|---|---|---|
| 3. | Interlayer effect imparting layer: | page 62, lines 15 to 18 |
| 4. | Silver halide halogen composition: | page 62, lines 21 to 25 |
| 5. | Silver halide grain crystal habit: | page 62, lines 26 to 30 |
| 6. | Silver halide grain size: | page 62, lines 31 to 34 |
| 7. | Emulsion production method: | page 62, lines 35 to 40 |
| 8. | Silver halide grain size distribution: | page 62, lines 41 to 42 |
| 9. | Tabular grain: | page 62, lines 43 to 46 |
| 10. | Internal structure of grain: | page 62, lines 47 to 53 |
| 11. | Latent image forming type of emulsion: | page 62, line 54 to page 63, to line 5 |
| 12. | Physical ripening and chemical ripening of emulsion: | page 63, lines 6 to 9 |
| 13. | Use of mixed emulsion: | page 63, lines 10 to 13 |
| 14. | Fogged emulsion: | page 63, lines 14 to 31 |
| 15. | Light-insensitive emulsion: | page 63, lines 32 to 43 |
| 16. | Coated silver amount: | page 63, lines 49 to 50 |
| 17. | Formaldehyde scavenger: | page 64, lines 54 to 57 |
| 18. | Mercapto-based antifoggant: | page 65, lines 1 to 2 |
| 19. | Agent for releasing fogging agent, etc.: | page 65, lines 3 to 7 |
| 20. | Dyes: | page 65, lines 7 to 10 |
| 21. | Color coupler in general: | page 65, lines 11 to 13 |
| 22. | Yellow, magenta and cyan couplers: | page 65, lines 14 to 25 |
| 23. | Polymer coupler: | page 65, lines 26 to 28 |
| 24. | Diffusible dye forming coupler: | page 65, lines 29 to 31 |
| 25. | Colored coupler: | page 65, lines 32 to 38 |
| 26. | Functional coupler in general: | page 65, lines 39 to 44 |
| 27. | Bleaching accelerator-releasing coupler: | page 65, lines 45 to 48 |
| 28. | Development accelerator-releasing coupler: | page 65, lines 49 to 53 |
| 29. | Other DIR couplers: | page 65, line 54 to page 66, to line 4, |
| 30. | Coupler dispersion method: | page 66, lines 5 to 28 |
| 32. | Antiseptic and antifungal: | page 66, lines 29 to 33 |
| 32. | Kind of light-sensitive material: | page 66, lines 34 to 36 |
| 33. | Thickness and swelling rate of light-sensitive layer: | page 66, line 40 to page 67, line 1 |
| 34. | Back layer: | page 67, lines 3 to 8 |
| 35. | Development processing in general: | page 67, lines 9 to 11 |
| 36. | Developer and developing agent: | page 67, lines 12 to 30 |
| 37. | Additive for developer: | page 67, lines 31 to 44 |
| 38. | Reversal processing: | page 67, lines 45 to 56 |
| 39. | Opening ratio of processing solution: | page 67, line 57 to page 68, line 12 |
| 40. | Development time: | page 68, lines 13 to 15 |
| 41. | Bleach-fixing, bleaching and fixing: | page 68, line 16 to page 69, line 31 |
| 42. | Automatic developing machine: | page 69, lines 32 to 40 |
| 43. | Water washing, rinsing and stabilization: | page 69, line 41 to page 70, line 18 |
| 44. | Replenishment and re-use of processing solution: | page 70, lines 19 to 23 |
| 45. | Sensitive material self-containing developing agent: | page 70, lines 24 to 33 |
| 46. | Development processing temperature: | page 70, lines 34 to 38 and |
| 47. | Use for film with lens: | page 70, lines 39 to 41 |

The method for exposing the silver halide photographic light-sensitive material of the present invention is described below.

Exposure of the light-sensitive material to obtain a photographic image may be performed by a normal method. More specifically, a variety of known light sources can be used, such as natural light (sunlight), tungsten lamp, fluorescent light mercury vapor lamp, xenon arc lamp, carbon arc lamp, xenon flash lamp, laser, LED and CRT. Also, the light-sensitive photographic material may be exposed using light emitted from a phosphor excited by an electron beam, an X ray, a $\gamma$ (gamma) ray or an $\alpha$ (alpha) ray.

In the present invention, a laser light source is sometimes preferably used. Examples of the laser ray include those using a helium-neon gas, an argon gas, a krypton gas or a carbon dioxide gas as the laser oscillation medium, those using a solid such as ruby or cadmium as the oscillation medium, a liquid laser and a semiconductor laser. Unlike light usually used for illumination and the like, these laser rays are coherent light having sharp directivity with uniform phase and single frequency and therefore, the silver halide photographic light-sensitive material exposed using the laser ray as a light source must have spectral properties coincided with the oscillation wavelength of the laser used.

Among the above-described lasers, use of a semiconductor laser is preferred.

The compound of the present invention can be used not only as a sensitizing dye but also as a filter dye, an irradiation inhibiting dye or an antihalation dye for the purpose of improving the sharpness and color resolution.

The compound can be incorporated into a coating solution for a silver halide photographic light-sensitive layer, a filter layer and/or an antihalation layer by a method commonly used. The amount of the dye used may be sufficient if it is large enough to color the photographic material, and one skilled in the art can easily select the appropriate amount according to the used end. In general, the compound is preferably added to give an optical density of 0.05 to 3.0. The timing of adding the compound may be any step before the coating.

Also, a polymer having a charge opposite the dye ion may be used as a mordant and allowed to be present together in a layer so as to interact with the dye molecule and thereby localize the dye in a specific layer.

Examples of the polymer mordant include those described in U.S. Pat. Nos. 2,548,564, 4,124,386, 3,625,694, 3,958, 995, 4,168,976 and 3,445,231.

The compound of the present invention can be added to a desired layer in addition to the light-sensitive emulsion layer, such as interlayer, protective layer and back layer.

The compound of the present invention can be used as a photosensitizer (photo-charge separating agent) in various non-silver salt system photo-image forming methods or may be used for photocatalyst, photo-hydrogen generating agent or the like.

In the present invention, the light absorption intensity is an integrated intensity of light absorption (area) by a sensitizing dye per unit grain surface area and is defined as a value obtained, assuming that the quantity of light subjected to incidence into the unit surface area of a grain is $I_0$ and the quantity of light absorbed by a sensitizing dye on the surface is I, by integrating the optical density $\mathrm{Log}(I_0/(I_0-I))$ to the wave number ($cm^{-1}$). The integration range is from 5,000 $cm^{-1}$ to 35,000 $cm^{-1}$.

The silver halide photographic emulsion according to the present invention preferably contains silver halide grains having a light absorption intensity of 100 or more in the case of a grain having a spectral absorption maximum wavelength of 500 nm or more, or silver halide grains having a light absorption intensity of 60 or more in the case of a grain having a spectral absorption maximum wavelength of less than 500 nm, in a proportion of a half (½) or more of the entire projected area of all silver halide grains. In the case of a grain having a spectral absorption maximum wavelength of 500 nm or more, the light absorption intensity is preferably 150 or more, more preferably 170 or more, still more preferably 200 or more. In the case of a grain having a spectral absorption maximum wavelength of less than 500 nm, the light absorption intensity is preferably 90 or more, more preferably 100 or more, still more preferably 120 or more. The upper limit is not particularly limited but it is preferably 2,000 or less, more preferably 1,000 or less, still more preferably 500 or less.

The spectral absorption maximum wavelength of a grain having a spectral absorption maximum wavelength of less than 500 nm is preferably 350 nm or more.

One example of the method for measuring the light absorption intensity is a method using a microspectrophotometer. The microspectrophotometer is a device capable of measuring an absorption spectrum of a microscopic area and can measure the transmission spectrum of one grain. The measurement of absorption spectrum of one grain by the microspectrometry is described in the report by Yamashita et al. (*Nippon Shashin Gakkai,* 1996 *Nendo Nenji Taikai Ko'en Yoshi Shu* (*Lecture Summary at Annual Meeting of Japan Photographic Association in* 1996), page 15). From this absorption spectrum, an absorption intensity per one grain can be obtained, however, the light transmitting the grain is absorbed on two surfaces of upper surface and lower surface and therefore, the absorption intensity per unit are on the grain surface can be obtained as a half (½) of the absorption intensity per one grain determined by the above-described method. At this time, the segment used for the integration of absorption spectrum is in the definition from 5,000 to 35,000 $cm^{-1}$, however, in experiment, the segment for the integration may contain the region of 500 $cm^{-1}$ shorter or longer than the segment having absorption by the sensitizing dye.

The light absorption intensity is a value indiscriminately determined by the oscillator strength of sensitizing dye and the number of adsorbed molecules per unit area and therefore, when the oscillator strength of sensitizing dye, the amount of dye adsorbed and the surface area of grain are determined, the light absorption intensity can be calculated therefrom.

The oscillator strength of sensitizing dye can be experimentally obtained as a value in proportion to the absorption integrated intensity (optical density×$cm^{-1}$) of a sensitizing dye solution. Therefore, assuming that the absorption integrated intensity of a dye per 1 M is A (optical density×$cm^{-1}$), the amount of sensitizing dye adsorbed is B (mol/mol-Ag) and the surface area of grain is C ($m^2$/mol-Ag), the light absorption intensity can be obtained according to the following formula within an error range of about 10%:

$$0.156 \times A \times B/C$$

The light absorption intensity calculated from this formula is substantially the same as the light absorption intensity measured based on the above-described definition (a value obtained by the integration of $\mathrm{Log}(I_0/(I_0-I))$ to the wave number ($cm^{-1}$)).

For increasing the light absorption intensity, a method of adsorbing a dye chromophore in one or more layers onto the grain surface, a method of increasing the molecular extinction coefficient of dye and a method of reducing the dye occupation area may be used. Any of these methods may be used but preferred is the method of adsorbing a dye chromophore in one or more layers onto the grain surface.

Here, the state where a dye chromophore is adsorbed in one or more layers onto the grain surface means that the dye bounded to the vicinity of a silver halide grain is present in one or more layers. Dyes present in the dispersion medium is not included in this dye. Incidentally, the term "in one or more layers" as used herein includes the case where as in the present invention, a dye chromophore is connected to a compound adsorbed to the grain surface, such as dye, through a covalent bond. In this case, spectral sensitization must be generated by a dye not directly adsorbed to the grain surface and for this purpose, an excitation energy must be transmitted from the dye not directly adsorbed to silver halide to the dye directly adsorbed to a grain. In this meaning, the excitation energy transmission required to pass through more than 10 stages is not preferred because the transmission efficiency of final excitation energy decreases. One example of such a case is a polymer dye described in JP-A-2-113239 where a majority of dye chromophores are present in a dispersion medium and the excitation energy must be transmitted through more than 10 stages.

The dye chromophore adsorbed to a silver halide grain is preferably in 1.5 or more layers, more preferably in 1.7 or more layers, still more preferably in 2 or more layers.

In the present invention, the state where a chromophore is adsorbed in one or more layers onto the surface of a silver halide grain means that when saturation adsorption achieved, out of sensitizing dyes added to an emulsion, by a dye having a smallest dye occupation area on the surface of a silver halide grain is defined as a single layer saturation coverage, the adsorption amount of a dye chromophore per unit layer is large based on this single layer saturation coverage. The adsorption layer number means an adsorption amount based on the single layer saturation coverage. In the case of a dye where dye chromophores are connected through a covalent bond, the adsorption layer number may be based on the dye occupation area of individual dyes in the state of not being connected.

The dye occupation area may be obtained from an adsorption isotherm showing the relationship between the free dye concentration and the dye adsorption amount, and the grain surface area. The adsorption isotherm may be obtained by referring, for example, to A. Herz et al., *Adsorption from Aqueous Solution, Advances in chemistry Series*), No. 17, page 173 (1968).

For determining the amount of a sensitizing dye adsorbed to an emulsion layer, two methods may be used, namely, one is a method of centrifuging an emulsion having adsorbed thereto a dye to separate emulsion grains from the supernatant aqueous gelatin solution, measuring the spectral absorption of the supernatant to obtain a non-adsorbed dye concentration, subtracting the concentration from the amount of dye added and thereby determining the dye adsorption amount, and another is a method of drying precipitated emulsion grains, dissolving a predetermined weight of the precipitate in a 1:1 mixed solution of aqueous sodium thiosulfate solution and methanol, measuring the spectral absorption and thereby determining the dye adsorption amount. In the case of using a plurality of dyes, the adsorption amount of individual dyes may also be obtained using means such as high-performance liquid chromatography.

The dye occupation area can be experimentally determined, however, the molecular occupation areas of sensitizing dyes usually used are mostly present in the vicinity of 80 $Å^2$ and therefore, the adsorption layer number may also be roughly estimated by simply considering that all dyes have a dye occupation area of 80 $Å^2$.

In the silver halide photographic emulsion containing the compound of the present invention as a sensitizing dye, the distance between the shortest wavelength showing 50% of a maximum value Amax of the spectral absorption factor by a sensitizing dye and showing 50% of a maximum value Smax of the spectral sensitivity and the longest wavelength showing 50% of Amax and 50% of Smax is preferably 120 nm or less, more preferably 100 nm or less.

The distance between the shortest wavelength showing 80% of Amax and 80% of Smax and the longest wavelength showing 80% of Amax and 80% of Smax is 20 nm or more and is preferably 100 nm or less, more preferably 80 nm or less, still more preferably 50 nm or less.

The distance between the shortest wavelength showing 20% of Amax and 20% of Smax and the longest wavelength showing 20% of Amax and 20% of Smax is preferably 180 nm or less, more preferably 150 nm or less, still more preferably 120 nm or less, and most preferably 100 nm or less.

The longest wavelength showing 50% of Amax and 50% of Smax is preferably from 460 to 510 nm, from 560 nm to 610 nm, or from 640 to 730 nm.

In the present invention, when a dye chromophore is adsorbed in multiple layers onto a silver halide grain, the dye chromophore directly adsorbing to the silver halide grain, namely, dye chromophore in the first layer, and the dye chromophores in the second and subsequent layers may have any reduction potential and any oxidation potential, however, from the standpoint of accelerating the electron transfer from the dye in the second or subsequent layer to the dye in the first layer and preventing the reverse electron transfer, the reduction potential of the dye chromophore in the first layer is preferably more positive than the value obtained by subtracting 0.2 V from the reduction potential of the dye chromophore in the second or subsequent layer. Also, the reduction potential of the dye chromophore in the first layer is more preferably more positive then that of the dye chromophore in the second or subsequent layer.

The reduction potential and the oxidation potential may be measured by various methods, however, these are preferably measured by phase discrimination-type second harmonic a.c. polarography for determining so that exact values can be obtained. The method for determining the potential by phase discrimination-type second harmonic a.c. polarography is described in *Journal of Imaging Science,* Vol. 30, page 27 (1986).

The dye chromophore in the second or subsequent layer is preferably a light-emitting dye. The light-emitting dye preferably has a skeleton structure of dyes used for dye laser. These are described, for example, in Mitsuo Maeda, *Laser Kenkyu* (*Study of Laser*), Vol. 8, page 694, page 803 and page 958 (1980), ibid., Vol. 9, page 85 (1981), and F. Shaefer, *Dye Lasers*, Springer (1973).

In view of the energy transfer efficiency from the dye in the second or subsequent layer to the dye in the first layer, the absorption maximum wavelength of the dye chromophore in the first layer in a silver halide photographic light-sensitive material is preferably longer than the absorption maximum wavelength of the dye chromophore in the second or subsequent layer, and also the light emission of the dye chromophore in the second or subsequent layer preferably overlaps the absorption of the dye chromophore in the first layer. In addition, the dye chromophore in the first layer preferably forms J-association. In order to have absorption and spectral sensitivity in a desired wavelength range, the dye chromophores in the second or subsequent layer also preferably form a J-association product.

In the energy transfer of the excitation energy of the second layer dye to the first layer dye, the energy transfer efficiency is preferably 30% or more, more preferably 60% or more, still more preferably 90% or more. The term "excitation energy of the second layer dye" as used herein means an energy of an excited dye generated by resulting from the second layer dye absorbing light energy. In the case where an excitation energy of a certain molecule transfers to another molecule, the excitation energy is considered to transfer through an excitation electron transfer mechanism, a Forster type energy transfer mechanism (Forster Model), a Dextor energy transfer mechanism (Dextor Model) or the like. Accordingly, the multilayer adsorption system of the present invention preferably satisfies the conditions for causing an efficient excitation energy transfer available by these mechanisms, more preferably the conditions for causing a Forster type energy transfer.

The efficiency in the energy transfer from the second layer dye to the first layer dye can be obtained as spectral sensitization efficiency at excitation of second layer dye/spectral sensitization efficiency at excitation of first layer dye.

The meanings of the terms used in the present invention are described below.

Dye Occupation Area:

An occupation area per one molecule of dye. This can be experimentally determined from the adsorption isotherm. In the case of a dye where dye chromophores are connected through a covalent bond, the area is determined based on the dye occupation area of individual dyes not connected. Simply, 80 $Å^2$.

Single Layer Saturation Coverage:

A dye adsorption amount per unit grain surface area at the time of single layer saturation covering. A reciprocal of the minimum dye occupation area out of dyes added.

Multilayer Adsorption:

A state where the adsorption amount of dye chromophore per unit grain surface area is larger than the single layer saturation coverage. In the present invention, since the multilayer adsorption means the state where the adsorption amount of dye chromophore per unit grain surface area is larger than the single layer saturation coverage, the one-layer adsorption of a dye in which two dye chromophores are connected through a covalent bond, means that the dye is adsorbed in two layers.

Adsorption Layer Number:

An adsorption amount of dye chromophore per unit grain surface area based on the single layer saturation coverage. In the case of a compound where two dye chromophores are connected through a covalent bond, the adsorption layer number is defined as adsorption amount×2. For example, when a dye containing two dye chromophores connected through a covalent bond is supposed to have the same dye occupation area and the same adsorption amount as those of a certain non-connected model dye, the adsorption layer number is 2.

The present invention is described in greater detail below by referring to the Examples, however, the present invention should not be construed as being limited thereto.

EXAMPLE 1

Synthesis Example of Compound D-21 of the Present Invention

Synthesis of D-21

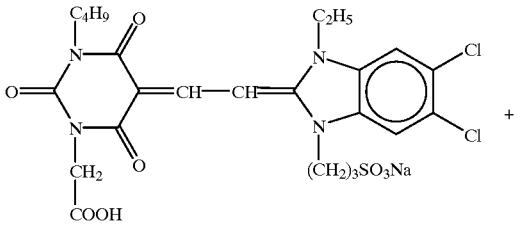

[1]

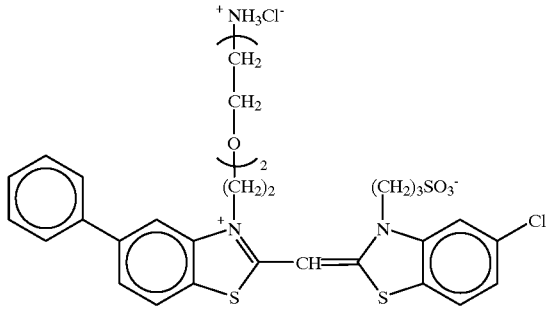

[2]

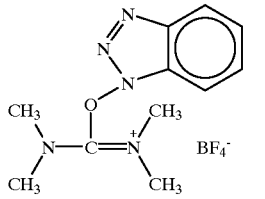

[3]

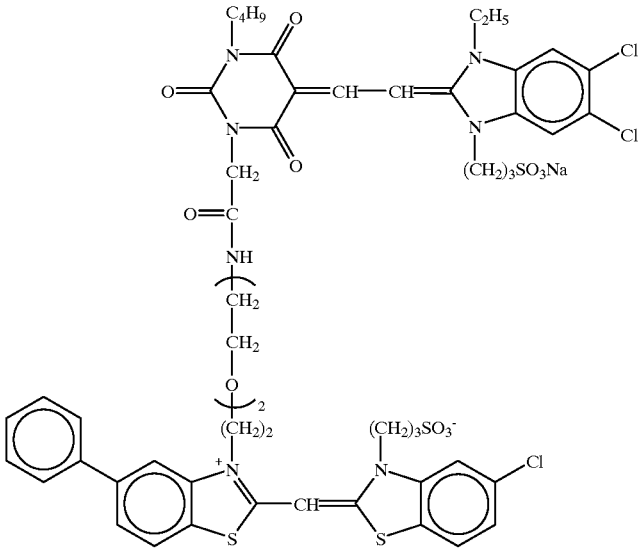

D-21

In 30 ml of dimethylsulfoxide, 0.54 g (0.8 mmol) of Cyanine Dye [1], 0.50 g (0.8 mmol) of Merocyanine Dye [2], in which dyes were synthesized by referring to the method of European Patent Publication 887700A, and 0.12 g (0.88 mmol) of 1-hydroxybenzotriazole were dissolved and stirred at 60° C. for 10 minutes.

Thereto, 0.30 g (0.96 mmol) of Uronium Salt [3] and 0.37 g (2.9 mmol) of diisopropylethylamine were added and stirred at 60° C. for 3 hours. After cooling, 300 ml of acetone was added and the precipitated crystals were separated by filtration. The crystals were dissolved in methanol, then 0.065 g (0.8 mmol) of sodium acetate was added, further isopropyl alcohol was added, and the generated crystals were separated by filtration, washed with isopropyl alcohol and vacuum dried to obtain 0.52 g of the objective D-21 as yellow crystals (yield: 52%).

The structure thereof was confirmed by NMR spectrum, MS spectrum and elemental analysis.

Synthesis Example of Compound D-1011 of the Present Invention

Synthesis of D-101

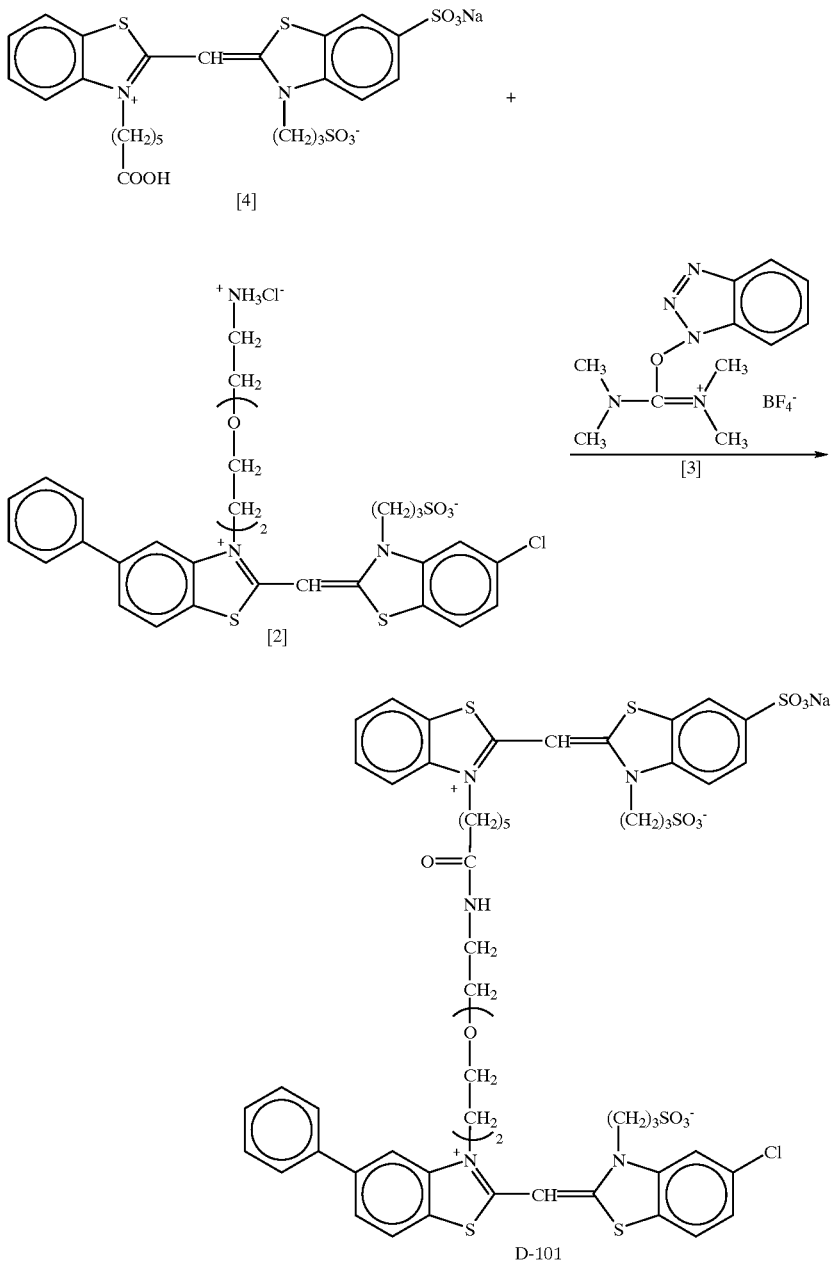

According to the reaction scheme shown above, Compound D-101 of the present invention was synthesized. More specifically, in 30 ml of dimethylsulfoxide, 0.62 g (1 mmol) of Compound [4], 0.68 g (1 mmol) of Compound [2], in which compounds were synthesized by referring to the method described in a publication, and 0.15 g (1.1 mmol) of 1-hydroxybenzotriazole were dissolved and stirred at 60° C. for 10 minutes. Thereto, 0.39 g (1.2 mmol) of Uronium Salt [3] and 0.47 g (3.6 mmol) of diisopropylethylamine were added and stirred at 60° C. for 3 hours.

After cooling, 300 ml of acetone was added and the precipitated crystals were separated by filtration. The crystals were dissolved in 20 ml of methanol, then 0.1 g of sodium acetate was added, further isopropyl alcohol was added, and the precipitated crystals were separated by filtration, washed with isopropyl alcohol and vacuum dried to obtain 0.75 g of the object D-101 as yellow crystals (yield: 60%).

The structure thereof was confirmed by NMR spectrum, MS spectrum and elemental analysis.

Synthesis Example of Compound D-201 of the Present Invention

Synthesis of D-201

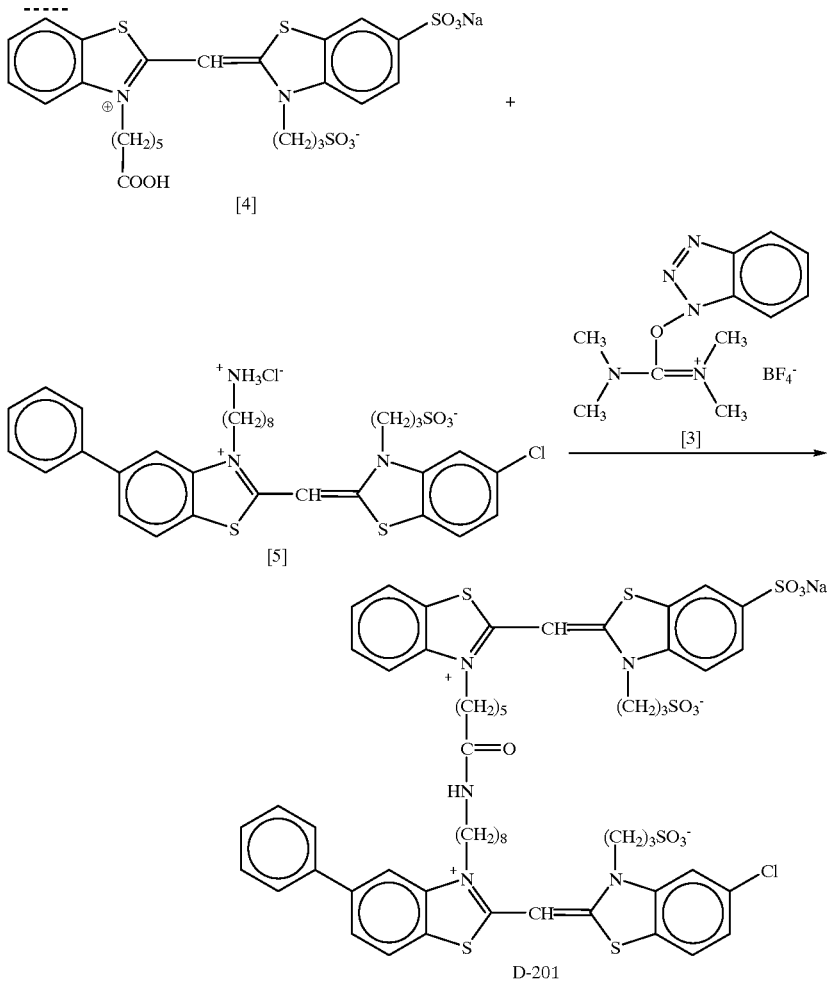

In 30 ml of dimethylsulfoxide, 0.62 g (1 mmol) of Compound [4], 0.68 g (1 mmol) of Compound [5], which compounds were synthesized by referring to the method described in a publication, and 0.15 g (1.1 mmol) of 1-hydroxybenzotriazole were dissolved and stirred at 60° C. for 10 minutes.

Thereto, 0.39 g (1.2 mmol) of Uronium Salt [3] and 0.47 g (3.6 mmol) of diisopropylethylamine were added and stirred at 60° C. for 3 hours. After cooling, 300 ml of acetone was added and the precipitated crystals were separated by filtration. The crystals were dissolved in 20 ml of methanol, then 0.1 g of sodium acetate was added, further isopropyl alcohol was added, and the precipitated crystals were separated by filtration, washed with isopropyl alcohol and vacuum dried to obtain 0.75 g of the object D-201 as yellow crystals (yield: 60%).

The structure thereof was confirmed by NMR spectrum, MS spectrum and elemental analysis.

Other compounds of the present invention can be synthesized in the same manner as above.

EXAMPLE 2

(Preparation of Seed Emulsion a)

1,164 ml of an aqueous solution containing 0.017 g of KBr and 0.4 g of an oxidation-treated gelatin having an average molecular weight of 20,000 was stirred while keeping it at 35° C. Thereto, an aqueous $AgNO_3$ (1.6 g) solution, an aqueous KBr solution and an aqueous solution of oxidation-treated gelatin (2.1 g) having an average molecular weight of 20,000 were added by a triple jet method over 48 seconds. At this time, the silver potential was kept at 13 mV to the saturated calomel electrode. To the solution obtained, an aqueous KBr solution was added and after adjusting the silver potential to −66 mV, the temperature was elevated to 60° C. Thereafter, 21 g of succinated gelatin having an average molecular weight of 100,000 was added and then an aqueous NaCl (5.1 g) solution was added. Subsequently, an aqueous $AgNO_3$ (206.3 g) solution and an aqueous KBr solution were added by a double jet method over 61 minutes while accelerating each flow rate. At this time, the silver potential was kept at −44 mV to the saturated calomel electrode. After the desalting, succinated gelatin having an average molecular weight of 100,000 was added and the pH and the pAg were adjusted at 40° C. to 5.8 and 8.8, respectively, to prepare a seed emulsion. This seed emulsion was an emulsion of tabular grains containing 1 mol of Ag and 80 g of gelatin per 1 kg of the emulsion and having an average equivalent-circle diameter of 1.46 μm, a coefficient of variation in the equivalent-circle diameter of 28%, an average thickness of 0.046 μm and an average aspect ratio of 32.

(Formation of Core)

1,200 ml of an aqueous solution containing 134 g of Seed Emulsion a prepared above, 1.9 g of KBr and 22 g of succinated gelatin having an average molecular weight of 100,000 was stirred while keeping it at 75° C. An aqueous $AgNO_3$ (43.9 g) solution, an aqueous KBr solution and an aqueous solution of gelatin having a molecular weight of 20,000 which were mixed in a separate chamber having a magnetic coupling induction-type stirring machine described in JP-A-10-43570 immediately before the addition, were added to the solution above over 25 minutes. At this time, the silver potential was kept at −40 mV to the saturated calomel electrode.

(Formation of First Shell)

After the formation of core grains above, an aqueous $AgNO_3$ (43.9 g) solution, an aqueous KBr solution and an aqueous solution of gelatin having a molecular weight of 20,000 which were mixed in the same separate chamber as above immediately before the addition, were added over 20 minutes. At this time, the silver potential was kept at −40 mV to the saturated calomel electrode.

(Formation of Second Shell)

After the formation of the first shell, an aqueous $AgNO_3$ (42.6 g) solution, an aqueous KBr solution and an aqueous solution of gelatin having a molecular weight of 20,000 which were mixed in the same separate chamber as above immediately before the addition, were added over 17 minutes. At this time, the silver potential was kept at −20 mV to the saturated calomel electrode. Thereafter, the temperature was lowered to 55° C.

(Formation of Third Shell)

After the formation of the second shell, the silver potential was adjusted to −55 mV, an aqueous $AgNO_3$ (7.1 g) solution, an aqueous KI (6.9 g) solution and an aqueous solution of gelatin having a molecular weight of 20,000 which were mixed in the same separate chamber as above immediately before the addition, were added over 5 minutes.

(Formation of Fourth Shell)

After the formation of the third shell, an aqueous $AgNO_3$ (66.4 g) solution and an aqueous KBr solution were added each at a constant flow rate over 30 minutes by a double jet method. In the way of addition, potassium iridium hexachloride and yellow prussiate of potash were added. At this time, the silver potential was kept at 30 mV to the saturated calomel electrode. The resulting solution was subjected to normal water washing, gelatin was added thereto, and the pH and the pAg were adjusted at 40° C. to 5.8 and 8.8, respectively. This emulsion was designated as Emulsion b. Emulsion b was an emulsion of tabular grains having an average equivalent-circle diameter of 3.3 μm, a coefficient of variation in the equivalent circle diameter of 21%, an average thickness of 0.090 μm and an average aspect ratio of 37. In the emulsion, 70% or more of the entire projected area was occupied by tabular grains having an equivalent-circle diameter of 3.3 μm or more and a thickness of 0.090 μm or less. Assuming that the dye occupation area was 80 $Å^2$, the single layer saturation coverage was $1.45\times10^{-3}$ mol/mol-Ag.

The temperature of Emulsion b was elevated to 56° C. and after adding $1.2\times10^{-3}$ mol/mol-Ag of Comparative Dye S-1 shown below, chemical sensitization was optimally performed by adding C-5, potassium thiocyanate, chloroauric acid, sodium thiosulfate and N,N-dimethylselenourea. Furthermore, $2.5\times10^{-4}$ mol/mol-Ag of S-1 was added and stirred for 60 minutes to prepare an emulsion for Comparative Example 1.

(2) Measurements of Light Absorption Intensity and Absorption Amount

The light absorption intensity per unit area was measured as follows. The emulsion obtained was thinly coated on a slide glass and the transmission spectrum and reflection spectrum of individual grains were determined using a microspectrophotometer MSP65 prepared by Karl Zweiss Co.,Ltd., by the following method to determine the absorption spectrum. The area where grains were not present was used as the reference for the transmission spectrum, and the reference for the reflection spectrum was obtained by measuring silicon carbide of which reflectance is known. The measured area is a circular aperture part having a diameter of 1 μm. After adjusting the position not to allow the aperture part to overlap the contour of a grain, the transmission spectrum and the reflection spectrum were measured in the wave number region of 14,000 $cm^{-1}$ (714 nm) to 28,000 $cm^{-1}$ (357 nm). The absorption spectrum was determined from the absorption factor A which is 1—T (transmittance)—R (reflectance). Using the absorption factor A' obtained by subtracting the absorption of silver halide, −Log(1−A') was integrated to the wave number ($cm^{-1}$) and the value obtained was halved and used as a light absorption intensity per unit area. The integration range was from 14,000 to 28,000 $cm^{-1}$. At this time, the light source used was a tungsten lamp and the light source voltage was 8 V. In order to minimize the damage of the dye due to light irradiation, a monochromator in the primary side was used and the wavelength distance and the slit width were set to 2 nm and 2.5 nm, respectively. In the determination of the absorption spectrum and the light absorption intensity, 200 grains were measured.

The dye adsorption amount was measured as follows. The liquid emulsion was precipitated by centrifugation at 10,000 rpm for 10 minutes, the precipitate was freeze-dried and thereto, 25 ml of an aqueous 25% sodium thiosulfate solution and methanol were added to make 50 ml. This solution was analyzed by high-performance liquid chromatography and the dye concentration was quantitated to determine the dye adsorption amount. From the dye adsorption amount and the single layer saturated coverage, the dye adsorption layer number was obtained.

(3) Preparation of Coated Sample

An emulsion layer and a protective layer shown in Table 1 were coated on a triacetyl cellulose film support having provided thereon an undercoat layer. Also, Samples 101 to 122 were prepared by changing Comparative Compound S-1 to an equimolar amount of the compound of the present invention.

TABLE 1

| Emulsion Coating Conditions | |
|---|---|
| (1) Emulsion Layer | |
| Emulsion: Emulsion b (dye used is shown in Table 2) | |
| Coupler: | ($1.6 \times 10^{-3}$ mol/m$^2$) |

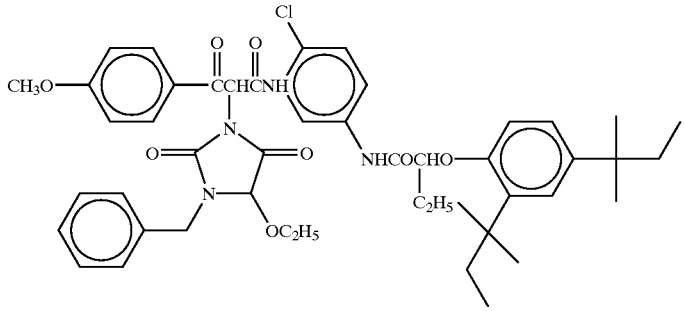

| | |
|---|---|
| Tricresyl phosphate | (1.50 g/m$^2$) |
| Gelatin | (2.30 g/m$^2$) |
| (2) Protective Layer | |
| 2,4-Dichloro-6-hydroxy-s-triazine sodium salt | (0.08 g/m$^2$) |
| Gelatin | (1.80 g/m$^2$) |

These samples each was subjected to exposure for sensitometry (1/100 seconds) and then to the following color development.

Processing Method:

| Step | Processing Time | Processing Temperature (° C.) | Replenishing Amount (ml) | Tank Volume (liter) |
|---|---|---|---|---|
| Color development | 2 min 45 sec | 38 | 33 | 20 |
| Bleaching | 6 min 30 sec | 38 | 25 | 40 |
| Water washing | 2 min 10 sec | 24 | 1,200 | 20 |
| Fixing | 4 min 20 sec | 38 | 25 | 30 |
| Water washing 1 | 1 min 05 sec | 24 | counter-current piping system from (2) to (1) | 10 |
| Waster washing2 | 1 min 00 sec | 24 | 1,200 | 10 |
| Stabilization | 1 min 05 sec | 38 | 25 | 10 |
| Drying | 4 min 20 sec | 55 | | |

The replenishing amount was per 1-m length in 35-mm width.

The composition of each processing solution is shown below.

(Color Developer)

| | Tank Solution (g) | Replenisher (g) |
|---|---|---|
| Diethylenetriaminepentaacetic acid | 1.0 | 1.1 |
| 1-Hydroxyethylidene-1,1-diphosphonic acid | 3.0 | 3.2 |
| Sodium sulfite | 4.0 | 4.4 |
| Potassium carbonate | 30.0 | 37.0 |
| Potassium bromide | 1.4 | 0.7 |
| Potassium iodide | 1.5 ml | — |

-continued (Color Developer)

| | Tank Solution (g) | Replenisher (g) |
|---|---|---|
| Hydroxylamine sulfate | 2.4 | 2.8 |
| 4-[N-Ethyl-N-(β-hydroxyethyl)-amino]-2-methylaniline sulfate | 4.5 | 5.5 |
| Water to make | 1.0 liter | 1.0 liter |
| pH | 10.05 | 10.05 |
| (Bleaching Solution) | | |
| Sodium ethylenediamine-tetraacetato ferrate trihydrate | 100.0 | 120.0 |
| Disodium ethylenediamine-tetraacetate | 10.0 | 11.0 |
| Ammonium bromide | 140.0 | 160.0 |
| Ammonium nitrate | 30.0 | 35.0 |
| Aqueous ammonia (27%) | 6.5 ml | 4.0 ml |
| Water to make | 1.0 liter | 1.0 liter |
| PH | 6.0 | 5.7 |
| (Fixing Solution) | | |
| Sodium ethlenediaminetetraacetate | 0.5 | 0.7 |
| Sodium sulfite | 7.0 | 8.0 |
| Sodium bisulfite | 5.0 | 5.5 |
| Aqueous ammonium thiosulfate (70%) | 170.0 ml | 200.0 ml |
| Water to make | 1.0 liter | 1.0 liter |
| PH | 6.7 | 6.65 |
| (Stabilizing Solution) | | |
| Formalin | 2.0 ml | 3.0 ml |
| Polyoxyethylene-p-monononylphenyl ether (average polymerization degree: 10) | 0.3 | 0.45 |
| Disodium ethylenediamine-tetraacetate | 0.05 | 0.08 |
| Water to make | 1.0 liter | 1.0 liter |
| pH | 5.8–8.0 | 5.8–8.0 |

Each processed Sample was measured on the density through a blur filter and evaluated on the sensitivity and fog.

The sensitivity is defined as a reciprocal of the exposure amount of giving a density 0.2 higher than the fog density, and the sensitivity of each sample is shown by a relative value to Sample 101 of which sensitivity was taken as 100. The emulsion used in each Sample, the light absorption intensity of each compound in Comparative Example and the present invention, and the sensitivity of each Sample are shown in Table 2. The light absorption intensity is an average value of 200 grains, obtained by microspectrophotometry. The light absorption intensity and the sensitivity both are based on the values of Comparative Example 101. Incidentally, the light absorption of Comparative Example 101 was 58.

TABLE 2

| Sample No. | Compound | Light Absorption Intensity | Sensitivity | Remarks |
|---|---|---|---|---|
| 101 | S-1 | 1 (control) | 100 (control) | Comparison |
| 102 | D-1 | 1.71 | 156 | Invention |
| 103 | D-2 | 1.83 | 167 | Invention |
| 104 | D-3 | 1.82 | 164 | Invention |
| 105 | D-5 | 1.83 | 167 | Invention |
| 106 | D-7 | 1.79 | 163 | Invention |
| 107 | D-12 | 1.81 | 165 | Invention |
| 108 | D-13 | 1.80 | 166 | Invention |
| 109 | D-14 | 1.79 | 164 | Invention |
| 110 | D-20 | 1.84 | 169 | Invention |
| 111 | D-21 | 1.81 | 166 | Invention |
| 112 | D-22 | 1.84 | 169 | Invention |
| 113 | D-27 | 1.75 | 160 | Invention |
| 114 | D-29 | 1.77 | 162 | Invention |
| 115 | D-35 | 1.78 | 162 | Invention |
| 116 | D-36 | 1.79 | 164 | Invention |
| 117 | D-37 | 1.79 | 164 | Invention |
| 118 | D-38 | 1.78 | 162 | Invention |
| 119 | D-39 | 1.78 | 162 | Invention |
| 120 | D-40 | 1.79 | 164 | Invention |
| 121 | D-43 | 1.80 | 165 | Invention |
| 122 | S-2 | 1.62 | 146 | Comparison |

S-1

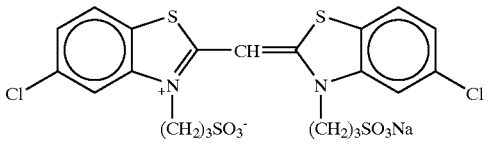

S-2

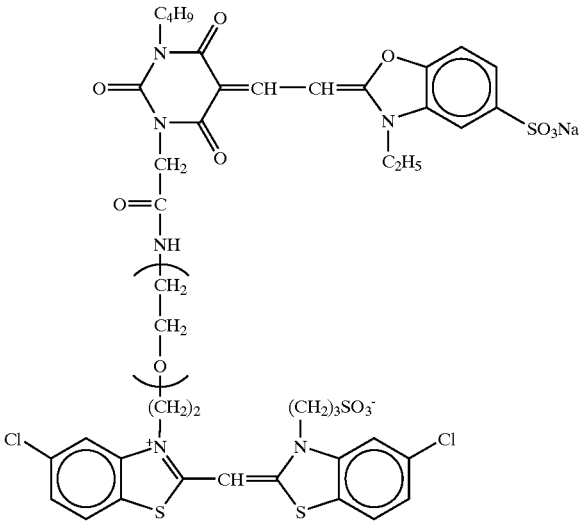

TABLE 2-continued

| Sample No. | Compound | Light Absorption Intensity | Sensitivity | Remarks |
|---|---|---|---|---|
| C-5 | 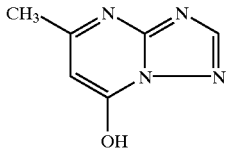 | | | |

It is apparent from Table 2 that as compared with Comparative Compound S-1, the compound of the present invention has an effect of improving the absorptivity by virtue of the multiple structure formed by the compound and as a result, the sensitivity is elevated. Furthermore, this effect is higher than that of Comparative Compound S-2 described in European Patent application 887700A1.

In Sample 110 using Compound D-20 of the present invention, the adsorption layer number is 1.91 and this reveals that nearly a two-layer structure is formed.

From these results, it is verified that the photo-excited second layer dye contributes to the attainment of high sensitivity by way of energy transfer or electron transfer to the first layer dye.

EXAMPLE 3

The same comparison as in Example 2 was performed in the color negative light-sensitive material system of Example 5 of JP-A-8-29904. As a result, assuming that the sensitivity of the blue-sensitive layer of the light-sensitive material using Comparative Example S-1 was 100 (control), the sensitivity of the light-sensitive material using D-20 of the present invention was as high as 165. Also, the same comparison was performed in the instant light-sensitive material system of Example 1 of JP-A-284442/2000, as a result, assuming that the sensitivity of the blue-sensitive layer of the light-sensitive material using Comparative Example S-1 was 100 (control), the sensitivity of the light-sensitive material using D-9 of the present invention was as high as 163. Similarly, in the color reversal light-sensitive material system of Example 1 of JP-A-7-92601 and JP-A-11-160828, the color paper system of Example 1 of JP-A-6-347944, the X-ray light-sensitive material of Example 1 of JP-A-8-122954, the photo-thermographic material system of Example 1 of Japanese Patent Application No. 2000-89436, and the printing light-sensitive material system of Example 1 of JP-A-8-292512, the light-sensitive material using the compound of the present invention was found to yield high sensitivity as compared with those using a comparative compound. Furthermore, in any of these systems, high light absorption intensity and a large chromophore adsorption layer number are attained and this reveals that the present invention is useful also in this respect.

EXAMPLE 4

An emulsion layer and a protective layer shown in Table 3 were coated on a triacetyl cellulose film support having provided thereon an undercoat layer. Samples 201 to 218 were prepared by using, in the emulsion layer, Emulsion b or an emulsion prepared according to the same formulation as Emulsion b of Example 2 except for changing Comparative Compound S-1 to an equimolar amount of the compound of the present invention. The thus-obtained Samples were evaluated in the same manner as in Example 2.

TABLE 3

| Emulsion Coating Conditions | |
|---|---|
| (1) Emulsion Layer | |
| Emulsion: Emulsion b (dye used is shown in Table 2) | |
| Coupler: | ($1.6 \times 10^{-3}$ mol/m$^2$) |

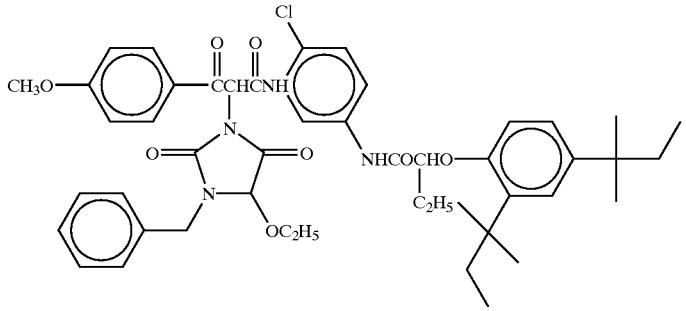

| | |
|---|---|
| Tricresyl phosphate | (1.10 g/m$^2$) |
| Gelatin | (2.30 g/m$^2$) |
| (2) Protective Layer | |
| 2,4-Dichloro-6-hydroxy-s-triazine sodium salt | (0.08 g/m$^2$) |
| Gelatin | (1.80 g/m$^2$) |

The sensitivity is defined as a reciprocal of the exposure amount of giving a density 0.2 higher than the fog density, and the sensitivity of each sample is shown by a relative value to Sample 101 of which sensitivity was taken as 100. The emulsion used in each Sample, the light absorption intensity of each compound in Comparative Example and the present invention, and the sensitivity of each Sample are shown in Table 4. The light absorption intensity is an average value of 200 grains, obtained by the microspectrophotometry described above. The light absorption intensity and the sensitivity both are based on the values of Comparative Example 201. Incidentally, the light absorption of Comparative Example 201 was 58.

TABLE 4

| Sample | Compound | Light Absorption Intensity | Sensitivity | Remarks |
|---|---|---|---|---|
| 201 | S-1 | 1 (control) | 100 (control) | Comparison |
| 202 | D-101 | 1.83 | 166 | Invention |
| 203 | D-103 | 1.79 | 169 | Invention |
| 204 | D-104 | 1.81 | 168 | Invention |
| 205 | D-109 | 1.82 | 165 | Invention |
| 206 | D-113 | 1.79 | 169 | Invention |
| 207 | D-119 | 1.79 | 161 | Invention |
| 208 | D-120 | 1.73 | 159 | Invention |
| 209 | D-121 | 1.75 | 162 | Invention |
| 210 | D-122 | 1.71 | 157 | Invention |
| 211 | D-123 | 1.77 | 165 | Invention |
| 212 | D-125 | 1.81 | 162 | Invention |
| 213 | D-127 | 1.77 | 164 | Invention |
| 214 | D-128 | 1.76 | 167 | Invention |
| 215 | D-129 | 1.79 | 166 | Invention |
| 216 | D-130 | 1.76 | 163 | Invention |
| 217 | D-132 | 1.75 | 162 | Invention |
| 218 | S-2 | 1.53 | 138 | Comparison |

It is apparent from Table 4 that as compared with Comparative Compound S-1, the compound of the present invention has an effect of improving the absorptivity, which seems to be ascribable to the multiple structure formed by the compound, and as a result, the sensitivity is elevated. Furthermore, this effect is higher than that of the cyanine-merocyanine connected Dye S-2 described in European Patent Application 887700A.

In Sample 103 using Compound D-103 of the present invention, the adsorption layer number is 1.93 and this reveals that nearly a two-layer structure is formed. Also, the distance in 50% of Amax is relatively narrow and 55 nm and this is advantageous. Furthermore, the first layer dye and the second layer dye both form a J-association product.

From these results, it is verified that the light-sensitive material using the sensitizing dye of the present invention shows high sensitivity because the photo-excited second layer dye contributes to the attainment of high sensitivity by way of energy transfer or electron transfer to the first layer dye.

EXAMPLE 5

The same comparison as in Example 4 was performed in the color negative light-sensitive material system of Example 5 of JP-A-8-29904. As a result, assuming that the sensitivity of the blue-sensitive layer of the light-sensitive material using Comparative Example S-1 was 100 (control), the sensitivity of the light-sensitive material using D-103 of the present invention was as high as 166. Also, the same comparison was performed in the instant light-sensitive material system of Example 1 of JP-A-28442/2000, as a result, assuming that the sensitivity of the blue-sensitive layer of the light-sensitive material using Comparative Example S-1 was 100 (control), the sensitivity of the light-sensitive material using D-108 of the present invention was as high as 164. Similarly, in the color reversal light-sensitive material system of Example 1 of JP-A-7-92601 and JP-A-11-160828, the color paper system of Example 1 of JP-A-6-347944, the X-ray light-sensitive material of Example 1 of JP-A-8-122954, the photo-thermographic material system of Example 1 of Japanese Patent Application No. 2000-89436, and the printing light-sensitive material system of Example 1 of JP-A-8-292512, the light-sensitive material using the compound of the present invention was found to yield high sensitivity as compared with those using a comparative compound. Furthermore, in any of these systems, the light-sensitive material using the compound of the present invention is favored with high light absorption intensity and a large chromophore adsorption layer number and this reveals that the present invention is useful also in this respect.

EXAMPLE 6

An emulsion layer and a protective layer shown in Table 5 were coated on a triacetyl cellulose film support having provided thereon an undercoat layer. Samples 301 to 324 were prepared by using, in the emulsion layer, Emulsion b or an emulsion prepared according to the same formulation as Emulsion b of Example 2 except for changing Comparative Compound S-1 to an equimolar amount of the compound of the present invention. The thus-obtained Samples were evaluated in the same manner as in Example 2.

TABLE 5

| Emulsion Coating Conditions | |
|---|---|
| (1) Emulsion Layer | |
| Emulsion: Emulsion b (dye used is shown in Table 2) | |
| Coupler: | ($1.5 \times 10^{-3}$ mol/m$^2$) |

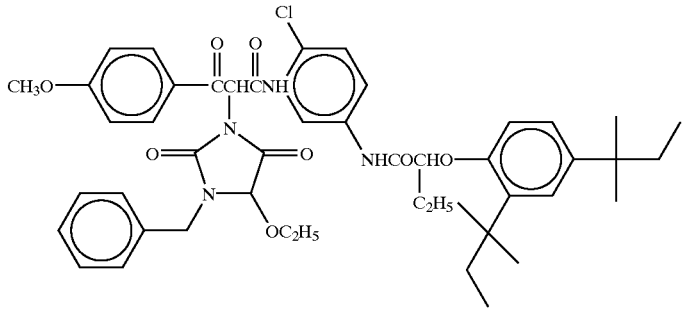

| | |
|---|---|
| Tricresyl phosphate | (1.10 g/m$^2$) |
| Gelatin | (2.30 g/m$^2$) |
| (2) Protective Layer | |
| 2,4-Dichloro-6-hydroxy-s-triazine sodium salt | (0.08 g/m$^2$) |
| Gelatin | (1.80 g/m$^2$) |

The sensitivity is defined as a reciprocal of the exposure amount of giving a density 0.2 higher than the fog density, and the sensitivity of each sample is shown by a relative value to Sample 301 of which sensitivity was taken as 100. The emulsion used in each Sample, the light absorption intensity of each compound in Comparative Example and the present invention, and the sensitivity of each Sample are shown in Table 6. The light absorption intensity is an average value of 200 grains, obtained by microspectrophotometry. The light absorption intensity and the sensitivity both are based on the values of Comparative Example 301. Incidentally, the light absorption of Comparative Example 301 was 58.

TABLE 6

| Sample No. | Compound | Light Absorption Intensity | Sensitivity | Remarks |
|---|---|---|---|---|
| 301 | S-1 | 1 (control) | 100 (control) | Comparison |
| 302 | D-202 | 1.86 | 169 | Invention |
| 303 | D-203 | 1.82 | 172 | Invention |

TABLE 6-continued

| Sample No. | Compound | Light Absorption Intensity | Sensitivity | Remarks |
|---|---|---|---|---|
| 304 | D-204 | 1.84 | 171 | Invention |
| 305 | D-205 | 1.85 | 168 | Invention |
| 306 | D-206 | 1.85 | 168 | Invention |
| 307 | D-207 | 1.83 | 166 | Invention |
| 308 | D-208 | 1.84 | 166 | Invention |
| 309 | D-210 | 1.80 | 164 | Invention |
| 310 | D-222 | 1.84 | 170 | Invention |
| 311 | D-224 | 1.84 | 165 | Invention |
| 312 | D-226 | 1.83 | 165 | Invention |
| 313 | D-228 | 1.83 | 165 | Invention |
| 314 | D-234 | 1.83 | 167 | Invention |

TABLE 6-continued

| Sample No. | Compound | Light Absorption Intensity | Sensitivity | Remarks |
|---|---|---|---|---|
| 315 | D-235 | 1.79 | 170 | Invention |
| 316 | D-236 | 1.81 | 169 | Invention |
| 317 | D-237 | 1.79 | 166 | Invention |
| 318 | D-238 | 1.80 | 166 | Invention |
| 319 | D-240 | 1.80 | 165 | Invention |
| 320 | D-243 | 1.79 | 165 | Invention |
| 321 | D-244 | 1.79 | 163 | Invention |
| 322 | D-254 | 1.69 | 151 | Invention |
| 323 | I-4 | 1.80 | 166 | Invention |
| 324 | I-17 | 1.85 | 168 | Invention |

It is apparent from Table 6 that as compared with the comparative compound, the compound of the present invention has an effect of improving the absorptivity by virtue of the multiple structure formed by the compound, and as a result, the sensitivity is elevated. Furthermore, out of the compounds of the present invention, when the linking group L1 contains an amide group, an ester group or the like, the effect is higher than that obtained in the case where L1 is a mere alkylene group.

In Sample 303 using Compound D-203 of the present invention, the adsorption layer number is 1.93 and this reveals that nearly a two-layer structure is formed. Also, the distance in 50% of Amax is relatively narrow and 55 nm and this is advantageous. Furthermore, the first layer dye and the second layer dye both form a J-association product.

From these results, it is verified that the photo-excited second layer dye contributes to the attainment of high sensitivity by way of energy transfer or electron transfer to the first layer dye.

EXAMPLE 7

The same comparison as in Example 6 was performed in the color negative light-sensitive material system of Example 5 of JP-A-8-29904. As a result, assuming that the sensitivity of the blue-sensitive layer of the light-sensitive material using Comparative Example S-1 was 100 (control), the sensitivity of the light-sensitive material using D-203 of the present invention was as high as 166. Also, the same comparison was performed in the instant light-sensitive material system of Example 1 of JP-A-28442/2000, as a result, assuming that the sensitivity of the blue-sensitive layer of the light-sensitive material using Comparative Example S-1 was 100 (control), the sensitivity of the light-sensitive material using D-208 of the present invention was as high as 164. Similarly, in the color reversal light-sensitive system of Example 1 of JP-A-7-92601 and JP-A-11-160828, the color paper system of Example 1 of JP-A-6-347944, the X-ray light-sensitive material of Example 1 of JP-A-8-122954, the photo-thermographic material system of Example 1 of Japanese Patent Application No. 2000-89436, and the printing light-sensitive material system of Example 1 of JP-A-8-292512, the light-sensitive material using the compound of the present invention was found to yield high sensitivity as compared with those using a comparative compound. Furthermore, in any of these systems, high light absorption intensity and a large chromophore adsorption layer number are attained and this reveals that the present invention is useful also in this respect.

By using the methine dye connected compound of the present invention, a multilayer structure is formed and therefore, the light absorptivity is improved, as a result, a high-sensitivity silver halide photographic light-sensitive material can be obtained.

While the invention has been described in detail and with reference to specific embodiments thereof, it will be apparent to one skilled in the art that various changes and modifications can be made therein without departing from the spirit and scope thereof.

What is claimed is:

1. A silver halide photographic light-sensitive material comprising a compound represented by the following formula (6):

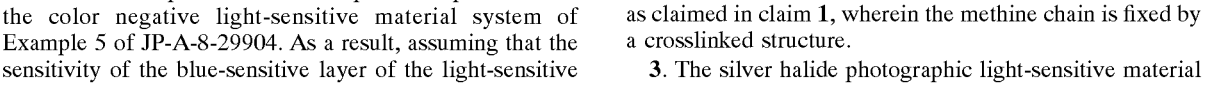

$$A_{61}\text{-}(L_{61}\text{-}(A_{62})_{n61})_{m61} \quad (6)$$

wherein $A_{61}$ represents a first chromophore, $A_{62}$ represents a second chromophore, provided that at least one of $A_{61}$ and $A_{62}$ is a polymethine chromophore comprising a methine chain and the methine chain of the polymethine chromophore is not isomerized geometrically when the polymethine chromophore is excited, $L_{61}$ represents a linking group or a single bond, and n61 and m61 each represents an integer of 1 to 5.

2. The silver halide photographic light-sensitive material as claimed in claim 1, wherein the methine chain is fixed by a crosslinked structure.

3. The silver halide photographic light-sensitive material as claimed in claim 1, wherein the compound comprises from 1 to 10 dissociative groups.

4. A silver halide photographic light-sensitive material comprising a compound represented by formula (7):

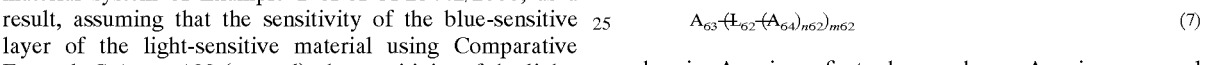

$$A_{63}\text{-}(L_{62}\text{-}(A_{64})_{n62})_{m62} \quad (7)$$

wherein $A_{63}$ is a first chromophore, $A_{64}$ is a second chromophore, provided that at least one of $A_{63}$ and $A_{64}$ is a cyanine chromophore or a merocyanine chromophore comprising a 5- or 6-membered nitrogen-containing heterocyclic ring which may further be condensed with a benzene ring and the nitrogen-containing heterocyclic ring or the condensed benzene ring has from 1 to 10 dissociative groups directly substituted to the nitrogen-containing heterocyclic ring or the condensed benzene ring, $L_{62}$ represents a linking group or a single bond, and $n_{62}$ and $m_{62}$ each represents an integer of 1 to 5.

5. The silver halide photographic light-sensitive material as claimed in claim 1, wherein the polymethine chromophore is a cyanine chromophore.

6. The silver halide photographic light-sensitive material as claimed in claim 1, wherein $A_{62}$ is a polymethine chromophore.

7. The silver halide photographic light-sensitive material as claimed in claim 6, wherein the adsorption strength of $A_{61}$ and $A_{62}$ to silver halide grain is $A_{61}>A_{62}$.

8. The silver halide photographic light-sensitive material as claimed in claim 4, wherein $A_{64}$ is a cyanine chromophore or a merocyanine chromophore, and the adsorption strength of $A_{63}$ and $A_{64}$ to silver halide grain is $A_{63}>A_{64}$.

* * * * *